US012767389B1

(12) United States Patent
Brown et al.

(10) Patent No.: US 12,767,389 B1
(45) Date of Patent: Oct. 20, 2026

(54) INTERLOCKING SECTIONAL CONTAINER FOR MAINTAINING CONTACT BETWEEN SOLID AND FLUID CONTENTS REGARDLESS OF CONTAINER ORIENTATION

(71) Applicant: Fourth Axis LLC, Boise, ID (US)

(72) Inventors: Christine Brown, Boise, ID (US); William Dyche, Boise, ID (US)

(73) Assignee: Fourth Axis LLC, Boise, ID (US)

( * ) Notice: Subject to any disclaimer, the term of this patent is extended or adjusted under 35 U.S.C. 154(b) by 52 days.

(21) Appl. No.: 18/623,849

(22) Filed: Apr. 1, 2024

(51) Int. Cl.

| | |
|---|---|
| ***A45C 11/04*** | (2006.01) |
| ***A45C 11/00*** | (2006.01) |
| ***B65D 21/02*** | (2006.01) |
| ***B65D 41/04*** | (2006.01) |
| ***B65D 81/22*** | (2006.01) |

(52) U.S. Cl.
CPC ..... *B65D 41/0442* (2013.01); *A45C 11/005* (2013.01); *B65D 21/0224* (2013.01); *B65D 21/023* (2013.01); *B65D 81/22* (2013.01)

(58) Field of Classification Search
CPC ..... B65D 41/0442; B65D 21/0224; B65D 21/023; B65D 81/22; A45C 11/005
USPC ..... 206/205, 5.1; 220/4.26, 4.27
See application file for complete search history.

(56) References Cited

U.S. PATENT DOCUMENTS

| | | | | |
|---|---|---|---|---|
| 3,101,087 A * | 8/1963 | Watson | A45C 11/005 134/146 |
| D350,460 S * | 9/1994 | Picozza | D9/504 |
| 2014/0238949 A1* | 8/2014 | Patel | B65D 1/04 215/6 |

* cited by examiner

*Primary Examiner* — Andrew D Perreault
(74) *Attorney, Agent, or Firm* — Hawley Troxell; Philip McKay

(57) ABSTRACT

A sectional container includes at least one leak-proof container having a container cap that has an interior surface that is substantially semi-spherical or semi-ellipsoidal shaped and a container body that is also substantially semi-spherical or semi-ellipsoidal shaped. When the container cap and container body are removably connected by one or more leak-proof connection devices, a leak-proof containment enclosure that is deep and has continuously curved sides is formed for containing both an item, such as a contact lens, and its required fluid, such as contact lens solution, that is leak-proof and keeps the item and the fluid in relatively constant contact with each other. In some examples, two or more such leak-proof containers are removably interconnected to form an interlocking sectional container.

11 Claims, 48 Drawing Sheets

100

100

100

200

200

200

200

200

200

INTERLOCKING SECTIONAL CONTAINER FOR MAINTAINING CONTACT BETWEEN SOLID AND FLUID CONTENTS REGARDLESS OF CONTAINER ORIENTATION

BACKGROUND

Numerous items in our daily lives and in commerce need to remain in contact with various fluid solutions at all times, or at least when the items are not in use. In some cases, the items need to remain in contact with their respective fluids to prevent drying out and/or harmful exposure to the atmosphere and various environmental elements such as oxygen, bacteria, viruses and various other forms of contamination. Some examples of items that must remain in contact with their respective fluid solutions include, but are not limited to, contact lenses, various membranes, reactive chemicals, food items, medical devices and samples, and even preserved organisms.

It is often the case that items that must remain in contact with their respective fluids are very difficult to transport and store while, at the same time, ensuring that the items remain in relatively constant contact with their respective fluids. Thus, the need to keep these items in contact with their respective fluids represents several long-standing challenges to users, sellers, and transporters of these items.

For instance, there is always the concern that when these items are transit, or in storage, leaks can occur whereby the fluid required to keep the item viable leaks, evaporates, or otherwise is released from a container in which both the item and its respective fluid are stored. However, the expense of providing a container to ensure that the necessary fluid does not leak, evaporate, or otherwise get released from the container can be prohibitive, and even then, still ineffective.

In addition, even if the container in which the item and its respective fluid does not allow the required fluid to leak, evaporate, or otherwise get released, there is still an issue of making sure that the item remains in contact with the fluid inside the container. This can be a significant challenge if the container's orientation is changed.

The challenge arises from the fact that many containers for both the items and their fluids, are relatively shallow. These prior art containers often include at least two parts; a cap for placing the item and its required fluid in the container and a body for holding the item and the fluid. As a result, the level of fluid in the container often fails to fill the entire container, which as noted, is typically shallow to start with. Consequently, when the orientation of the container is changed, all or part of the item may lose contact with the fluid it requires as the fluid shifts while the item remains in place in the shallow body portion.

As a specific illustrative example, consider contact lenses. Virtually every type of contact lens requires the lens to be stored in a contact lens solution when the lens is not actually in the user's eye. It is typically very important that the lens remain in contact with a solution of one type or another in order to prevent the lens from drying out, and/or avoid harmful exposure of the lens to the atmosphere, and various environmental elements such as chemicals, bacteria, viruses, and numerous other forms of contamination. This is a critical requirement in that if the entire lens is not in contact with its respective solution for any significant amount of time, the lens can not only dry out and be ruined, but it can also pose a health hazard if the user tries to wear a dried-out lens or if the lens has been exposed to various harmful environmental elements such as chemicals, bacteria, viruses and various other forms of contamination.

As discussed, it is critical that a contact lens, when not in use, remain in complete contact with its respective solution. However, contact lens containers and contact lenses are personal items that are often carried with the user in purses, briefcases, backpacks, cars, pockets, etc. Contact lens containers and contact lenses also travel with the user and are therefore often put in suitcases, carry-on bags, backpacks, etc., that are out of the control of the user. In addition, contact lens containers and contact lenses are typically stored by the user and therefore often end up in various types of locations including, but not limited to, car center consoles, drawers, and cabinets, etc. Therefore, the contact lens containers, and contact lens therein, are often subject to all kinds of movement, jolts, and multiple changes in orientation.

As a result, contact lens containers are often subjected to various forces and incidents that can cause the contact lens container to leak and/or otherwise allow the contact lenses to dry out and/or be exposed to the environment. In addition, the orientation of the contact lens containers is often variable and often outside the control of the user.

In short, contact lens containers are subject to significant forces and movement that can interfere and negate the ability of the contact lens containers to protect the contact lenses and keep the lenses in relatively constant contact with the solution required to keep the contact lenses viable, safe and healthy.

However, despite the issues discussed above, prior art contact lens containers, and many other types of containers designed to hold an item and its necessary fluid, often fail to rise to the challenge. Again, using prior art contact lens cases as a specific illustrative example, current contact lens cases often leak, are subject to damage, and, in many cases, too easily accidentally open and release the solution and/or lens during normal use under the conditions discussed above.

In addition, prior art contact lens containers are typically shallow and have a defined upright orientation. Consequently, even if the prior art contact lens containers do manage to keep the lens and the solution contained, it is often the case that when the orientation of the prior art contact lens container changes, e.g., the container is turned upside, on its side, or otherwise has its orientation changed from the defined upright orientation, all or part of the contact lenses in these shallow containers lose contact with the solution as the solution shifts while the contact lens remains in place. Again, this issue arises at least in part from the fact that prior art contact lens containers are typically shallow and flat, have a defined upright or correct orientation, and a relatively flat cap potion.

Too often, the result is that when the orientation of the prior art contact lens container is changed, e.g., the prior art contact lens container is placed in a cap down orientation, or an angled orientation, the lens typically remains in the bottom portion of the prior art contact lens container while the fluid flows to the cap, or other portion of the prior art contact lens container containment enclosure. This often results in all or part of the lens losing contact with the solution.

Given the normal use and treatment of contact lens containers discussed above, this often results in dried out, and unusable, contact lenses. As noted above, while prior art contact lens containers are used above as a specific example, the same problem arises for many other items that require relatively constant contact with a fluid at virtually all times.

As discussed above, prior art methods and systems for providing containers for an item in the container and a fluid also within the container often allow the required fluid to leak, evaporate, or otherwise get released, and/or fail to ensure the entire item remains in contact with the fluid inside the container.

What is needed is a technical solution to the long-standing problem of providing a container that cost effectively, efficiently, and reliably keeps an item and its required fluid within the container and in contact with each other without leaking, evaporating, or otherwise getting released, regardless of orientation of the container and even when the container is subject to significant use and abuse.

SUMMARY

Embodiments of the present disclosure provide a solution to the long-standing technical problem of providing a container that cost effectively, efficiently, and reliably keeps an item and its required fluid within the container and in contact with each other without leaking, evaporating, or otherwise releasing the fluid or exposing the item to the environment, regardless of orientation of the container and even when the container is subject to significant use and abuse.

In one embodiment, an interlocking sectional container includes at least one leak-proof container having a container cap that has an interior surface that is substantially semi-spherical or semi-ellipsoidal shaped and a container body that is also substantially semi-spherical or semi-ellipsoidal shaped. In one embodiment, when the container cap and container body are removably connected by one or more leak-proof connection devices, in one embodiment, a relatively deep leak-proof containment enclosure is formed having continuously curved sides for containing both an item, such as a contact lens, and its required fluid, such as contact lens solution.

In one embodiment, when the container cap and container body are removably connected by one or more leak-proof connection devices, a leak-proof containment enclosure is formed having a diameter dimension and depth dimension that are approximately equal and has continuously curved sides for containing both an item, such as a contact lens, and its required fluid, such as contact lens solution.

In one embodiment, when the container cap and container body are removably connected by one or more leak-proof connection devices, a leak-proof containment enclosure is formed having a depth dimension that is approximately one half a diameter dimension for containing both an item, such as a contact lens, and its required fluid, such as contact lens solution.

In some examples, the leak-proof containment enclosure has an interior surface that is substantially spherical or ellipsoidal shaped and smooth so that both the item and the fluid can move freely within the container and with each other. The result is a containment enclosure that has no preferred orientation and is deep and smooth enough to allow the item and fluid to remain in relatively constant contact with each other regardless of the orientation of the sectional container.

In some embodiments, two or more leak-proof containers are removably interconnected to form an interlocking sectional container.

One embodiment of the disclosed leak-proof container is an interlocking sectional container. In one embodiment, the interlocking sectional container includes a first container section and a second container section removably connected to each other by an interconnector such that the first container section and second container section can be connected and separated by a user as desired.

In one embodiment, the first container section includes a first container section cap and a first container section body such that the first container section cap and first container section body can be removably coupled by one or more leak-proof coupling devices, such as, in one embodiment, self-sealing threads and/or O-ring/O-ring contact surface combinations.

In one embodiment, the first container section cap includes an interior surface that is concave and curved to create a first container section cap interior surface that is substantially semi-spherical or semi-ellipsoidal shaped.

In one embodiment, the first container section body includes an interior surface that is concave and curved to create a first container section body interior surface that is also substantially semi-spherical or semi-ellipsoidal shaped.

In one embodiment, when the first container section cap and the first container section body are removably coupled by the one or more leak-proof coupling devices, the substantially semi-spherical or semi-ellipsoidal shaped first container section cap interior surface and substantially semi-spherical or semi-ellipsoidal shaped first container section body interior surface form a relatively deep containment enclosure having continuously curved sides for containing both the item and its required fluid. The result is a containment enclosure that has no preferred orientation and is deep and smooth enough to allow the item and fluid to remain in relatively constant contact with each other regardless of the orientation of the sectional container.

In some examples, the leak-proof containment enclosure is substantially spherical or ellipsoidal shaped so that both the item and the fluid can move freely within the container and with each other. Consequently, when an item and its fluid are contained with the containment enclosure formed by the substantially semi-spherical or semi-ellipsoidal shaped first container section cap interior surface and substantially semi-spherical or semi-ellipsoidal shaped first container section body interior surface, the item and fluid can freely move together within the leak-proof containment enclosure so that fluid remains in contact with the item regardless of orientation of the first container section and/or the disclosed interlocking sectional container.

In one embodiment, the second container section includes a second container section cap and a second container section body such that the second container section cap and second container section body can be removably coupled by one or more leak-proof coupling devices, such as, in one embodiment, self-sealing threads.

In one embodiment, the second container section cap includes an interior surface that is concave and curved to create a second container section cap interior surface that is substantially semi-spherical or semi-ellipsoidal shaped.

In one embodiment, the second container section body includes an interior surface that is concave and curved to create a second container section body interior surface that is also substantially semi-spherical or semi-ellipsoidal shaped.

In one embodiment, when the second container section cap and the second container section body are removably coupled by the one or more leak-proof coupling devices, the substantially semi-spherical or semi-ellipsoidal shaped second container section cap interior surface and substantially semi-spherical or semi-ellipsoidal shaped second container section body interior surface form a relatively deep containment enclosure having continuously curved sides for containing both the item and its required fluid. The result is a containment enclosure that has no preferred orientation and is deep and smooth enough to allow the item and fluid to remain in relatively constant contact with each other regardless of the orientation of the sectional container.

In some examples, the leak-proof containment enclosure is substantially spherical or ellipsoidal shaped so that both the item and the fluid can move freely within the container and with each other. Consequently, when an item and its fluid are contained with the containment enclosure formed by the substantially semi-spherical or semi-ellipsoidal shaped first container section cap interior surface and substantially semi-spherical or semi-ellipsoidal shaped first container section body interior surface, the item and fluid can freely move together within the leak-proof containment enclosure so that fluid remains in contact with the item regardless of orientation of the first container section and/or the disclosed interlocking sectional container.

In one embodiment, when the container cap and container body are removably connected by one or more leak-proof connection devices, a leak-proof containment enclosure is formed having a diameter dimension and depth dimension that are approximately equal and has continuously curved sides for containing both an item, such as a contact lens, and its required fluid, such as contact lens solution.

In one embodiment, when the container cap and container body are removably connected by one or more leak-proof connection devices, a leak-proof containment enclosure is formed having a depth dimension that is approximately one half a diameter dimension for containing both an item, such as a contact lens, and its required fluid, such as contact lens solution.

In one embodiment, the first or second container section cap and first or second container section body are removably coupled by the one or more leak-proof coupling devices that include first or second container section cap self-sealing threads that mate with first or second container section body self-sealing threads.

In one embodiment, the first or second container section cap and first or second container section body are removably coupled by the one or more leak-proof coupling devices that include O-rings and a body/cap O-ring interface surface. In one embodiment, the O-rings and body/cap O-ring interface surface of the first or second container section cap and first or second container section body provide a leak-proof seal in addition to the first or second container section cap self-sealing threads that mate with first or second container section body self-sealing threads.

Therefore, the disclosed embodiments, provide a leak-proof container that prevents the fluid from leaking, evaporating, or otherwise getting released regardless of orientation of the container and even when the container is subject to significant use and abuse.

In one embodiment, the first container section and a second container section are removably connected by an interconnector that includes one or more ball detent connectors housed in one or more ball detent connector housings. In one embodiment, one end of the interconnector is permanently attached to one surface of either the first container section body or the second container section body and the ball detent connectors of the interconnector can then be removably mated with ball detent connector catches formed on the other of the second container section body or the first container section body.

Therefore, the disclosed first and second container sections are removably attached to each other to form the disclosed interlocking sectional container. In this way, the disclosed first and second container sections can be separated from each other and manipulated separately as needed.

As one specific illustrative example, in one embodiment, the disclosed leak-proof container is an interlocking sectional contact lens container. In one embodiment, the interlocking sectional contact lens container includes a first contact lens container and a second contact lens container removably connected to each other by an interconnector such that the first contact lens container and second contact lens container can be connected and separated by a user as needed.

In one embodiment, the first contact lens container includes a first contact lens container cap and a first contact lens container body such that the first contact lens container cap and first contact lens container body can be removably coupled by one or more leak-proof coupling devices, such as, in one embodiment, self-sealing threads.

In one embodiment, the first contact lens container cap includes an interior surface that is concave and curved to create a first contact lens container cap interior surface that is substantially semi-spherical or semi-ellipsoidal shaped.

In one embodiment, the first contact lens container body includes an interior surface that is concave and curved to create a first contact lens container body interior surface that is also substantially semi-spherical or semi-ellipsoidal shaped.

In one embodiment, when the first contact lens container cap and the first contact lens container body are removably coupled by the one or more leak-proof coupling devices, the substantially semi-spherical or semi-ellipsoidal shaped first contact lens container cap interior surface and substantially semi-spherical or semi-ellipsoidal shaped first contact lens container body interior surface form a relatively deep containment enclosure having continuously curved sides for containing both the lens and its required solution. The result is a containment enclosure that has no preferred orientation and is deep and smooth enough to allow the lens and solution to remain in relatively constant contact with each other regardless of the orientation of the sectional container.

In some examples, the resulting leak-proof containment enclosure is substantially spherical or ellipsoidal shaped so that both the lens and the solution can move freely within the container and with each other. Consequently, when a lens and its solution are contained with the containment enclosure formed by the substantially semi-spherical or semi-ellipsoidal shaped first contact lens container cap interior surface and substantially semi-spherical or semi-ellipsoidal shaped first contact lens container body interior surface, the lens and solution can freely move together within the leak-proof containment enclosure so that solution remains in contact with the lens regardless of orientation of the first container section and/or the disclosed interlocking sectional container.

In one embodiment, when the container cap and container body are removably connected by one or more leak-proof connection devices, a leak-proof containment enclosure is formed having a diameter dimension and depth dimension that are approximately equal and has continuously curved sides for containing both an item, such as a contact lens, and its required fluid, such as contact lens solution.

In one embodiment, when the container cap and container body are removably connected by one or more leak-proof connection devices, a leak-proof containment enclosure is formed having a depth dimension that is approximately one half a diameter dimension for containing both an item, such as a contact lens, and its required fluid, such as contact lens solution.

In one embodiment, the second contact lens container includes a second contact lens container cap and a second contact lens container body such that the second contact lens container cap and second contact lens container body can be removably coupled by one or more leak-proof coupling devices, such as, in one embodiment, self-sealing threads.

In one embodiment, the second contact lens container cap includes an interior surface that is concave and curved to create a second contact lens container cap interior surface that is substantially semi-spherical or semi-ellipsoidal shaped. In one embodiment, the second contact lens container body includes an interior surface that is concave and curved to create a second contact lens container body interior surface that is also substantially semi-spherical or semi-ellipsoidal shaped.

In one embodiment, when the second contact lens container cap and the second contact lens container body are removably coupled by the one or more leak-proof coupling devices, the substantially semi-spherical or semi-ellipsoidal shaped second contact lens container cap interior surface and substantially semi-spherical or semi-ellipsoidal shaped second contact lens container body interior surface form a relatively deep containment enclosure having continuously curved sides for containing both the lens and its required solution. The result is a containment enclosure that has no preferred orientation and is deep and smooth enough to allow the lens and solution to remain in relatively constant contact with each other regardless of the orientation of the sectional container.

In some examples, the resulting leak-proof containment enclosure is substantially spherical or ellipsoidal shaped so that both the lens and the solution can move freely within the container and with each other. Consequently, when a lens and its solution are contained with the containment enclosure formed by the substantially semi-spherical or semi-ellipsoidal shaped second contact lens container cap interior surface and substantially semi-spherical or semi-ellipsoidal shaped second contact lens container body interior surface, the lens and solution can freely move together within the leak-proof containment enclosure so that solution remains in contact with the lens regardless of orientation of the first container section and/or the disclosed interlocking sectional container.

In one embodiment, when the container cap and container body are removably connected by one or more leak-proof connection devices, a leak-proof containment enclosure is formed having a diameter dimension and depth dimension that are approximately equal and has continuously curved sides for containing both an item, such as a contact lens, and its required fluid, such as contact lens solution.

In one embodiment, when the container cap and container body are removably connected by one or more leak-proof connection devices, a leak-proof containment enclosure is formed having a depth dimension that is approximately one half a diameter dimension for containing both an item, such as a contact lens, and its required fluid, such as contact lens solution.

In one embodiment, the first or second contact lens container cap and first or second contact lens container body are removably coupled by the one or more leak-proof coupling devices that include first or second contact lens container cap self-sealing threads that mate with first or second contact lens container body self-sealing threads.

In one embodiment, the first or second contact lens container cap and first or second contact lens container body are removably coupled by the one or more leak-proof coupling devices that include O-rings and a body/cap O-ring interface surface. In, one embodiment, the O-rings and body/cap O-ring interface surface of the first or second contact lens container cap and first or second contact lens container body provide a leak-proof seal in addition to the first or second contact lens container cap self-sealing threads that mate with first or second contact lens container body self-sealing threads.

Therefore, the disclosed embodiments, provide a leak-proof container that prevents the contact lens solution from leaking, evaporating, or otherwise getting released regardless of orientation of the container and even when the container is subject to significant use and abuse.

In one embodiment, the first contact lens container and a second contact lens container are removably connected by an interconnector that includes one or more ball detent connectors housed in one or more ball detent connector housings. In one embodiment, one end of the interconnector is permanently attached to one surface of either the first contact lens container body or the second contact lens container body and the ball detent connectors of the interconnector are then mated with ball detent connector catches formed on the other of the second contact lens container body or the first contact lens container body.

Therefore, the disclosed first and second contact lens containers are removably attached to each other to form the disclosed interlocking sectional container. In this way, the disclosed first and second contact lens containers can be separated from each other and manipulated separately so that the user can access and work with each contact lens container and contact lens separately.

As shown above, and as described in more detail below, in one embodiment, a leak-proof container is disclosed that keeps an item, such as a contact lens, and its required fluid, such as a contact lens solution, within the container and in contact with each other without leaking.

As discussed above, and in more detail below, in one embodiment, an item, such as a contact lens, and its fluid, such as contact lens solution, are contained within a relatively deep and smooth sided spherical or ellipsoidal containment enclosure formed by a substantially semi-spherical or semi-ellipsoidal shaped container cap interior surface and substantially semi-spherical or semi-ellipsoidal shaped container body interior surface. Consequently the containment enclosure so formed has no preferred orientation. As a result, the item, such as a contact lens, and the fluid, such as contact lens solution, can freely move together within the spherical or ellipsoidal containment enclosure and remains in contact with each other regardless of orientation of the container and/or the disclosed interlocking sectional container.

As also discussed above, and in more detail below, in one embodiment, the first or second container section cap and first or second container section body are removably coupled by the one or more leak-proof coupling devices that include first or second container section cap self-sealing threads that mate with first or second container section body self-sealing threads.

As also discussed above, and in more detail below, in one embodiment, the first or second container section cap and first or second container section body are removably coupled by the one or more leak-proof coupling devices that include O-rings and a body/cap O-ring interface surface. In, one embodiment, the O-rings and body/cap O-ring interface surface of the first or second container section cap and first or second container section body provide a leak-proof seal in addition to the first or second container section cap self-sealing threads that mate with first or second container section body self-sealing threads.

Therefore, the disclosed embodiments, provides a leakproof container that prevents the fluid, such as contact lens solution, from leaking, evaporating, or otherwise getting released regardless of orientation of the container and even when the container is subject to significant use and abuse.

As also discussed above, and in more detail below, in one embodiment, the first container section and a second container section are removably connected by an interconnector that includes one or more ball detent connectors housed in one or more ball detent connector housings. In one embodiment, one end of the interconnector is permanently attached to one surface of either the first container section body or the second container section body and the ball detent connectors of the interconnector are then mated with ball detent connector catches on the other of the second container section body or the first container section body.

Therefore, the disclosed first and second container sections are removably attached to each other to form the disclosed interlocking sectional container. In this way, the disclosed first and second container sections can be separated from each other and manipulated separately.

Consequently, as discussed in more detail below, embodiments of the present disclosure provide a solution to the long-standing technical problem of providing a container that cost effectively, efficiently, and reliably keeps an item and its required fluid within the container and in contact with each other without leaking, evaporating, or otherwise getting released regardless of orientation of the container and even when the container is subject to significant use and abuse.

For these and numerous other reasons discussed herein, the disclosed methods and systems represent a significant improvement over the prior art methods and systems.

Figure 1A:
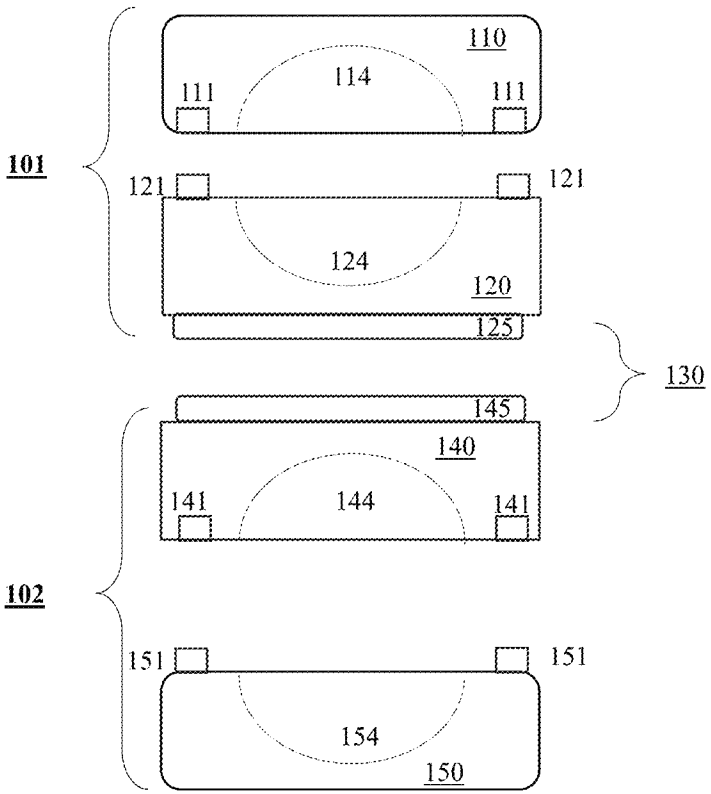
FIG. 1A is an exploded side sectional view of the basic components of an interlocking sectional container in accordance with one embodiment.

Common reference numerals are used throughout the figures and the detailed description to indicate like elements. One skilled in the art will readily recognize that the above figures are merely illustrative examples and that other architectures, modes of operation, orders of operation, and elements/functions can be provided and implemented without departing from the characteristics and features of the invention, as set forth in the claims.

DEFINITIONS

As used herein the term "relatively deep" are used in the term "leak-proof containment enclosure" can include, but is not limited to, a leak-proof containment enclosure having a leak-proof containment enclosure diameter dimension and leak-proof containment enclosure depth dimension that are approximately equal.

As used herein the term "relatively deep" are used in the term "leak-proof containment enclosure" can include, but is not limited to, a leak-proof containment enclosure having a leak-proof containment enclosure depth dimension that is approximately one half a leak-proof containment enclosure diameter dimension for containing both an item, such as a contact lens, and its required fluid, such as contact lens solution.

DETAILED DESCRIPTION

Embodiments will now be discussed with reference to the accompanying figures, which depict one or more exemplary embodiments. Embodiments may be implemented in many different forms and should not be construed as limited to the embodiments set forth herein, shown in the figures, or described below. Rather, these exemplary embodiments are provided to allow a complete disclosure that conveys the principles of the invention, as set forth in the claims, to those of skill in the art.

In one embodiment, an interlocking sectional container includes at least one leak-proof container having a container cap that has an interior surface that is substantially semi-spherical or semi-ellipsoidal shaped and a container body that is also substantially semi-spherical or semi-ellipsoidal shaped.

In one embodiment, when the container section cap and the container section body are removably coupled by the one or more leak-proof coupling devices, the substantially semi-spherical or semi-ellipsoidal shaped container cap interior surface and substantially semi-spherical or semi-ellipsoidal shaped container body interior surface form a relatively deep containment enclosure having continuously curved sides for containing both the item and its required fluid. The result is a containment enclosure that has no preferred orientation and is deep and smooth enough to allow the item and fluid to remain in relatively constant contact with each other regardless of the orientation of the container.

In some examples, the resulting leak-proof containment enclosure is substantially spherical or ellipsoidal shaped so that both the item and the fluid can move freely within the container and with each other. Consequently, when an item and its fluid are contained with the containment enclosure formed by the substantially semi-spherical or semi-ellipsoidal shaped container cap interior surface and substantially semi-spherical or semi-ellipsoidal shaped container body interior surface, the item and fluid can freely move together within the leak-proof containment enclosure so that fluid remains in contact with the item regardless of orientation of the first container section and/or the disclosed interlocking sectional container.

In some embodiments, two or more leak-proof containers are removably interconnected to form an interlocking sectional container.

FIG. 1A is an exploded side sectional view of the basic components of an interlocking sectional container 100 in accordance with one embodiment.

In various embodiments, at least part of the interlocking sectional container 100 and/or the components making up interlocking sectional container 100 are made of any material suitable for forming a leak-proof interlocking sectional container 100 having the properties discussed below, as discussed herein, and/or as known in the art at the time of filing, and/or as becomes known after the time of filing.

In one embodiment, at least part of the interlocking sectional container 100 and/or the components making up interlocking sectional container 100 are made of a polymer material. In one embodiment, at least part of the interlocking sectional container 100 and/or the components making up interlocking sectional container 100 are made of a metal material. In one embodiment, at least part of the interlocking sectional container 100 and/or the components making up interlocking sectional container 100 are made of an alloy material. In one embodiment, at least part of the interlocking sectional container 100 and/or the components making up interlocking sectional container 100 are made of ceramic material. In one embodiment, at least part of the interlocking sectional container 100 and/or the components making up interlocking sectional container 100 are made of a composite material.

As seen in FIG. 1A, in one embodiment, an interlocking sectional container 100 includes a first container section 101 for containing an item and a fluid.

In various embodiments, first container section 101 can be used for containing any item and any fluid that must remain in relatively constant contact with each other, as discussed herein, and/or as known in the art at the time of filing, and/or as becomes known after the time of filing.

In one embodiment, first container section 101 can be used for containing an item and a fluid, such as a contact lens and contact lens solution. In one embodiment, first container section 101 can be used for containing an item and a fluid, such as a medical sample and a fluid required to preserve or protect the medical sample. In one embodiment, first container section 101 can be used for containing an item and a fluid, such as an organic or inorganic membrane and a fluid required to preserve or protect the membrane.

In one embodiment, first container section 101 can be used for containing an item and a fluid, such as a reactive chemical and a fluid required to preserve or protect the reactive chemical, and/or keep it inert. In one embodiment, first container section 101 can be used for containing an item and a fluid, such as a food item and a fluid, such as oil or water, required to preserve or protect the food item.

In one embodiment, first container section 101 can be used for containing an item and a fluid, such as a live organism, such as an aquatic organism, and a fluid, such as fresh or salt water, required to preserve or protect the organism, and keep it alive. In one embodiment, first container section 101 can be used for containing an item and a fluid, such as a preserved organism, and a fluid, such as formaldehyde, required to preserve or protect the preserved organism.

In one embodiment, the first container section 101 is capable of being removably coupled to a second container section 102 by an interconnector 130 such that the first container section 101 and a second container section 102 can be connected and separated by a user as desired.

In one embodiment, the first container section 101 includes a first container section cap 110. In one embodiment, the first container section cap 110 has a first container section cap interior surface portion 114 that is concave and curved. In one embodiment, first container section cap interior surface portion 114 is of a semi-spherical or dome shape. In one embodiment, first container section cap interior surface portion 114 is of a semi-ellipsoidal, such as an egg shape.

In various embodiments, first container section cap interior surface portion 114 can be any three-dimensional shape that includes a relatively uniform and smooth concave and curved surface as discussed herein, and/or as known/available in the art at the time of filing, and/or as developed/made available after the time of filing.

In one embodiment, first container section cap 110 and includes at least one first leak-proof coupling device 111 for removably coupling first container section cap 110 to an at least one second leak-proof coupling device 121 of first container section body 120.

In various other embodiments, first leak-proof coupling device 111 and second leak-proof coupling device 121 can be any device, or combination of devices. capable of forming a leak-proof seal as discussed herein, and/or as available/known in the art at the time of filing, and/or as made known/available after the time of filing.

In one embodiment, first leak-proof coupling device 111 and second leak-proof coupling device 121 are self-sealing threads. In one embodiment, first leak-proof coupling device 111 and second leak-proof coupling device 121 are an O-ring and O-ring contact surface.

In one embodiment, there are two first leak-proof coupling devices 111 and second leak-proof coupling devices 121 to ensure a leak-proof seal. In one embodiment, the two first leak-proof coupling devices 111 and second leak-proof coupling devices 121 are self-sealing threads and O-ring/O-ring contact surface to ensure a leak-proof seal.

As shown in FIG. 1A, in one embodiment, first container section 101 includes a first container section body 120. In one embodiment, first container section body 120 has a first container section body interior surface portion 124 that is concave and curved. In one embodiment, first container section body interior surface portion 124 is of a semi-spherical or dome shape. In one embodiment, first container section body interior surface portion 124 is of a semi-ellipsoidal, such as an egg shape.

In various embodiments, first container section body interior surface portion 124 can be any three-dimensional shape that includes a relatively uniform and smooth concave and curved surface as discussed herein, and/or as known/available in the art at the time of filing, and/or as developed/made available after the time of filing.

In one embodiment, first container section body 120 includes at least one second leak-proof coupling device 121 for removably coupling first container section body 120 to an at least one second leak-proof coupling device 111 of first container section cap 110.

In various other embodiments, first leak-proof coupling device 111 and second leak-proof coupling device 121 can be any devices, or combination of devices capable of forming a leak-proof seal as discussed herein, and/or as available/known in the art at the time of filing, and/or as made known/available after the time of filing.

As discussed above, in one embodiment, first leak-proof coupling device 111 and second leak-proof coupling device 121 are self-sealing threads. In one embodiment, first leak-proof coupling device 111 and second leak-proof coupling device 121 are an O-ring and O-ring contact surface.

In one embodiment, there are two first leak-proof coupling devices 111 and second leak-proof coupling devices 121 to ensure a leak-proof seal. In one embodiment, the two first leak-proof coupling devices 111 and second leak-proof coupling devices 121 are self-sealing threads and O-ring/O-ring contact surface to ensure a leak-proof seal.

In one embodiment, the at least one first leak-proof coupling device 111 of the first container section cap 110 and the at least one second leak-proof coupling device 121 of the first container section body 120 are used to removably couple first container section cap 110 and first container section body 120 to form a leak-proof seal.

Figure 1B:
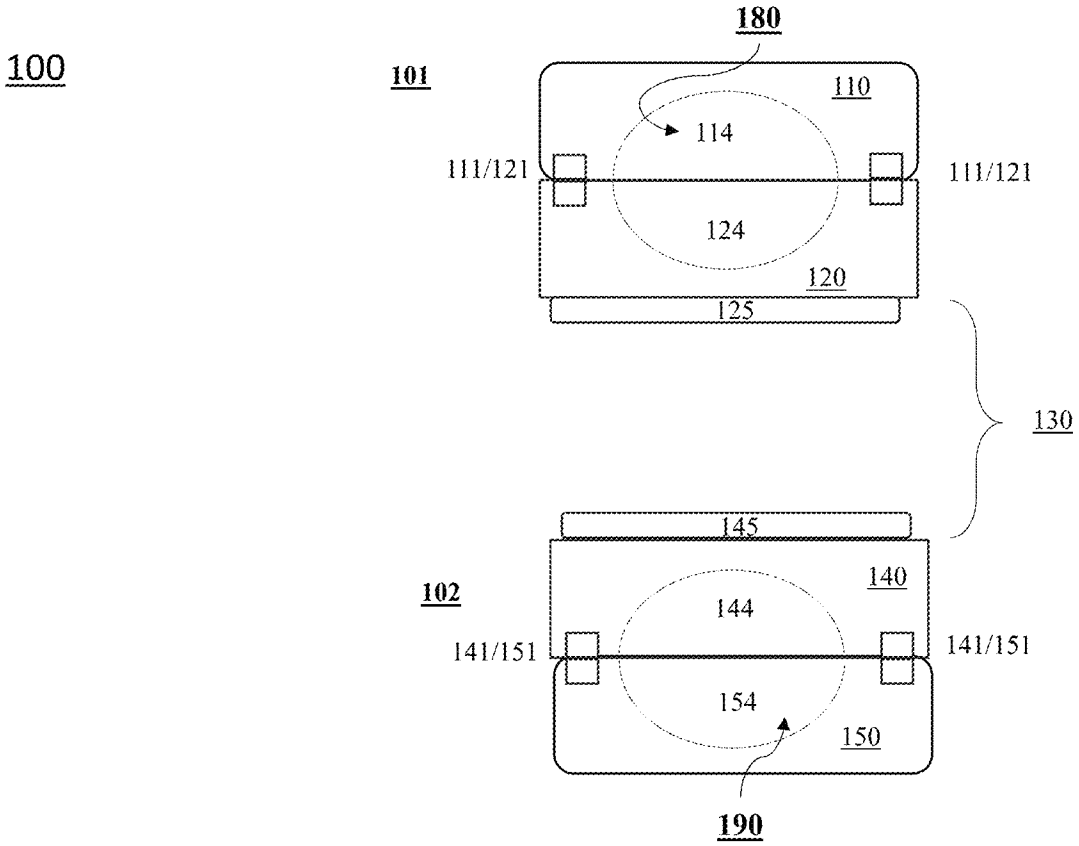
FIG. 1B is a side sectional view of disconnected first container section and second container section assemblies of an interlocking sectional container in accordance with one embodiment.

FIG. 1B is a side sectional view of disconnected first container section 101 and second container section 102 assemblies of an interlocking sectional container 100 in accordance with one embodiment.

In FIG. 1B, the at least one first leak-proof coupling device 111 of the first container section cap 110 and the at least one second leak-proof coupling device 121 of the first container section body 120 have been coupled to form a sealed disconnected first container section 101.

Referring to FIGS. 1A and 1B together, in one embodiment, when the at least one first leak-proof coupling device 111 of the first container section cap 110 and the at least one second leak-proof coupling device 121 of the first container section body 120 are used to removably couple the first container section cap 111 and the first container section body 120 to form a leak-proof seal 111/121, the concave and curved portion 114 of the first container section cap interior surface and the concave and curved portion 124 of the first container section body interior surface form a containment enclosure 180.

In one embodiment, when the at least one first leak-proof coupling device 111 of the first container section cap 110 and the at least one second leak-proof coupling device 121 of the first container section body 120 are used to removably couple first container section cap 110 and first container section body 120 the substantially semi-spherical or semi-ellipsoidal shaped first container section cap 110 interior surface 114 and substantially semi-spherical or semi-ellipsoidal shaped first container section body 120 interior surface 124 form a relatively deep containment enclosure 180 having continuously curved sides in all directions for containing both the item and its required fluid. The result is a containment enclosure 180 that has no preferred orientation and is deep and smooth enough to allow the item and fluid to move together and remain in relatively constant contact with each other regardless of the orientation of the first container section 101.

In some examples, the leak-proof containment enclosure 180 is substantially spherical or ellipsoidal shaped so that both the item and the liquid can move freely within the first container section 101 and thereby remain in contact with each other. Consequently, when an item and its liquid are contained with the leak-proof containment enclosure 180, the item and liquid can freely move together within the leak-proof containment enclosure 180 so that the liquid remains in contact with the item regardless of orientation of the first container section 101 and/or the disclosed interlocking sectional container 100.

As noted, in one embodiment, the containment enclosure 180 formed by the concave and curved portion 114 of the first container section cap interior surface and the concave and curved portion 124 of the first container section body interior surface is a substantially spherical containment enclosure 180.

As also noted, in one embodiment, the containment enclosure 180 formed by the concave and curved portion 114 of the first container section cap interior surface and the concave and curved portion 124 of the first container section body interior surface is a substantially ellipsoidal containment enclosure 180.

In one embodiment, the containment enclosure 180 formed by the concave and curved portion 114 of the first container section cap interior surface and the concave and curved portion 124 of the first container section body interior surface is a hybrid substantially spherical and substantially ellipsoidal containment enclosure 180.

In various embodiments, the containment enclosure 180 formed by the concave and curved portion 114 of the first container section cap interior surface and the concave and curved portion 124 of the first container section body interior surface can be any three dimensional, closed compartment that allows and item and fluid to freely move together within the first container section containment enclosure 180 so that the item remains in contact with the fluid regardless of the orientation of the first container section As discussed above, one of the issues with prior art containers, and in particular prior art contact lens containers, is that virtually every type of contact lens requires the lens to be stored in a contact lens solution when the lens is not actually in the user's eye. It is typically very important that the lens remain in contact with a solution of one type or another in order to prevent the lens drying out, and/or avoid harmful exposure to the atmosphere, and various environmental elements such as chemicals, bacteria, viruses, and various other forms of contamination. This is a critical requirement in that if the entire lens is not in contact with its respective solution for any significant amount of time, the lens can not only dry out and be ruined, but it can also pose a health hazard if the user tries to wear a dried-out lens or if the lens is exposed to various harmful environmental elements such as chemicals, bacteria, viruses and various other forms of contamination.

The problem arises from the fact that prior art containers typically provide relatively shallow containment spaces that have well-defined up and down orientations and rely on the contact lens container remaining in the defined upright orientation. In addition, the level of fluid in the container often fails to fill the entire container. Consequently, when the orientation of the prior art containers is changed, e.g., is not the defined upright orientation, all or part of the item may lose contact with the fluid it requires as the fluid shifts but the item remains in place.

As discussed above, in contrast to the prior art, in the various disclosed embodiments, the containment enclosure 180 has a relatively deep and continuously curved sides for containing both an item and a fluid such that item and does not have a mandatory or even preferred orientation. Consequently, fluid can freely move together with an item in the first container section containment enclosure 180 so that the item remains in contact with the fluid regardless of the orientation of the first container section.

Figure 1C:
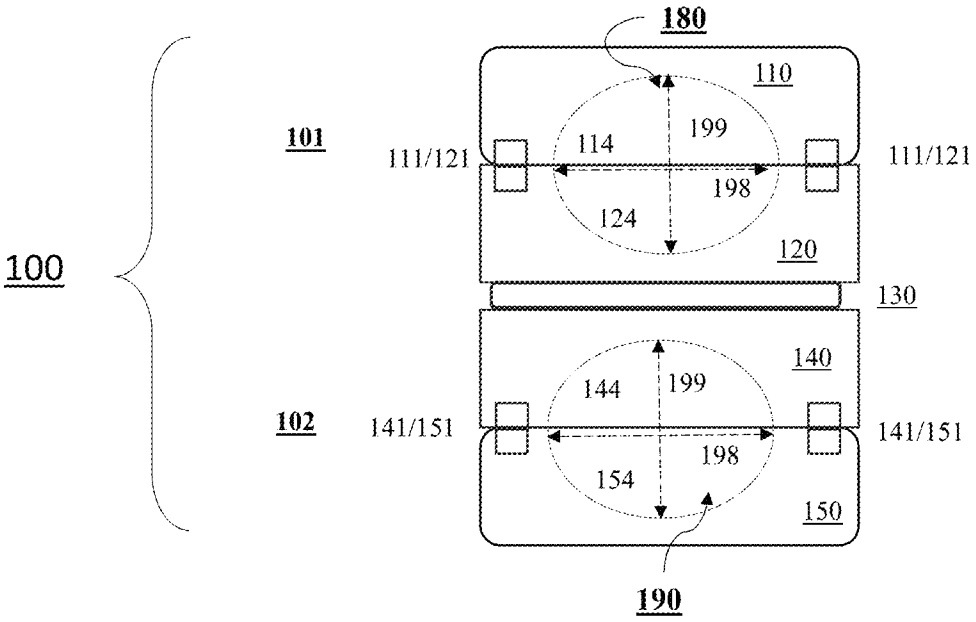
FIG. 1C is a side sectional view of connected first container section and second container section assemblies of an interlocking sectional container in accordance with one embodiment.

FIG. 1C is a side sectional view of connected first container section 101 and second container section 102 of interlocking sectional container 100 in accordance with one embodiment.

Figure 1D:
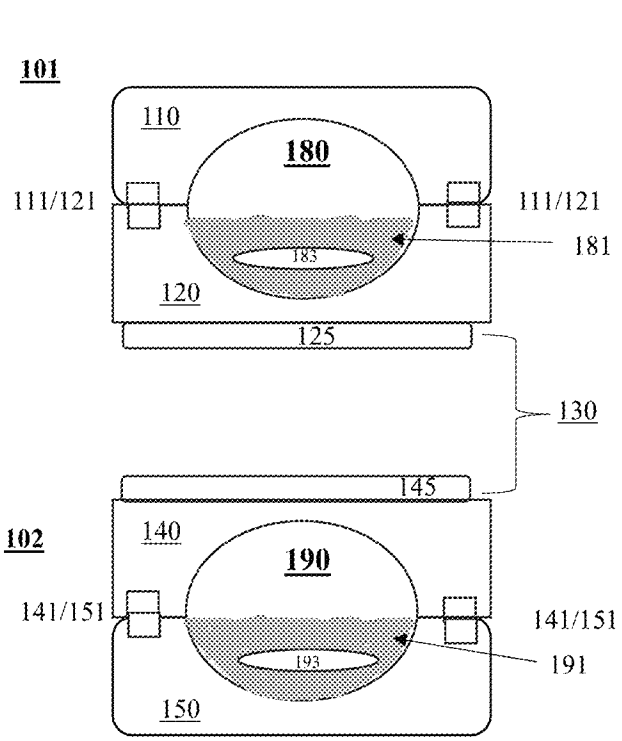
FIG. 1D is a side sectional view of disconnected first container section and second container section assemblies of an interlocking sectional container in a first orientation, including an item and fluid contained in the first container section and second container section assemblies in accordance with one embodiment.

FIG. 1D is a side sectional view of disconnected first container section 101 and second container section 102 assemblies of an interlocking sectional container 100 in a first orientation, including an item 183, such as a contact lens, and fluid, such as contact lens solution 181, contained in the first container section 101 and second container section 102 assemblies in accordance with one embodiment.

Figure 1E:
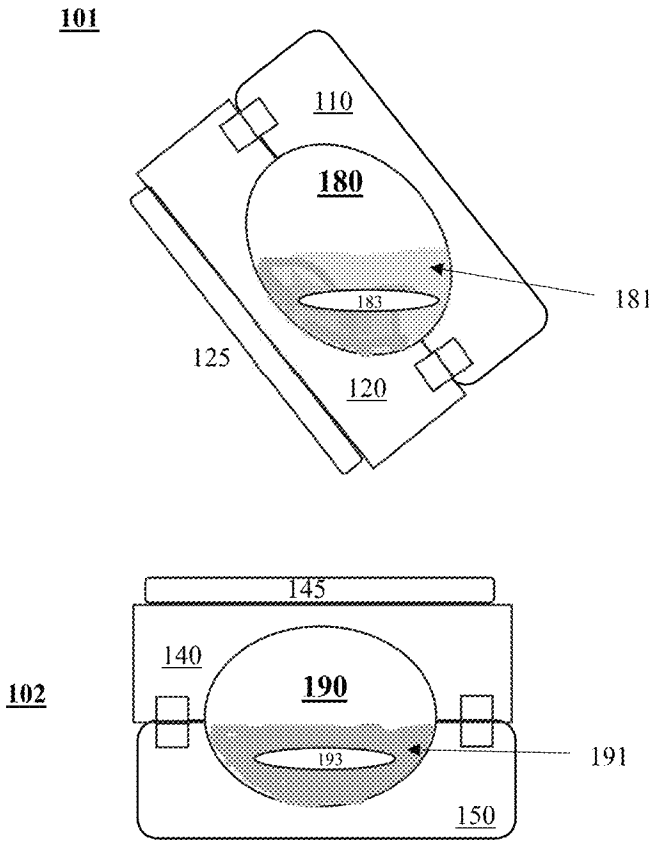
FIG. 1E is a side sectional view of the disconnected first container section and second container section assemblies of an interlocking sectional container of FIG. 1D wherein the first container section is in a second orientation and the second container section is in the first orientation in accordance with one embodiment.

FIG. 1E is a side sectional view of the disconnected first container section 101 and second container section 102 assemblies of an interlocking sectional container 100 of FIG. 1D wherein the first container section 101 is in a second orientation and the second container section 102 is in the first orientation in accordance with one embodiment.

Referring to FIGS. 1D and 1E together, using the disclosed embodiments, in contrast to the prior art, the containment enclosure 180 is a relatively deep containment enclosure 180 and has continuously curved sides in all directions for containing both the item 183 and the fluid 181. Consequently, fluid 181 can freely move together with item 183 in the first container section containment enclosure 180 so that the item 183 remains in contact with the fluid 181 regardless of the orientation, e.g., as the orientation of first container section 101 changes from that of FIG. 1D to that of FIG. 1E the item 183 remains in contact with the fluid 181. This represents a significant improvement over prior art methods and systems.

As also seen in FIG. 1A, in one embodiment, an interlocking sectional container 100 includes a second container section 102 for containing an item and a fluid.

In various embodiments, second container section 102 can be used for containing any item and any fluid that must remain in relatively constant contact with each other, as discussed herein, and/or as known in the art at the time of filing, and/or as becomes known after the time of filing.

In one embodiment, second container section 102 can be used for containing an item and a fluid, such as a contact lens and contact lens solution. In one embodiment, second container section 102 can be used for containing an item and a fluid, such as a medical sample and a fluid required to preserve or protect the medical sample. In one embodiment, second container section 102 can be used for containing an item and a fluid, such as an organic or inorganic membrane and a fluid required to preserve or protect the membrane.

In one embodiment, second container section 102 can be used for containing an item and a fluid, such as a reactive chemical and a fluid required to preserve or protect the reactive chemical, and/or keep it inert. In one embodiment, second container section 102 can be used for containing an item and a fluid, such as a food item and a fluid, such as oil or water, required to preserve or protect the food item.

In one embodiment, second container section 102 can be used for containing an item and a fluid, such as a live organism, such as an aquatic organism, and a fluid, such as fresh or salt water, required to preserve or protect the organism, and keep it alive. In one embodiment, second container section 102 can be used for containing an item and a fluid, such as a preserved organism, and a fluid, such as formaldehyde, required to preserve or protect the preserved organism.

In one embodiment, the second container section 102 is capable of being removably coupled to a first container section 101 by an interconnector 130 such that the first container section 101 and a second container section 102 can be connected and separated by a user as desired.

In one embodiment, the second container section 102 includes a second container section cap 150. In one embodiment, the second container section cap 150 has a second container section cap interior surface portion 154 that is concave and curved. In one embodiment, second container section cap interior surface portion 154 is of a semi-spherical or dome shape. In one embodiment, second container section cap interior surface portion 154 is of a semi-ellipsoidal, such as an egg shape.

In various embodiments, second container section cap interior surface portion 154 can be any three-dimensional shape that includes a relatively uniform and smooth concave and curved surface as discussed herein, and/or as known/available in the art at the time of filing, and/or as developed/made available after the time of filing.

In one embodiment, second container section cap 150 and includes at least one first leak-proof coupling device 151 for removably coupling second container section cap 150 to an at least one second leak-proof coupling device 141 of second container section body 140.

In various other embodiments, first leak-proof coupling device 151 and second leak-proof coupling device 141 can be any devices, or combination of devices capable of forming a leak-proof seal as discussed herein, and/or as available/known in the art at the time of filing, and/or as made known/available after the time of filing.

In one embodiment, first leak-proof coupling device 151 and second leak-proof coupling device 141 are self-sealing threads. In one embodiment, first leak-proof coupling device 151 and second leak-proof coupling device 141 are an O-ring and O-ring contact surface.

In one embodiment, there are two first leak-proof coupling devices 151 and second leak-proof coupling devices 141 to ensure a leak-proof seal. In one embodiment, the two first leak-proof coupling devices 151 and second leak-proof coupling devices 141 are self-sealing threads and O-ring/O-ring contact surface to ensure a leak-proof seal.

As shown in FIG. 1A, in one embodiment, second container section 102 includes a second container section body 140. In one embodiment, second container section body 140 has a second container section body interior surface portion 144 that is concave and curved. In one embodiment, second container section body interior surface portion 144 is of a semi-spherical or dome shape. In one embodiment, second container section body interior surface portion 144 is of a semi-ellipsoidal, such as an egg shape.

In various embodiments, second container section body interior surface portion 144 can be any three-dimensional shape that includes a relatively uniform and smooth concave and curved surface as discussed herein, and/or as known/available in the art at the time of filing, and/or as developed/made available after the time of filing.

In one embodiment, second container section body 140 includes at least one second leak-proof coupling device 141 for removably coupling second container section body 140 to an at least one second leak-proof coupling device 151 of second container section cap 150.

In various other embodiments, first leak-proof coupling device 151 and second leak-proof coupling device 141 can be any devices, or combination of devices capable of forming a leak-proof seal as discussed herein, and/or as available/known in the art at the time of filing, and/or as made known/available after the time of filing.

As discussed above, in one embodiment, first leak-proof coupling device 151 and second leak-proof coupling device 141 are self-sealing threads. In one embodiment, first leak-proof coupling device 151 and second leak-proof coupling device 141 are an O-ring and O-ring contact surface.

In one embodiment, there are two first leak-proof coupling devices 151 and second leak-proof coupling devices 141 to ensure a leak-proof seal. In one embodiment, the two first leak-proof coupling devices 151 and second leak-proof coupling devices 141 are self-sealing threads and O-ring/O-ring contact surface to ensure a leak-proof seal.

In one embodiment, the at least one first leak-proof coupling device 151 of the second container section cap 150 and the at least one second leak-proof coupling device 141 of the second container section body 140 are used to removably couple second container section cap 150 and second container section body 140 to form a leak-proof seal.

FIG. 1B is a side sectional view of disconnected second container section 101 and second container section 102 assemblies of an interlocking sectional container 100 in accordance with one embodiment.

In FIG. 1B, the at least one first leak-proof coupling device 151 of the second container section cap 150 and the at least one second leak-proof coupling device 141 of the second container section body 140 have been coupled to form a sealed disconnected second container section 102.

Referring to FIGS. 1A and 1B together, in one embodiment, when the at least one first leak-proof coupling device 151 of the second container section cap 150 and the at least one second leak-proof coupling device 141 of the second container section body 140 are used to removably couple the second container section cap 150 and the second container section body 140 to form a leak-proof seal 151/141, the concave and curved portion 154 of the second container section cap interior surface and the concave and curved portion 144 of the second container section body interior surface form a containment enclosure 190.

In one embodiment, when the at least one first leak-proof coupling device 151 of the second container section cap 150 and the at least one second leak-proof coupling device 141 of the second container section body 140 are used to removably couple second container section cap 150 and second container section body 140 the substantially semi-spherical or semi-ellipsoidal shaped second container section cap 150 interior surface 154 and substantially semi-spherical or semi-ellipsoidal shaped second container section body 140 interior surface 144 form a relatively deep containment enclosure 190 having continuously curved sides for containing both the item and its required fluid. The result is a containment enclosure 190 that has no preferred orientation and is deep and smooth enough to allow the item and fluid to move together and remain in relatively constant contact with each other regardless of the orientation of the second container section 102.

In some examples, the leak-proof containment enclosure 190 is substantially spherical or ellipsoidal shaped so that both the item and the liquid can move freely within the second container section 102 and thereby remain in contact with each other. Consequently, when an item and its liquid are contained with the containment enclosure 190, the item and liquid can freely move together within the leak-proof containment enclosure 190 so that the liquid remains in contact with the item regardless of orientation of the second container section 102 and/or the disclosed interlocking sectional container 100.

In one embodiment, when the container caps 110 and 150 and container bodies 120 and 140, respectively, are removably connected by one or more leak-proof connection devices 111/121 and 141/151, respectively the leak-proof containment enclosures 180 and 190, respectively, are formed each with a diameter dimension 198 and depth dimension 199 that are approximately equal for containing both an item, such as a contact lens, and its required fluid, such as contact lens solution.

As noted, in one embodiment, containment enclosure 190 has continuously curved sides for containing both an item and a fluid such that the item and fluid can freely move together within the second container section containment enclosure 190 so that the item remains in contact with the fluid regardless of the orientation of the second container section.

In one embodiment, the containment enclosure 190 formed by the concave and curved portion 154 of the second container section cap interior surface and the concave and curved portion 144 of the second container section body interior surface is a substantially spherical containment enclosure 190.

In one embodiment, the containment enclosure 190 formed by the concave and curved portion 154 of the second container section cap interior surface and the concave and curved portion 144 of the second container section body interior surface is a substantially ellipsoidal containment enclosure 190.

In one embodiment, the containment enclosure 190 formed by the concave and curved portion 154 of the second container section cap interior surface and the concave and curved portion 144 of the second container section body interior surface is a hybrid substantially spherical and substantially ellipsoidal containment enclosure 190.

In various embodiments, the containment enclosure 190 formed by the concave and curved portion 154 of the second container section cap interior surface and the concave and curved portion 144 of the second container section body interior surface can be any three dimensional, closed compartment that allows and item and fluid to freely move together within the second container section containment enclosure 190 so that the item remains in contact with the fluid regardless of the orientation of the second container section As discussed above, one of the issues with prior art containers, and in particular prior art contact lens containers, is that prior art containers typically provide relatively shallow containment spaces with well-defined and required up and down orientations that rely on the contact lens container remaining in the defied upright orientation. In addition, the level of fluid in the container often fails to fill the entire container. Consequently, when the orientation of the prior art containers is changed, e.g., is not the defined upright orientation, all or part of the item may lose contact with the fluid it requires as the fluid shifts but the item remains in place.

In contrast to the prior art, in the various disclosed embodiments, the containment enclosure 190 has a relatively deep and continuously curved sides for containing both an item and a fluid such that item and does not have a mandatory orientation. Consequently, fluid can freely move together with an item in the second container section containment enclosure 190 so that the item remains in contact with the fluid regardless of the orientation of the second container section.

As discussed above, FIG. 1D shows second container section 102 and first container section 101 assemblies of an interlocking sectional container 100 in a first orientation, including an item 193, such as a contact lens, and fluid 191, such as contact lens solution, contained in the second container section 102 and first container section 102 assemblies in accordance with one embodiment.

As discussed above, FIG. 1E is a side sectional view of the disconnected second container section 102 and first container section 102 assemblies of an interlocking sectional container 100 of FIG. 1D wherein the first container section 101 is in a second orientation and the second container section 102 is in the first orientation in accordance with one embodiment.

Referring to FIGS. 1D and 1E together, using the disclosed embodiments, in contrast to the prior art, like containment enclosure 190, the containment enclosure 180, is a relatively deep containment enclosure 180 and has continuously curved sides in all directions for containing both the item 183 and the fluid 181. Consequently, fluid 181 can freely move together with item 183 in the first container section containment enclosure 180 so that the item 181 remains in contact with the fluid 183 regardless of the orientation, e.g., as the orientation of first container section 101 changes from that of FIG. 1D to that of FIG. 1E. This represents a significant improvement over prior art methods and systems.

The discussion above with respect to FIGS. 1D and 1E and first container section 101 regarding the ability of the disclosed embodiments to keep an item 183, such as a contact lens, and fluid 181, such as contact lens solution, in constant contact regardless of the orientation of first container section 101 applies equally well to second container section 102, item 193, and fluid 191 and is incorporated here for second container section 102, item 193, and fluid 191.

Figure 1F:
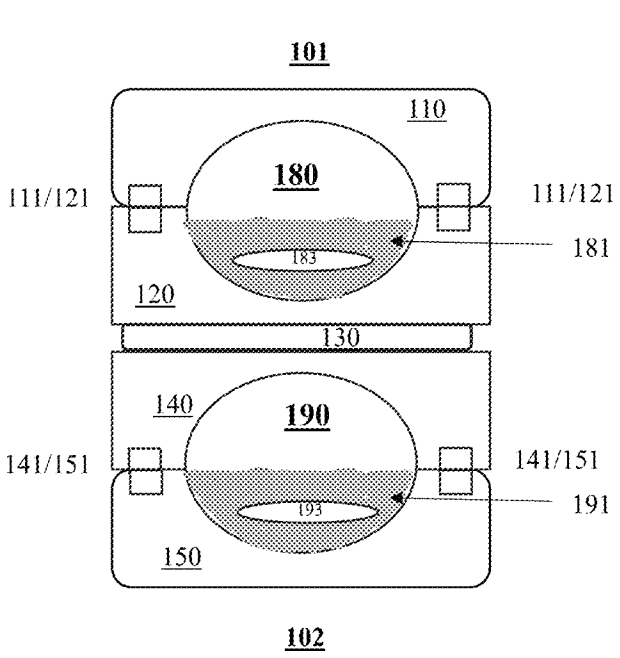
FIG. 1F is a side sectional view of connected first container section and second container section assemblies of an interlocking sectional container in a first orientation, including an item and fluid contained in the first container section and second container section assemblies in accordance with one embodiment.

In addition, FIG. 1F is a side sectional view of connected first container section 101 and second container section 102 assemblies of an interlocking sectional container 100, interconnected in a first orientation, including an items 183/193 and fluids 181/191 contained in the first container section 101 and second container section 102 assemblies in accordance with one embodiment.

Figure 1G:
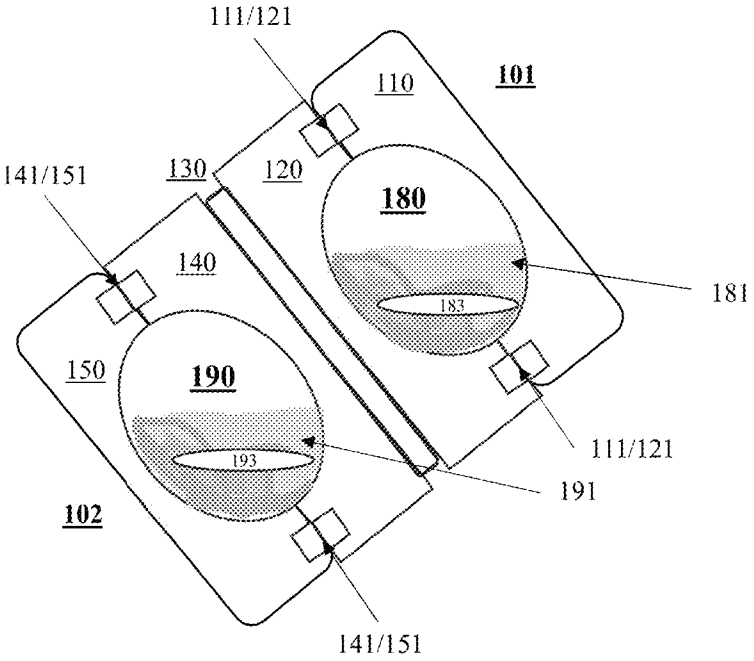
FIG. 1G is a side sectional view of connected first container section and second container section assemblies of an interlocking sectional container in a third orientation, including an item and fluid contained in the first container section and second container section assemblies in accordance with one embodiment.

FIG. 1G is a side sectional view of connected first container section 101 and second container section 102 assemblies of an interlocking sectional container 100 interconnected in a third orientation, including items 183/193 and fluids 181/191 contained in the first container section 101 and second container section 102.

Figure 1H:
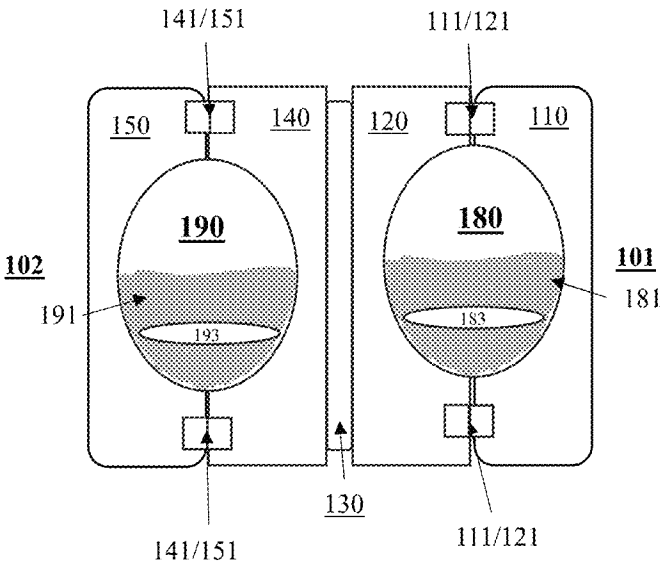
FIG. 1H is a side sectional view of connected first container section and second container section assemblies of an interlocking sectional container in a fourth orientation, including an item and fluid contained in the first container section and second container section assemblies in accordance with one embodiment.

FIG. 1H is a side sectional view of connected first container section 101 and second container section 102 assemblies of an interlocking sectional container 100, interconnected in a fourth orientation, including items 183/193 and fluids 181/191 contained in the first container section 101 and second container section 102.

As seen in FIGS. 1F 1G, and 1H, using the disclosed embodiments, in contrast to the prior art, the containment enclosures 180 and 190 are relatively deep containment enclosures and have continuously curved sides in all directions for containing both the items 183/193 and the fluids 181/191. Consequently, fluid 181 can freely move together with item 183 in the first container section containment enclosure 180 and fluid 191 can freely move together with item 193 in the second container section containment enclosure 190 so that the items 183 and 193 remain in continuous contact with the fluids 181 and 191 respectively regardless of the orientation, e.g., as the orientation of first container section 101 and second container section 102 changes from that of FIG. 1F to that of FIG. 1G, to that of FIG. 1H, or any orientation at all. This represents a significant improvement over prior art methods and systems.

As noted above, in one embodiment, second container section 102 is capable of being removably coupled to first container section 101 by an interconnector 130 such that the first container section 101 and a second container section 102 can be connected and separated by a user as desired.

In various embodiments, interconnector 130 can be any interconnector mechanism capable of removably coupling first container section 101 to second container section 102 such that the first container section 101 and a second container section 102 can be connected and separated by a user as desired, as discussed herein, and/or as available/ known in the art at the time of filing, and/or as made known/available after the time of filing.

As discussed in more detail below, in one specific embodiment, interconnector 130 includes one or more ball detent connectors housed in one or more ball detent connector housings. As also discussed in more detail below, in one embodiment, one end of the interconnector 130 is permanently attached to one surface of either the first container section body 120 or the second container section body 140, and the ball detent connectors of the interconnector 130 are then mated with ball detent connector catches formed on the other of the second container section body 140 or the first container section body 120.

Regardless of the specific type of interconnector 130 used, the disclosed first and second container sections 101 and 102 are removably attached to each other to form the disclosed interlocking sectional container 100. In this way, the disclosed first and second container sections 101 and 102, respectively, can be separated from each other and manipulated separately as needed.

FIG. 1C is a side sectional view of connected first container section 101 and second container section 102 assemblies interconnected using interconnector 130 to form connected interlocking sectional container 100 in accordance with one embodiment.

As discussed in more detail below, in one embodiment, first container section 101, and/or second container section 102, and/or interlocking sectional container 100 has an exterior surface that includes at least one side that is flat.

Those of skill in the art will recognize that while in the discussion above an interlocking sectional container 100 with two container sections, e.g., first container section 101, and second container section 102, is set forth, in other embodiments, any number interlocking container sections can be implemented as all or part of the disclosed interlocking sectional container. Therefore, in other embodiments, the disclosed interlocking sectional container can include a single container section, or any desired number of container sections.

As noted above, in some embodiments, interlocking sectional container 100 is a contact lens interlocking sectional container. In these embodiments, first container section 101 can be used to contain an item 183 that is a first contact lens and a fluid 181 that is a first portion of contact lens solution. Similarly, in these embodiments, second container section 102 can be used to contain an item 193 that is a second contact lens and fluid 191 that is a second portion of contact lens solution.

As discussed above, using the specific disclosed embodiment of an interlocking sectional container 100, an item, such as a contact lens, and its fluid, such as contact lens solution, are contained within spherical or ellipsoidal containment enclosure formed by a substantially semi-spherical or semi-ellipsoidal shaped container cap interior surface and substantially semi-spherical or semi-ellipsoidal shaped container body interior surface. As a result, the item, such as a contact lens, and the fluid, such as contact lens solution, can freely move together within the spherical or ellipsoidal containment enclosure and remains in contact with each other regardless of orientation of the container and/or the disclosed interlocking sectional container.

As also discussed above, using the specific disclosed embodiment of an interlocking sectional container 100 the first or second container section cap and first or second container section body are removably coupled by the one or more leak-proof coupling devices that include first or second container section cap self-sealing threads that mate with first or second container section body self-sealing threads.

Therefore, interlocking sectional container 100 provides a leak-proof container which prevents the fluid, such as contact lens solution, from leaking, evaporating, or otherwise getting released regardless of orientation of the container and even when the container is subject to significant use and abuse.

As also discussed above, and in more detail below, according to the specific illustrative example of interlocking sectional container 100 the first container section and a second container section are removably connected by an interconnector. Therefore, according to the specific illustrative example of interlocking sectional container 100 the first and second container sections are removably attached to each other to form the disclosed interlocking sectional container. In this way, the disclosed first and second container sections can be separated from each other and manipulated separately.

Consequently, interlocking sectional container 100 provides a solution to the long-standing technical problem of providing a container that cost effectively, efficiently, and reliably keeps an item and its required fluid within the container and in contact with each other without leaking, evaporating, or otherwise getting released regardless of orientation of the container and even when the container is subject to significant use and abuse.

FIGS. 2A through 10D are directed to a specific illustrative example of one embodiment of an interlocking sectional container and include numerous details associated with that specific illustrative example of one embodiment of an interlocking sectional container. In addition, some of the specific features of the specific illustrative example of one embodiment of an interlocking sectional container of FIGS. 2A through 10D are particularly well suited to a specific illustrative example of one embodiment of an interlocking sectional container used as a contact lens container. However, the features and details set forth in the discussion below of the specific illustrative example of one embodiment of an interlocking sectional container of FIGS. 2A through 10D are not intended to be limiting or to in any way restrict the features and limitations of the claims to the specific illustrative example of one embodiment of an interlocking sectional container of FIGS. 2A through 10D.

Figure 2A:
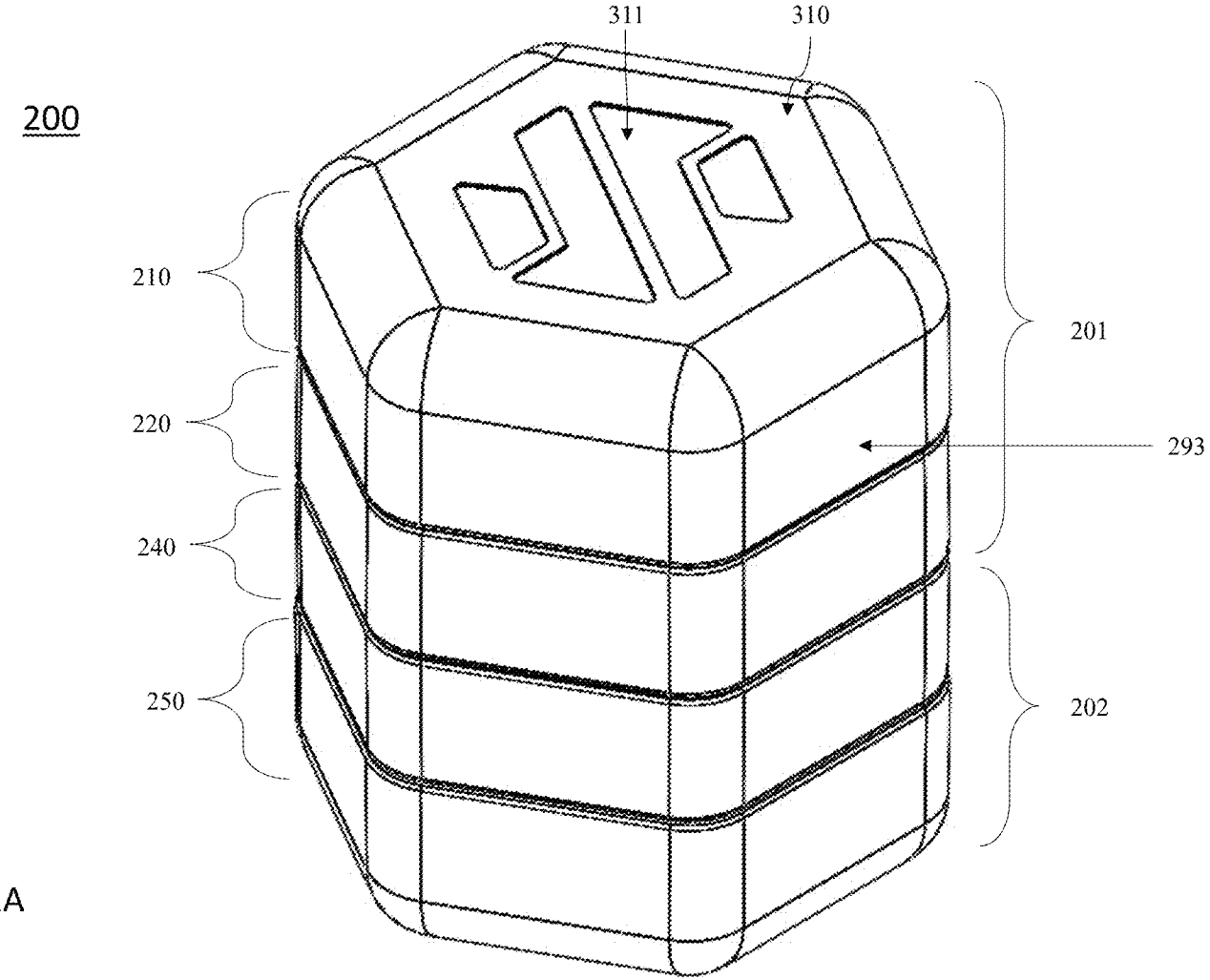
FIG. 2A is a perspective view of the exterior of an interlocking sectional container in accordance with one embodiment.

FIG. 2A is a perspective view of the exterior of an interlocking sectional container 200 in accordance with one embodiment.

As seen in FIG. 2A, interlocking sectional container 200 includes first container section 201 and second container section 202. In one embodiment, first container section 201 includes first container section cap 210 and first container section body 220. Similarly, in one embodiment, second container section 202 includes second container section body 240 and second container section cap 250. As discussed below, first container section body 220 and second container section body 240 are removably interconnected in FIG. 2A by an interconnector 230 that is internal to interlocking sectional container 200 when first container section body 220 and second container section body 240 are removably interconnected as shown in FIG. 2A. Therefore interconnector 230 is not shown in the external view of FIG. 2A.

In various embodiments, at least part of the interlocking sectional container 200 and/or the components making up interlocking sectional container 200 are made of any material suitable for forming a leak-proof interlocking sectional container 200 having the properties discussed below, as discussed herein, and/or as known in the art at the time of filing, and/or as becomes known after the time of filing.

In one embodiment, at least part of the interlocking sectional container 200 and/or the components making up interlocking sectional container 200 are made of a polymer material. In one embodiment, at least part of the interlocking sectional container 200 and/or the components making up interlocking sectional container 200 are made of a metal material. In one embodiment, at least part of the interlocking sectional container 200 and/or the components making up interlocking sectional container 200 are made of an alloy material. In one embodiment, at least part of the interlocking sectional container 200 and/or the components making up interlocking sectional container 200 are made of ceramic material. In one embodiment, at least part of the interlocking sectional container 200 and/or the components making up interlocking sectional container 200 are made of a composite material.

As seen in FIG. 2A, first container section cap 210 includes first surface 310 that includes a symbol 311. In various embodiments, symbol 311 can be used to identify first container section cap 210 and first container section 201 and distinguish it from second container section cap 250 second container section 202. This feature may be required because, as discussed above and in detail below, using the disclosed embodiments, and in contrast to the prior art, the interlocking sectional containers and interlocking sectional container sections do not have a required or even preferred orientation. Consequently, symbol 311 can help a user identify the interlocking sectional container section they want to access and/or the contents of the interlocking sectional container section.

As a specific example, when interlocking sectional container 200 is used as a contact lens container, symbol 311 can be used to identify the lens, e.g., left or right, contained in the first container section 201 or second container section 202. In other examples, symbol 311 can be used to identify the contents of first container section 201 or second container section 202 when first container section 201 or second container section 202 are used to carry different items.

In addition, as shown in FIG. 2A, in this specific illustrative example, interlocking sectional container 200 is of a substantially hexagonal cross section. As a result, interlocking sectional container 200 includes, in this specific illustrative example, six substantially flat exterior surfaces or sides, such as exterior flat surface 293 surface. To create the substantially hexagonal cross section of interlocking sectional container 200, in this specific illustrative example, each of first container section 201 or second container section 202 have a substantially hexagonal cross section so that when first container section 201 or second container section 202 are either interconnected as shown in FIG. 2A, or disconnected, the resulting interconnected interlocking sectional container 200, and/or disconnected first container section 201, and or disconnected second container section 202 also have six substantially flat exterior surfaces or sides, such as exterior flat surface 293 surface.

In various other embodiments, interconnected interlocking sectional container 200, and/or disconnected first container section 201, and or disconnected second container section 202 can have any number of flat exterior surfaces or sides, or even no flat exterior surfaces or sides. Consequently, in various embodiments, interconnected interlocking sectional container 200, and/or disconnected first container section 201, and or disconnected second container section 202 can be of any shape desired, as discussed herein, and/or as known in the art at the time of filing, and/or as becomes known at the time of filing.

However, one of the advantages to embodiments where interconnected interlocking sectional container 200, and/or disconnected first container section 201, and or disconnected second container section 202, have at least one flat exterior surface or side is that when interconnected interlocking sectional container 200, and/or disconnected first container section 201, and or disconnected second container section 202, are placed on their side, the at least one flat exterior surface or side of interconnected interlocking sectional container 200, and/or disconnected first container section 201, and or disconnected second container section 202 prevents the interconnected interlocking sectional container 200, and/or disconnected first container section 201, and or disconnected second container section 202 from rolling.

This anti-rolling feature can be particularly advantages for some uses of interconnected interlocking sectional container 200, and/or disconnected first container section 201, and or disconnected second container section 202 since, as discussed above and in detail below, using the disclosed embodiment, and in contrast to the prior art, the interlocking sectional containers and interlocking sectional container sections do not have a required or even preferred orientation.

Figure 2B:
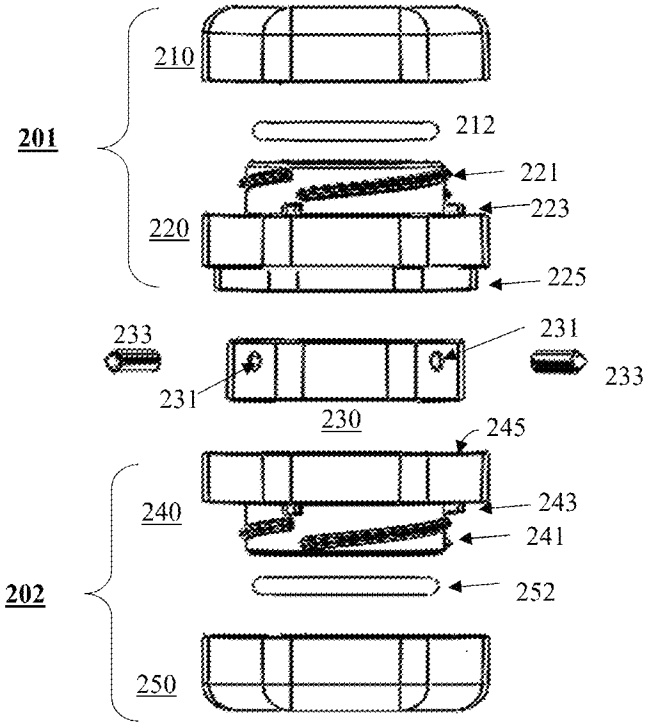
FIG. 2B is an exploded side view of the interlocking sectional container of FIG. 2A in accordance with one embodiment.

FIG. 2B is an exploded side view of the interlocking sectional container 200 of FIG. 2A in accordance with one embodiment.

Figure 2C:
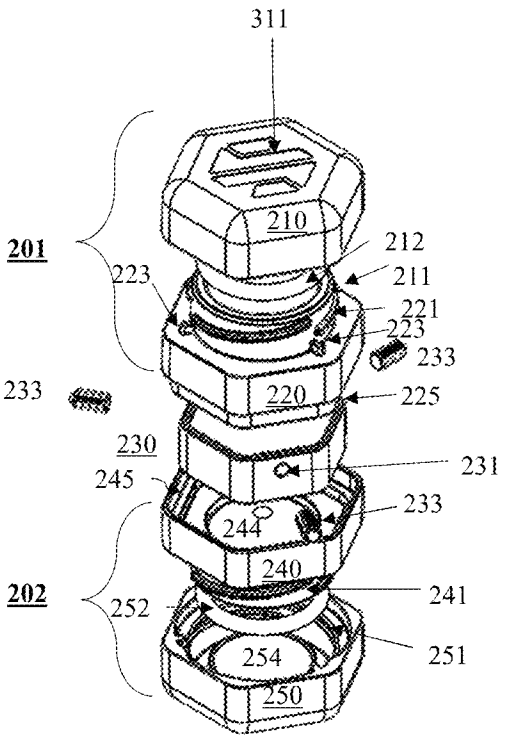
FIG. 2C is an exploded isomeric view of the interlocking sectional container of FIGS. 2A and 2B in accordance with one embodiment.

FIG. 2C is an exploded isomeric view of the interlocking sectional container 200 of FIGS. 2A and 2B in accordance with one embodiment.

Figure 2D:
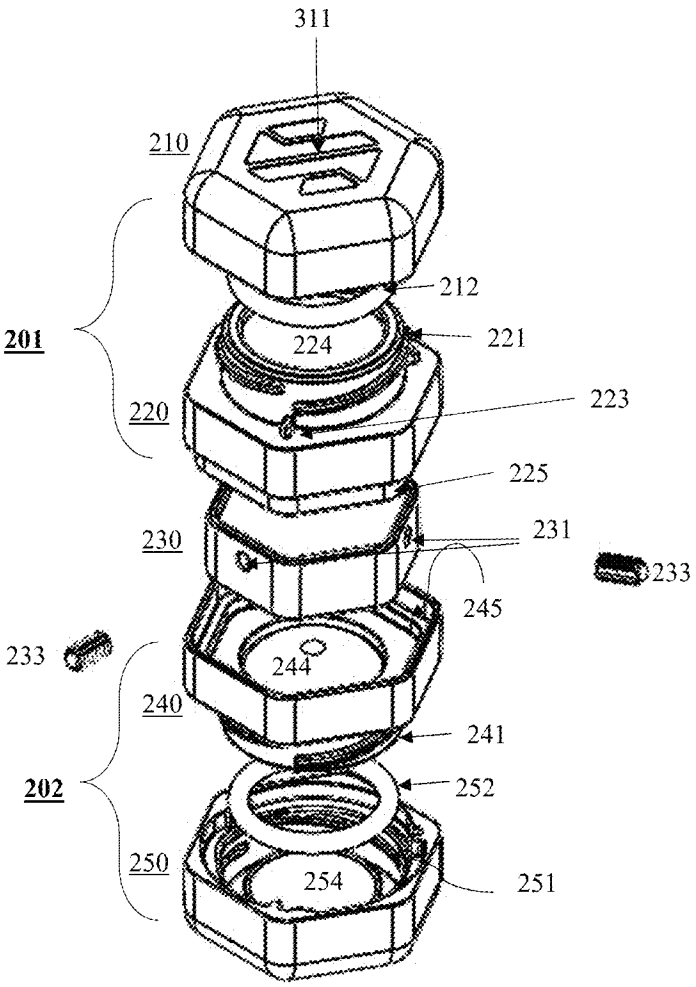
FIG. 2D is a more detailed exploded isomeric view of the interlocking sectional container of FIGS. 2A, 2B and 2C in accordance with one embodiment.

FIG. 2D is a more detailed exploded isomeric view of the interlocking sectional container 200 of FIGS. 2A, 2B, and 2C in accordance with one embodiment.

Figure 2E:
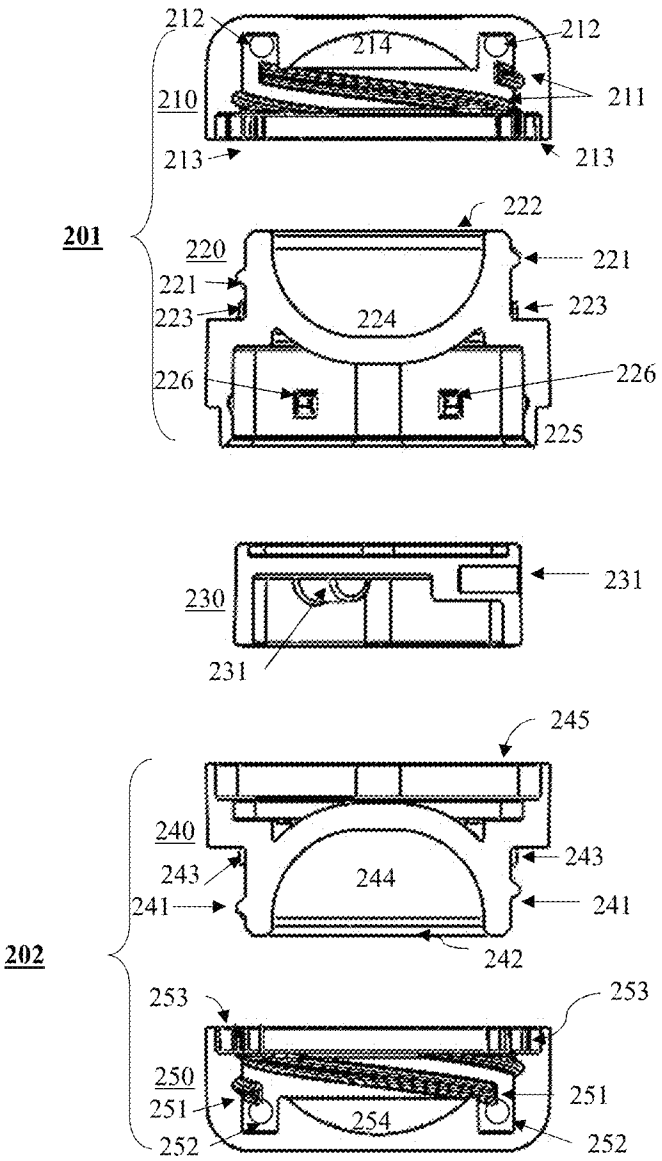
FIG. 2E is an exploded side sectional view of the interlocking sectional container of FIG. 2A in accordance with one embodiment.

FIG. 2E is an exploded side sectional view of the interlocking sectional container 200 of FIGS. 2A, 2B, 2C, and 2D in accordance with one embodiment.

Figure 2F:
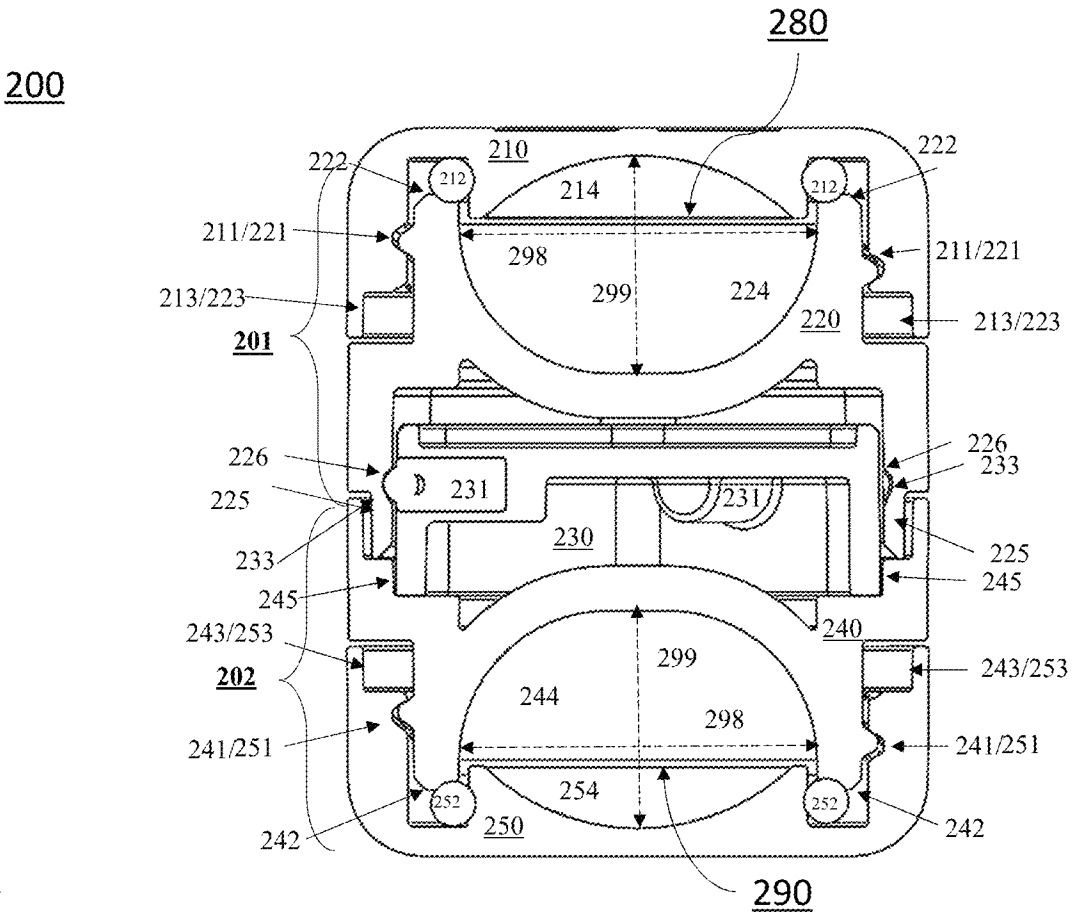
FIG. 2F is a side sectional view of the interlocking sectional container of FIG. 2A in accordance with one embodiment.

FIG. 2F is a side sectional view of the interlocking sectional container 200 of FIGS. 2A, 2B, 2C, 2D, and 2E in accordance with one embodiment.

Figure 2G:
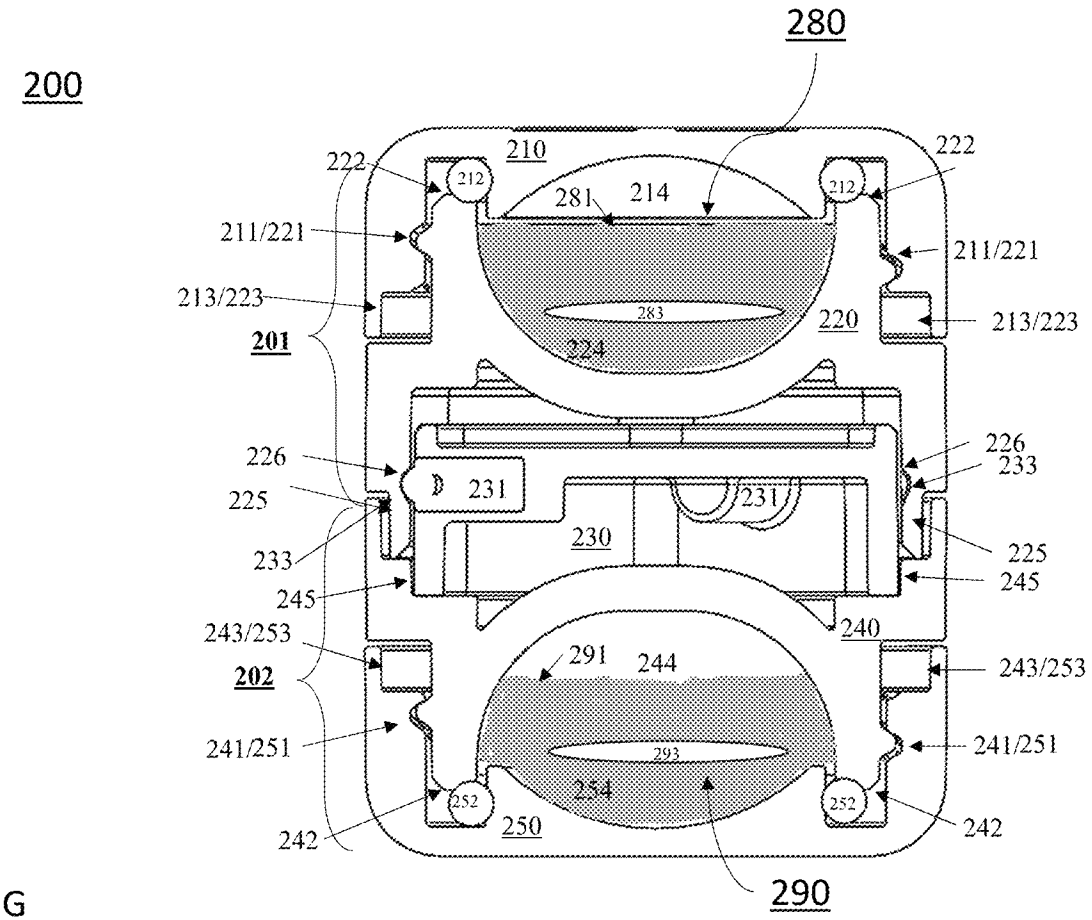
FIG. 2G is a side sectional view of interlocking sectional container of FIG. 2A in a first orientation, including an item and fluid contained in the first container section and second container section assemblies in accordance with one embodiment.

FIG. 2G is a side sectional view of interlocking sectional container 200 of FIGS. 2A, 2B, 2C, 2D, 2E, and 2F in a first orientation, including an item and fluid contained in the first container section and second container section assemblies in accordance with one embodiment.

In the following discussion reference will be made to FIGS. 2A, 2B, 2C, 2D, 2E and 2F, collectively referred to as FIGS. 2A-2G. The below discussion will be made in reference to FIGS. 2A-2G together unless otherwise stated.

Referring to FIGS. 2A-2G together, in one embodiment, interlocking sectional container 200 includes a first container section 201 for containing an item 283 and a fluid 281 (see FIG. 2G).

In various embodiments, first container section 201 can be used for containing any item 283 and any fluid 281 that must remain in relatively constant contact with each other, as discussed herein, and/or as known in the art at the time of filing, and/or as becomes known after the time of filing.

In one embodiment, first container section 201 can be used for containing an item 283 and a fluid 281, such as a contact lens and contact lens solution. In one embodiment, first container section 201 can be used for containing an item 283 and a fluid 281, such as a medical sample and a fluid required to preserve or protect the medical sample. In one embodiment, first container section 201 can be used for containing an item 283 and a fluid 281, such as an organic or inorganic membrane and a fluid required to preserve or protect the membrane.

In one embodiment, first container section 201 can be used for containing an item 283 and a fluid 281, such as a reactive chemical and a fluid required to preserve or protect the reactive chemical, and/or keep it inert. In one embodiment, first container section 201 can be used for containing an item 283 and a fluid 281, such as a food item and a fluid, such as oil or water, required to preserve or protect the food item.

In one embodiment, first container section 201 can be used for containing an item 283 and a fluid 281, such as a live organism, such as an aquatic organism, and a fluid, such as fresh or salt water, required to preserve or protect the organism, and keep it alive. In one embodiment, first container section 201 can be used for containing an item 283 and a fluid 281, such as a preserved organism, and a fluid, such as formaldehyde, required to preserve or protect the preserved organism.

In one embodiment, the first container section 201 is capable of being removably coupled to first container section 201 by an interconnector 230 (discussed in more detail below) such that the first container section 201 and second container section 202 can be connected and separated by a user as desired.

In one embodiment, the first container section 201 includes a first container section cap 210. In one embodiment, the first container section cap 210 has a first container section cap interior surface portion 214 (see FIGS. 2D and 2E) that is concave and curved. In one embodiment, first container section cap interior surface portion 214 is of a semi-spherical or dome shape. In one embodiment, first container section cap interior surface portion 214 is of a semi-ellipsoidal, such as an egg shape.

In various embodiments, first container section cap interior surface portion 214 can be any three-dimensional shape that includes a uniform and smooth concave and curved surface as discussed herein, and/or as known/available in the art at the time of filing, and/or as developed/made available after the time of filing.

In one embodiment, first container section cap 210 and includes first container section cap self-sealing threads 211 (see FIGS. 2D and 2E) for removably coupling first container section cap 210 to first container section body self-sealing threads 221 (see FIGS. 2B, 2D and 2E) of first container section body 220.

As discussed in more detail below, in one embodiment, first container section cap 210 includes first container section cap lock 213 (see FIGS. 2D and 2E) that couples with first container section cap locking detent 223 of first container section body 220 to lock first container section cap 210 in a desired position with respect to first container section body 220.

In one embodiment, first container section cap 210 includes first container section cap O-ring 212 that when coupled with first container section body/cap O-ring interface surface 222 (see FIGS. 2D and 2E) of first container section body 220 forms an additional leak proof seal.

Consequently, in one embodiment, there are two leak-proof coupling mechanisms for forming a seal between first container section cap 210 and first container section body 220; first container section cap self-sealing threads 211/first container section body self-sealing threads 221 and first container section cap O-ring 212/first container section body/cap O-ring interface surface 222. In this way, in one embodiment, a leak-proof seal between first container section cap 210 and first container section body 220 can be provided even under most challenging conditions.

In one embodiment, first container section 201 includes a first container section body 220. In one embodiment, first container section body 220 has a first container section body interior surface portion 224 that is concave and curved. In one embodiment, first container section body interior surface portion 224 (see FIGS. 2D and 2E) is of a semi-spherical or dome shape. In one embodiment, first container section body interior surface portion 224 is of a semi-ellipsoidal, such as an egg shape.

In various embodiments, first container section body interior surface portion 224 can be any three-dimensional shape that includes a relatively uniform and smooth concave and curved surface as discussed herein, and/or as known/available in the art at the time of filing, and/or as developed/made available after the time of filing.

In one embodiment, first container section body 220 includes first container section body self-sealing threads 221 for removably coupling first container section body 220 to first container section cap self-sealing threads 211 of first container section cap 210.

As noted above, in one embodiment, first container section cap 210 includes first container section cap lock 213 that couples with first container section cap locking detent 223 of first container section body 220 to lock first container section cap 210 in a desired position with respect to first container section body 220.

As also noted above, in one embodiment, first container section cap 210 includes first container section cap O-ring 212 that when coupled with first container section body/cap O-ring interface surface 222 first container section body 220 forms an additional leak proof seal.

Consequently, in one embodiment, there are two leak-proof coupling mechanisms for forming a seal between first container section cap 210 and first container section body 220; first container section cap self-sealing threads 211/first container section body self-sealing threads 221 and first container section cap O-ring 212/first container section body/cap O-ring interface surface 222. In this way, in one embodiment, a leak-proof seal between first container section cap 210 and first container section body 220 can be provided even under most challenging conditions.

In one embodiment, the first container section cap self-sealing threads 211 of the first container section cap 210 and the first container section body self-sealing threads 221 of the first container section body 220 are used to removably couple first container section cap 210 and first container section body 220 to form a leak-proof seal and thereby form a sealed leak proof containment enclosure 280 (see FIGS. 2E and 2F).

FIG. 2F is a side sectional view of the interlocking sectional container 200 of FIGS. 2A, 2B, 2C, 2D, and 2E showing first container section 201 sealed to form leak-proof containment enclosure 280 in accordance with one embodiment.

FIG. 2G is a side sectional view of interlocking sectional container 200 of FIGS. 2A, 2B, 2C, 2D, 2E, and 2F with first container section 201 sealed to form leak-proof containment enclosure 280. In FIG. 2G, interlocking sectional container 200 and first container section 201 are shown in a first orientation, including an item 283 and fluid 281 contained in the first container section 201 and second container section 202 assemblies in accordance with one embodiment.

Referring to FIGS. 2F and 2G, first container section cap self-sealing threads 211 of the first container section cap 210 and the first container section body self-sealing threads 221 of the first container section body 220 have been coupled to form a sealed connected first container section 201.

In one embodiment, when the first container section cap self-sealing threads 211 of the first container section cap 210 and the first container section body self-sealing threads 221 of the first container section body 220 are used to removably couple the first container section cap 210 and the first container section body 220 to form a leak-proof seal 211/221, the concave and curved first container section cap interior surface portion 214 of the first container section cap 210 interior surface and the concave and curved first container section body interior surface portion 224 of the first container section body 220 interior surface form a containment enclosure 280 that is relatively deep and has substantially continuously curved sides in every direction.

In one embodiment, when the first container section cap self-sealing threads 211 of the first container section cap 210 and the first container section body self-sealing threads 221 of the first container section body 220 are used to removably couple first container section cap 210 and first container section body 220 the substantially semi-spherical or semi-ellipsoidal shaped of first container section cap interior surface portion 214 of the first container section cap 210 interior surface and substantially semi-spherical or shaped the concave and curved first container section body interior surface portion 224 of the first container section body 220 interior surface form a relatively deep containment enclosure 280 that is leak proof and has continuously curved sides for containing both the item 283 and its required fluid 281. The result is a leak proof containment enclosure 280 that has no preferred orientation and is deep and smooth enough to allow the item 283 and fluid 281 to move together and remain in relatively constant contact with each other regardless of the orientation of the first container section 201.

In some examples, the leak-proof containment enclosure 280 is substantially spherical or ellipsoidal shaped so that both the item 283 and the liquid 281 can move freely within the first container section 201 and thereby remain in contact with each other. Consequently, when an item 283 and its liquid 281 are contained with the containment enclosure 280, the item 283 and liquid 281 can freely move together within the leak-proof containment enclosure 280 so that the liquid 281 remains in contact with the item 283 regardless of orientation of the first container section 201 and/or the disclosed interlocking sectional container 200.

In one embodiment, when the container cap 210 and container body 220 are removably connected by one or more leak-proof connection devices 211/221, the leak-proof containment enclosure 280 is formed with a diameter dimension 298 and depth dimension 299 that are approximately equal for containing both an item, such as a contact lens, and its required fluid, such as contact lens solution.

In one embodiment, when the container cap 210 and container body 220 are removably connected by one or more leak-proof connection devices 211/221, the leak-proof containment enclosure 280 is formed with a depth dimension 299 that is approximately one half a diameter dimension 298 for containing both an item, such as a contact lens, and its required fluid, such as contact lens solution.

As noted, in one embodiment, the containment enclosure 280 formed by first container section cap interior surface portion 214 of the first container section cap 210 first container section body interior surface portion 224 of the first container section body 220 can be a substantially spherical containment enclosure 280.

As also noted, in one embodiment, the containment enclosure 280 formed by first container section cap interior surface portion 214 of the first container section cap 210 first container section body interior surface portion 224 of the first container section body 220 can be a substantially ellipsoidal containment enclosure 280.

In one embodiment, the containment enclosure 280 formed by the containment enclosure 280 formed by first container section cap interior surface portion 214 of the first container section cap 210 first container section body interior surface portion 224 of the first container section body 220 can be a hybrid substantially spherical and substantially ellipsoidal containment enclosure 280.

In various embodiments, the containment enclosure 280 formed by first container section cap interior surface portion 214 of the first container section cap 210 first container section body interior surface portion 224 of the first container section body 220 can be any three dimensional, closed compartment that allows and item 283 and fluid 281 to freely move together within the first container section containment enclosure 280 so that the item 283 remains in contact with the fluid 281 regardless of the orientation of the first container section 201.

As discussed above, in contrast to the prior art, in the various disclosed embodiments, the containment enclosure 280 has a relatively deep and continuously curved sides for containing both an item 283 and a fluid 281 such that first container section 201 does not have a mandatory orientation. Consequently, fluid 281 can freely move together with an item 283 in the first container section containment enclosure 280 so that the item 283 remains in contact with the fluid 281 regardless of the orientation of the first container section 201.

Consequently, like interlocking sectional container 100, first container section 101 and second container section 102 discussed above with respect to FIGS. 1D-1H, and in contrast to the prior art, the first container section 201, second container section 202, and interlocking sectional container 200 of FIGS. 2A-2G include containment enclosures 280 and 290 that are relatively deep and have continuously curved sides in all directions for containing both the items 283/293 and the fluids 281/291. Consequently, fluids 281/291 can freely move together with items 283/293 in the containment enclosure 280/290 so that the items 283/293 remain in contact with the fluids 281/291 regardless of the orientation of first container section 201, second container section 202, or interlocking sectional container 200. This represents a significant improvement over prior art methods and systems.

Referring back to FIGS. 2A-2G together, in one embodiment, interlocking sectional container 200 includes a second container section 202 for containing an item 293 and a fluid 291 (see FIG. 2G).

In various embodiments, second container section 202 can be used for containing any item 293 and any fluid 291 that must remain in relatively constant contact with each other, as discussed herein, and/or as known in the art at the time of filing, and/or as becomes known after the time of filing.

In one embodiment, second container section 202 can be used for containing an item 293 and a fluid 291, such as a contact lens and contact lens solution. In one embodiment, second container section 202 can be used for containing an item 293 and a fluid 291, such as a medical sample and a fluid required to preserve or protect the medical sample. In one embodiment, second container section 202 can be used for containing an item 293 and a fluid 291, such as an organic or inorganic membrane and a fluid required to preserve or protect the membrane.

In one embodiment, second container section 202 can be used for containing an item 293 and a fluid 291, such as a reactive chemical and a fluid required to preserve or protect the reactive chemical, and/or keep it inert. In one embodiment, second container section 202 can be used for containing an item 293 and a fluid 291, such as a food item and a fluid, such as oil or water, required to preserve or protect the food item.

In one embodiment, second container section 202 can be used for containing an item 293 and a fluid 291, such as a live organism, such as an aquatic organism, and a fluid, such as fresh or salt water, required to preserve or protect the organism, and keep it alive. In one embodiment, second container section 202 can be used for containing an item 293 and a fluid 291, such as a preserved organism, and a fluid, such as formaldehyde, required to preserve or protect the preserved organism.

In one embodiment, the second container section 202 is capable of being removably coupled to first container section 201 by an interconnector 230 (discussed in more detail below) such that the second container section 202 and a first container section 201 can be connected and separated by a user as desired.

In one embodiment, the second container section 202 includes a second container section cap 250. In one embodiment, the second container section cap 250 has a second container section cap interior surface portion 254 (see FIGS. 2D and 2E) that is concave and curved. In one embodiment, second container section cap interior surface portion 254 is of a semi-spherical or dome shape. In one embodiment, second container section cap interior surface portion 254 is of a semi-ellipsoidal, such as an egg shape.

In various embodiments, second container section cap interior surface portion 254 can be any three-dimensional shape that includes a relatively uniform and smooth concave and curved surface as discussed herein, and/or as known/available in the art at the time of filing, and/or as developed/made available after the time of filing.

In one embodiment, second container section cap 250 and includes second container section cap self-sealing threads 251 (see FIGS. 2D and 2E) for removably coupling second container section cap 250 to second container section body self-sealing threads 241 of second container section body 240.

As discussed in more detail below, in one embodiment, second container section cap 250 includes second container section cap lock 253 (see FIGS. 2D and 2E) that couples with second container section cap locking detent 243 of second container section body 240 to lock first container section cap 210 in a desired position with respect to first container section body 240.

In one embodiment, second container section cap 250 includes second container section O-ring 252 that when coupled with second container section body/cap O-ring interface surface 242 (see FIG. 2F) second container section body 240 forms an additional leak proof seal.

Consequently, in one embodiment, there are two leak-proof coupling mechanisms for forming a seal between second container section cap 250 and second container section body 240; second container section cap self-sealing threads 251/second container section body self-sealing threads 241 and second container section O-ring 252/second container section body/cap O-ring interface surface 242. In this way, in one embodiment, a leak-proof seal between second container section cap 250 and second container section body 240 can be provided even under most challenging conditions.

In one embodiment, second container section 202 includes a second container section body 240. In one embodiment, second container section body 240 has a second container section body interior surface portion 244 (see FIGS. 2D and 2E) that is concave and curved. In one embodiment, second container section body interior surface portion 244 is of a semi-spherical or dome shape. In one embodiment, second container section body interior surface portion 244 is of a semi-ellipsoidal, such as an egg shape.

In various embodiments, second container section body interior surface portion 244 can be any three-dimensional shape that includes a relatively uniform and smooth concave and curved surface as discussed herein, and/or as known/available in the art at the time of filing, and/or as developed/made available after the time of filing.

In one embodiment, second container section body 240 includes second container section body self-sealing threads 241 for removably coupling second container section body 240 to second container section cap self-sealing threads 251 of second container section cap 250.

As noted above, in one embodiment, second container section cap 250 includes second container section cap lock 253 that couples with second container section cap locking detent 243 of second container section body 240 to lock first container section cap 210 in a desired position with respect to first container section body 240.

As also noted above, in one embodiment, second container section cap 250 includes second container section O-ring 252 that when coupled with second container section body/cap O-ring interface surface 242 second container section body 240 forms an additional leak proof seal.

Consequently, in one embodiment, there are two leak-proof coupling mechanisms for forming a seal between second container section cap 250 and second container section body 240; second container section cap self-sealing threads 251/second container section body self-sealing threads 241 and second container section O-ring 252/second container section body/cap O-ring interface surface 242. In this way, in one embodiment, a leak-proof seal between second container section cap 250 and second container section body 240 can be provided even under most challenging conditions.

In one embodiment, the second container section cap self-sealing threads 251 of the second container section cap 250 and the second container section body self-sealing threads 241 of the second container section body 240 are used to removably couple second container section cap 250 and second container section body 240 to form a leak-proof seal and form a sealed leak proof containment enclosure 290.

FIG. 2F is a side sectional view of the interlocking sectional container 200 of FIGS. 2A, 2B, 2C, 2D, and 2E showing second container section 202 sealed to form leak-proof containment enclosure 290 in accordance with one embodiment.

FIG. 2G is a side sectional view of interlocking sectional container 200 of FIGS. 2A, 2B, 2C, 2D, 2E, and 2F with second container section 202 sealed to form leak-proof containment enclosure 290. In FIG. 2G, interlocking sectional container 200 and second container section 202 are shown in a first orientation, including an item and fluid contained in the first container section and second container section assemblies in accordance with one embodiment.

Referring to FIGS. 2F and 2G, second container section cap self-sealing threads 251 of the second container section cap 250 and the second container section body self-sealing threads 241 of the second container section body 240 have been coupled to form a sealed connected second container section 202.

In one embodiment, when the second container section cap self-sealing threads 251 of the second container section cap 250 and the second container section body self-sealing threads 241 of the second container section body 240 are used to removably couple the second container section cap 250 and the second container section body 240 to form a leak-proof seal 241/251, the concave and curved portion 254 of the second container section cap interior surface and the concave and curved portion 244 of the second container section body 240 interior surface form a containment enclosure 290 that is relatively deep and has substantially continuously curved sides in every direction.

In one embodiment, when the second container section cap self-sealing threads 251 of the second container section cap 250 and the second container section body self-sealing threads 241 of the second container section body 240 are used to removably couple second container section cap 250 and second container section body 240 the substantially semi-spherical or semi-ellipsoidal shaped second container section cap interior surface 254 and substantially semi-spherical or shaped second container section body interior surface 244 form a relatively deep containment enclosure 290 having continuously curved sides for containing both the item 293 and its required fluid 291. The result is a containment enclosure 290 that has no preferred orientation and is deep and smooth enough to allow the item 293 and fluid 291 to move together and remain in relatively constant contact with each other regardless of the orientation of the second container section 202.

In some examples, the leak-proof containment enclosure 290 is substantially spherical or ellipsoidal shaped so that both the item 293 and the liquid 291 can move freely within the second container section 202 and thereby remain in contact with each other. Consequently, when an item 293 and its liquid 291 are contained with the containment enclosure 290, the item 293 and liquid 291 can freely move together within the leak-proof containment enclosure 290 so that the liquid 291 remains in contact with the item 293 regardless of orientation of the second container section 202 and/or the disclosed interlocking sectional container 200.

In one embodiment, when the container cap 250 and container body 240 are removably connected by one or more leak-proof connection devices 241/251, the leak-proof containment enclosure 290 is formed with a diameter dimension 298 and depth dimension 299 that are approximately equal for containing both an item, such as a contact lens, and its required fluid, such as contact lens solution.

In one embodiment, when the container cap 250 and container body 240 are removably connected by one or more leak-proof connection devices 241/251, the leak-proof containment enclosure 290 is formed with a depth dimension 299 that is approximately one half a diameter dimension 298 for containing both an item, such as a contact lens, and its required fluid, such as contact lens solution.

As noted, in one embodiment, the containment enclosure 290 formed by the concave and curved portion 254 of the first container section cap interior surface and the concave and curved portion 244 of the second container section body 240 interior surface can be a substantially spherical containment enclosure 290.

As also noted, in one embodiment, the containment enclosure 290 formed by the concave and curved portion 254 of the first container section cap interior surface and the concave and curved portion 244 of the second container section body 240 interior surface can be a substantially ellipsoidal containment enclosure 290.

In one embodiment, the containment enclosure 290 formed by the concave and curved portion 254 of the first container section cap interior surface and the concave and curved portion 244 of the second container section body 240 interior surface can be a hybrid substantially spherical and substantially ellipsoidal containment enclosure 290.

In various embodiments, the containment enclosure 290 formed by the concave and curved portion 254 of the first container section cap interior surface and the concave and curved portion 244 of the second container section body 240 interior surface can be any three dimensional, closed compartment that allows and item 293 and fluid 291 to freely move together within the first container section containment enclosure 290 so that the item 293 remains in contact with the fluid 291 regardless of the orientation of the second container section 202.

As discussed above, in contrast to the prior art, in the various disclosed embodiments, the containment enclosure 290 has a relatively deep and continuously curved sides for containing both an item 293 and a fluid 291 such that second container section 202 does not have a mandatory orientation. Consequently, fluid 291 can freely move together with an item 293 in the first container section containment enclosure 290 so that the item 293 remains in contact with the fluid 291 regardless of the orientation of the second container section 202.

Consequently, like interlocking sectional container 100, first container section 101 and second container section 102 discussed above with respect to FIGS. 1D-1H, and in contrast to the prior art, the first container section 201, second container section 202, and interlocking sectional container 200 of FIGS. 2A-2G include containment enclosures 280 and 290 that are relatively deep and have continuously curved sides in all directions for containing both the items 283/293 and the fluids 281/291. Consequently, fluids 281/291 can freely move together with items 283/293 in the containment enclosure 290/290 so that the items 283/293 remains in contact with the fluids 281/291 regardless of the orientation of first container section 201, second container section 202, or interlocking sectional container 200. This represents a significant improvement over prior art methods and systems.

Referring back to FIGS. 2A-2G, as noted above, in one embodiment, first container section 201 is capable of being removably coupled to first container section 201 by an interconnector 230 such that the first container section 201 and a second container section 202 can be connected and separated by a user as desired.

FIGS. 2F and 2G show a side sectional view of connected first container section 201 and second container section 202 assemblies interconnected using interconnector 230 to form connected interlocking sectional container 200 in accordance with one embodiment.

In various embodiments, interconnector 230 can be any interconnector mechanism capable of removably coupling first container section 201 to second container section 202 such that the first container section 201 and second container section 202 can be connected and separated by a user as desired, as discussed herein, and/or as available/known in the art at the time of filing, and/or as made known/available after the time of filing.

As discussed in more detail below, in one specific embodiment, interconnector 230 includes one or more ball detent connectors 233 housed in one or more ball detent connector housings 231.

In one embodiment, interconnector 230 is connected to one surface of first container section body 220 at first container section/interconnector interface 225. Similarly, in one embodiment, interconnector 230 is connected to one surface of second container section body 240 at second container section/interconnector interface 245. In this way, the disclosed first and second container sections 201 and 202 are removably attached to each other to form the disclosed interlocking sectional container 200 using interconnector 230.

As discussed in more detail below, in one embodiment, one end of the interconnector 230 is permanently attached to one surface of either the first container section body 220 or the second container section body 240, and the ball detent connectors 233 of the interconnector 230 are then mated with ball detent connector catches 226 formed on the other of the second container section body 240 or the first container section body 220.

Regardless of the specific type of interconnector 230 used, the disclosed first and second container sections 201 and 202 are removably attached to each other to form the disclosed interlocking sectional container 200. In this way, the disclosed first and second container sections 201 and 202, respectively, can be separated from each other and manipulated separately as needed.

Those of skill in the art will recognize that while in the discussion above an interlocking sectional container 200 with two container sections, e.g., first container section 201, and second container section 202, is set forth, in other embodiments, any number interlocking container sections can be implemented as all or part of the disclosed interlocking sectional container. Therefore, in other embodiments, the disclosed interlocking sectional container can include a single container section, or any desired number of container sections.

As noted above, in some embodiments, interlocking sectional container 200 is a contact lens interlocking sectional container. In these embodiments, first container section 201 can be used to contain an item 283 that is a first contact lens and a fluid 281 that is a first portion of contact lens solution. Similarly, in these embodiments, second container section 202 can be used to contain an item 293 that is a second contact lens and fluid 291 that is a second portion of contact lens solution.

Figure 3A:
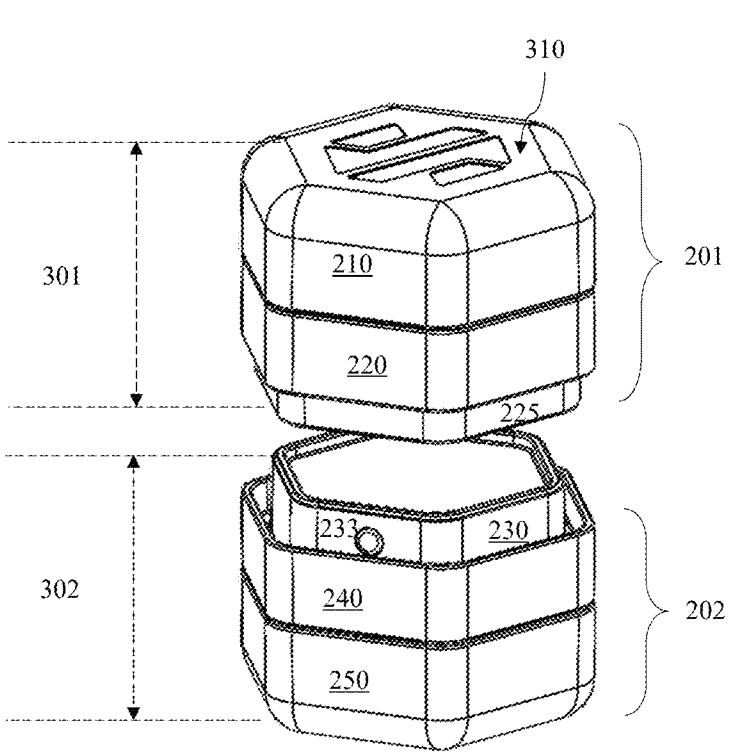
FIG. 3A is a diametric view of a partially disassembled interlocking sectional container in accordance with one embodiment.

FIG. 3A is a diametric view of partially disassembled interlocking sectional container 200 in accordance with one embodiment.

Referring to FIGS. 2A-2G and FIGS. 3A-3D together, in FIG. 3A first container section 201 is shown removably disconnected from second container section 202.

As shown in FIG. 3A, in one embodiment, interconnector 230 is permanently coupled to second container section body 240. In this specific illustrative example, interconnector 230 is removably coupled to first container section body 220 using ball detents 233 in interconnector 230 and ball detect catches formed in first container section body 220 (not shown in FIG. 3A, see FIGS. 2E and 7C).

As also shown in FIG. 3A, in one embodiment, first container section 201 has a first container section exterior length 301 and second container section 202 has a second container section exterior length 302. In some embodiments, first container section exterior length 301 of first container section 201 and second container section exterior length 302 of second container section 202 are equal to each other.

Figure 3B:
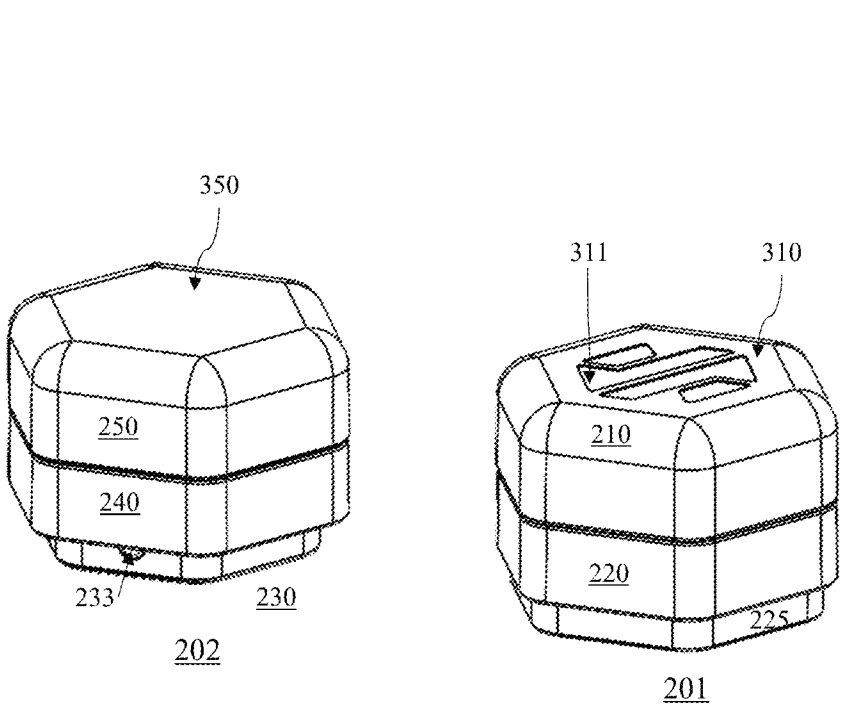
FIG. 3B is a diametric view of a partially disassembled interlocking sectional container showing a first container section and a second container section disconnected in accordance with one embodiment.

FIG. 3B is a diametric view of a partially disassembled interlocking sectional container 200 showing first container section 201 and second container section 202 assemblies disconnected in accordance with one embodiment. In FIG. 3B, surface 350 of second container section cap 250 is shown.

Figure 3C:
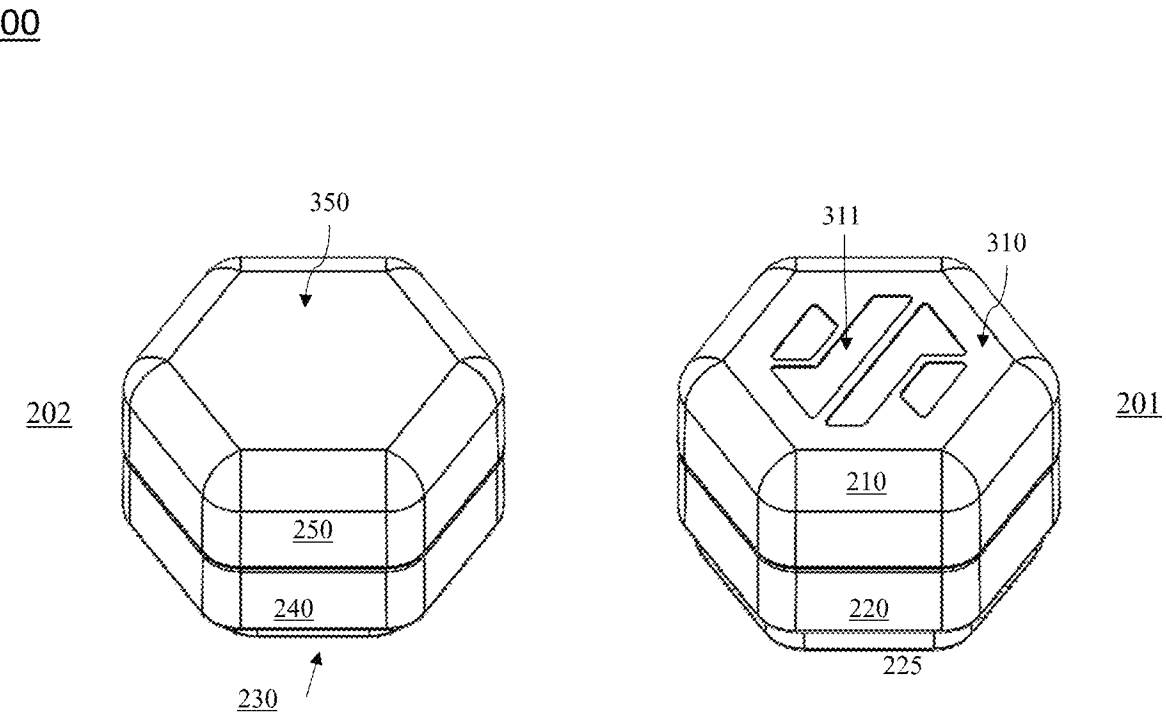
FIG. 3C is a perspective view of a partially disassembled interlocking sectional container showing first container section and second container section assemblies disconnected in accordance with one embodiment.

FIG. 3C is a perspective view of partially disassembled interlocking sectional container 200 showing first container section 201 and second container section 201 assemblies in accordance with one embodiment disconnected.

Figure 3D:
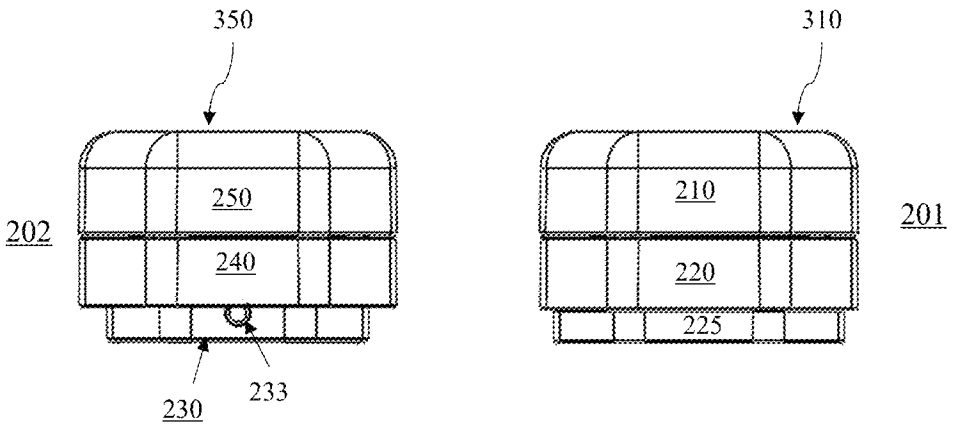
FIG. 3D is a side view of a partially disassembled interlocking sectional container showing a first container section and a second container section disconnected in accordance with one embodiment.

FIG. 3D is a side view of partially disassembled interlocking sectional container 200 showing the first container section 201 and second container section 202 assemblies disconnected in accordance with one embodiment.

Figure 4:
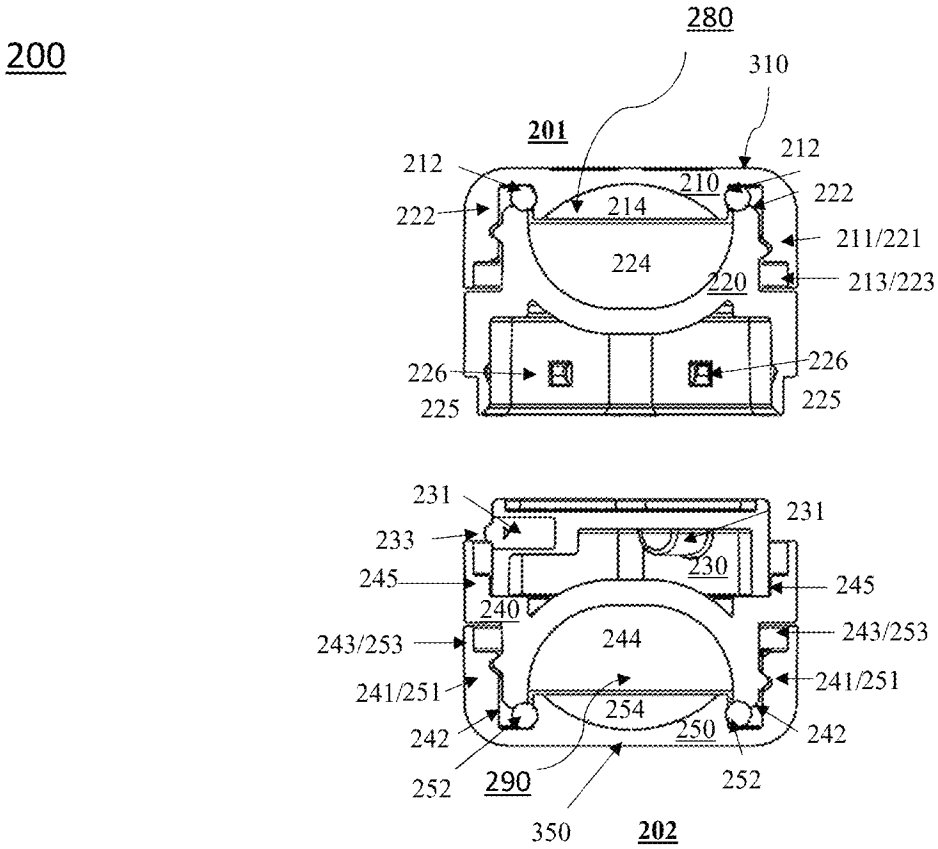
FIG. 4 is a sectional side view of a partially disassembled interlocking sectional container showing the first container section and second container section assemblies of FIGS. 2A-2G and 3A-3D disconnected.

FIG. 4 is a sectional side view of a partially disassembled interlocking sectional container 200 showing first container section 201 and second container section 202 assemblies of FIGS. 2A-2G and 3A-3D disconnected.

FIGS. 5A-FIG. 5D show various views of the disassembled components of the interlocking sectional container 200 of FIGS. 2A-2G and 3A-3D.

Figure 5A:
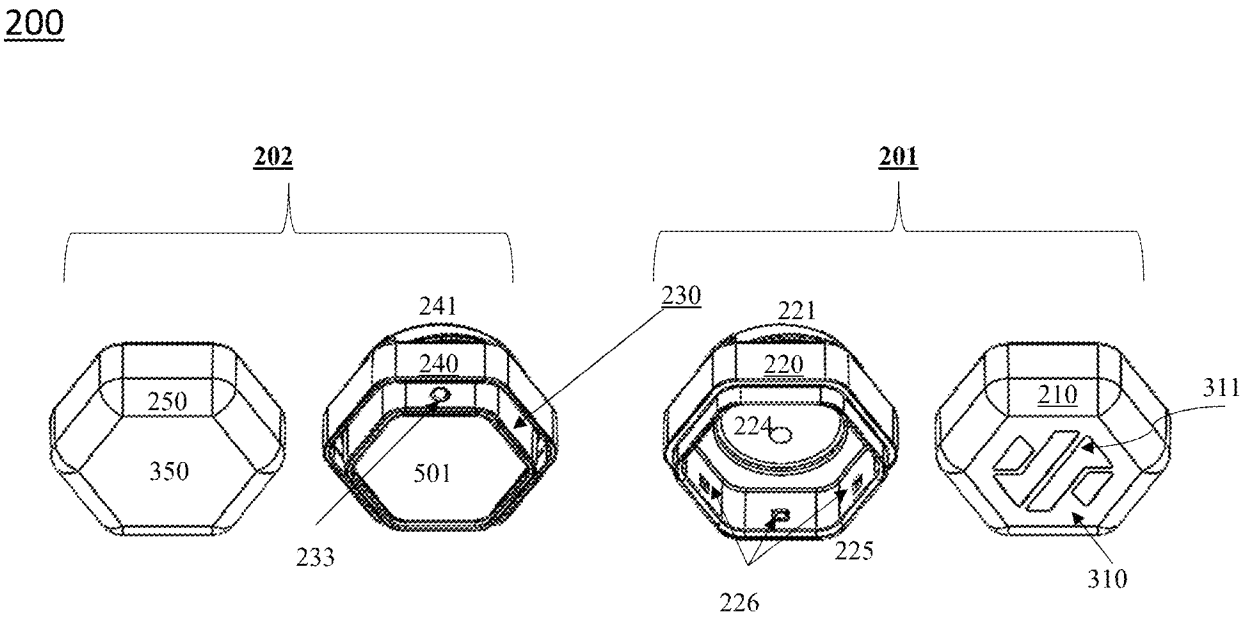
FIGS. 5A-FIG. 5D show various views of the disassembled components of the interlocking sectional container of FIGS. 2A-2G and 3A-3D.

Referring to FIGS. 2A-2G, FIGS. 3A-3D, and FIGS. 5A-5D, FIG. 5A is a bottom perspective view of fully disassembled interlocking sectional container 200 in accordance with one embodiment. Shown in FIG. 5A is interconnector second surface 501 in accordance with one embodiment.

Figure 5B:
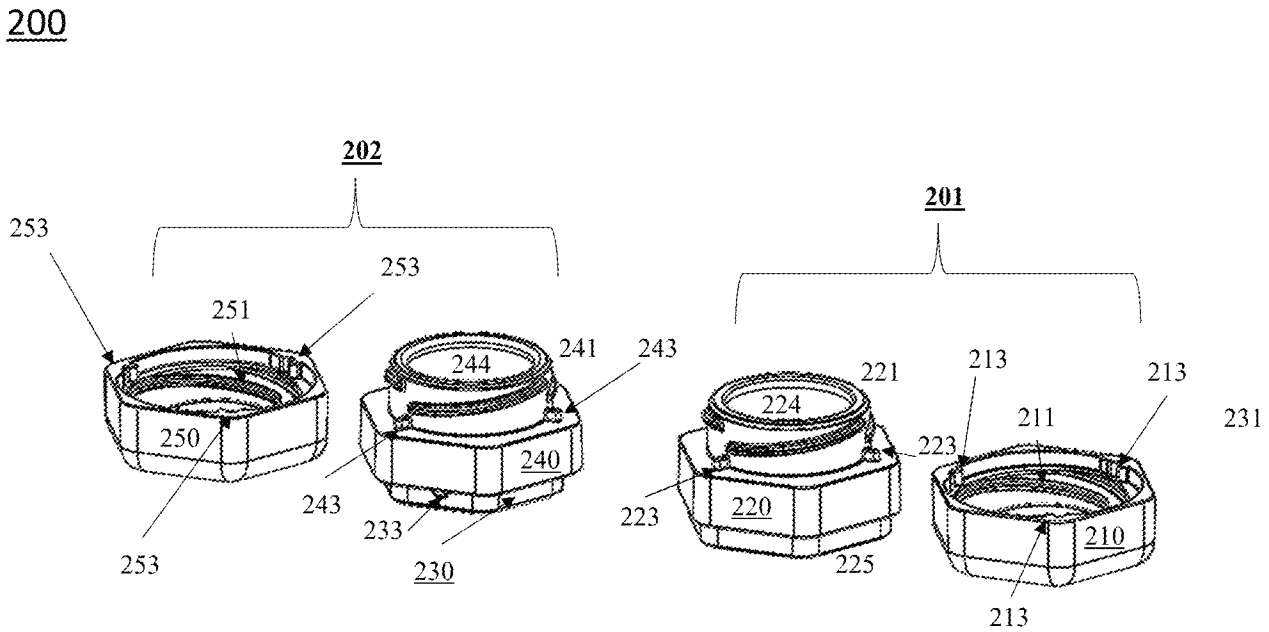

FIG. 5B is a diametric view of fully disassembled interlocking sectional container 200 in accordance with one embodiment.

Figure 5C:
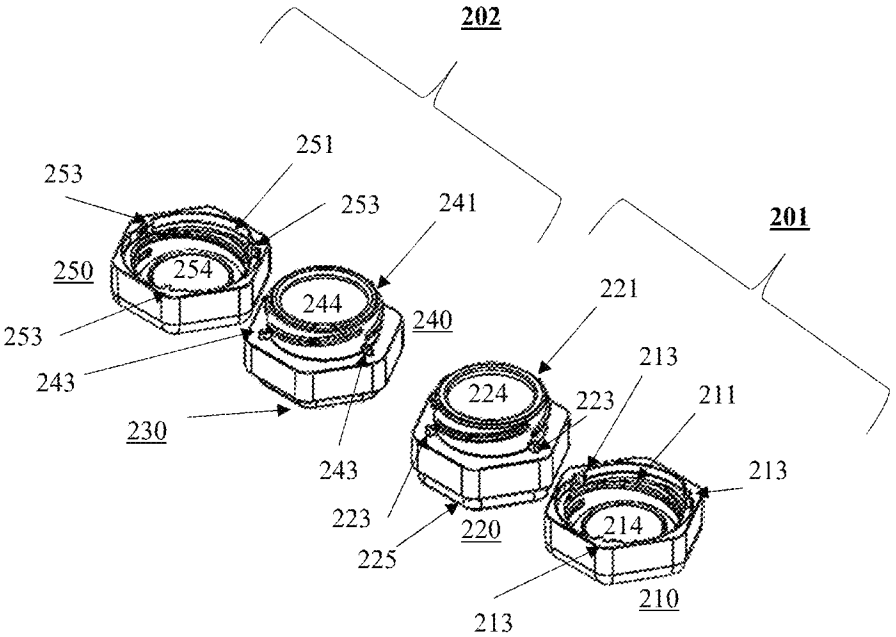

FIG. 5C is an isomeric view of fully disassembled interlocking sectional container 200 in accordance with one embodiment.

Figure 5D:
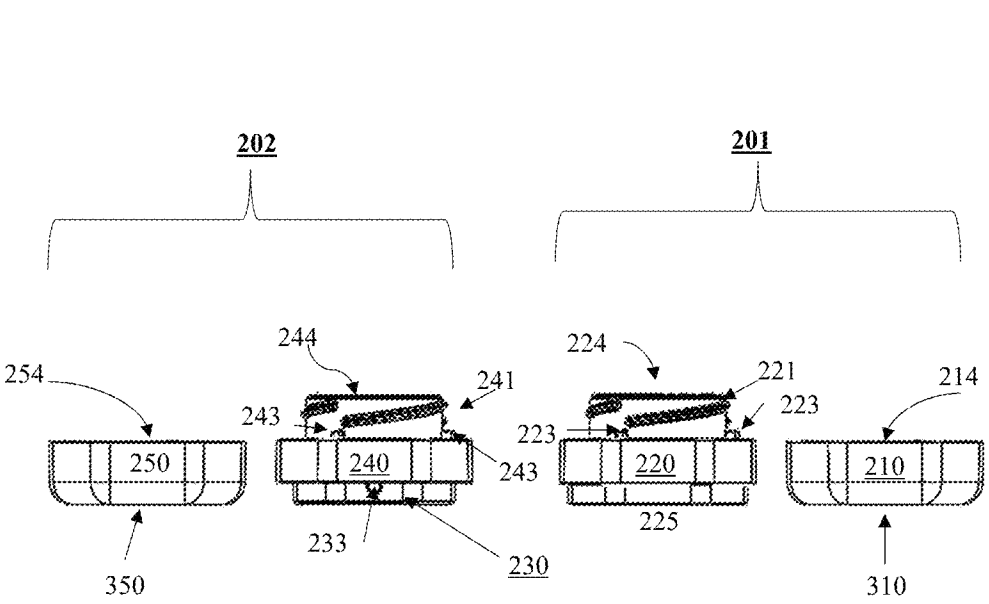

FIG. 5D is a side view of fully disassembled interlocking sectional container 200 in accordance with one embodiment.

FIGS. 6A-6D show various views of first container section cap 210 in accordance with one embodiment.

Referring to FIGS. 2A-2G, FIGS. 3A-3D, FIGS. 5A-5D, and FIGS. 6A-6D, FIG. 6A is an isomeric top perspective view of exterior surface 310 of first container section cap 210 in accordance with one embodiment.

Figure 6A:
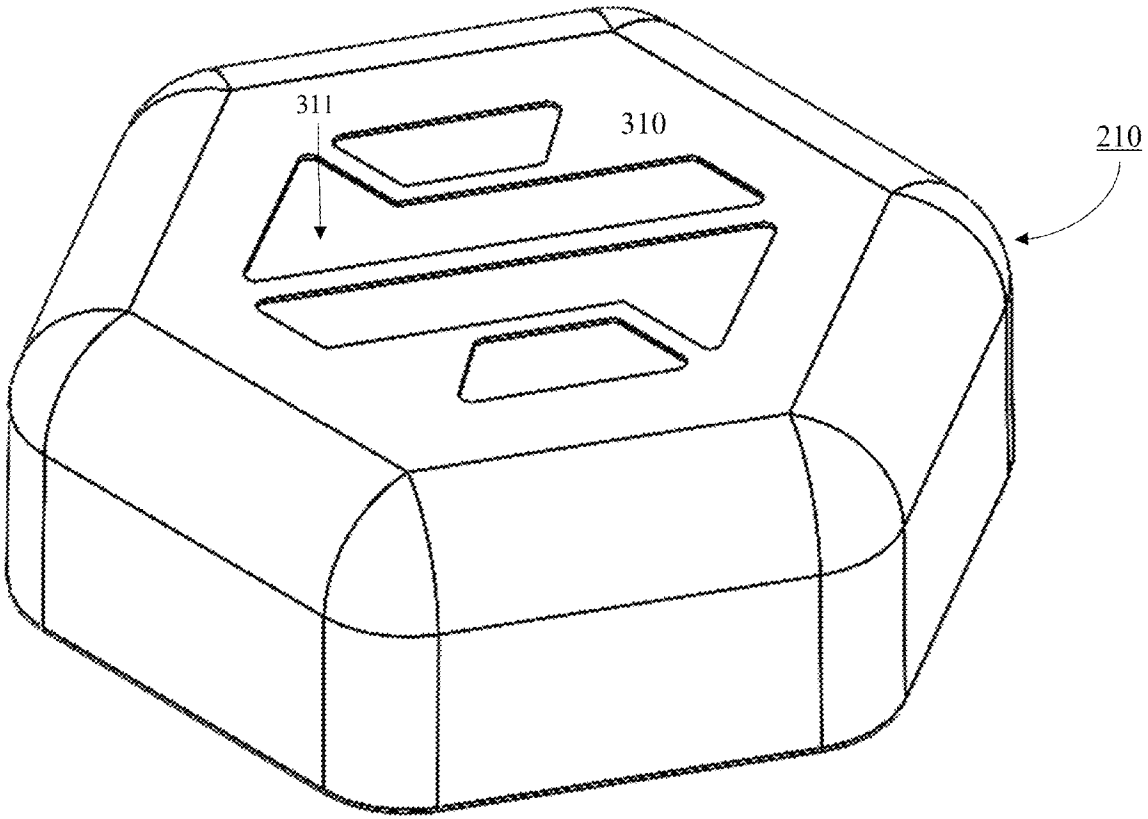
FIGS. 6A-6E show various views of a first container section cap in accordance with one embodiment.
Figure 6B:
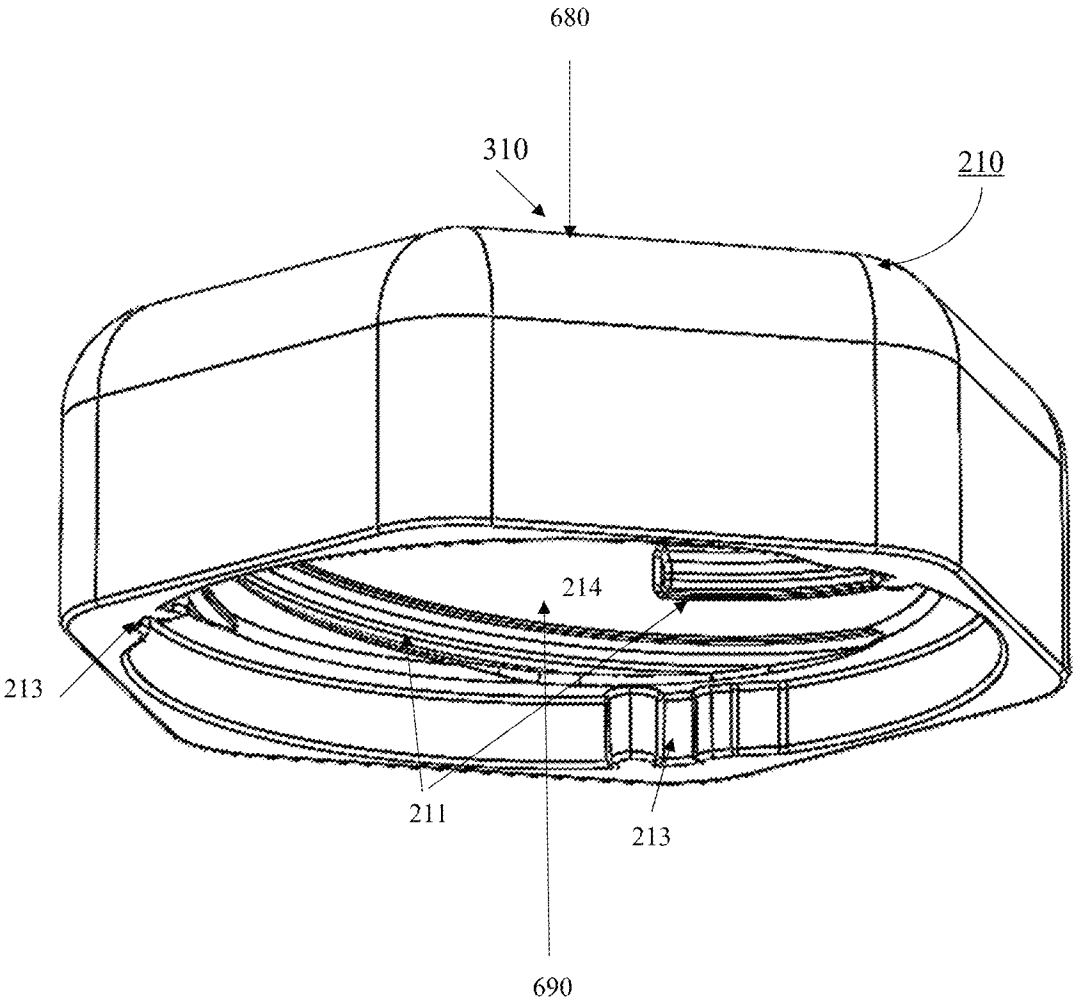

FIG. 6B is an isomeric bottom perspective view of first container section cap 210 in accordance with one embodiment. Shown in FIG. 6B is first container section cap exterior axis 680 and first container section cap interior axis 690.

Figure 6C:
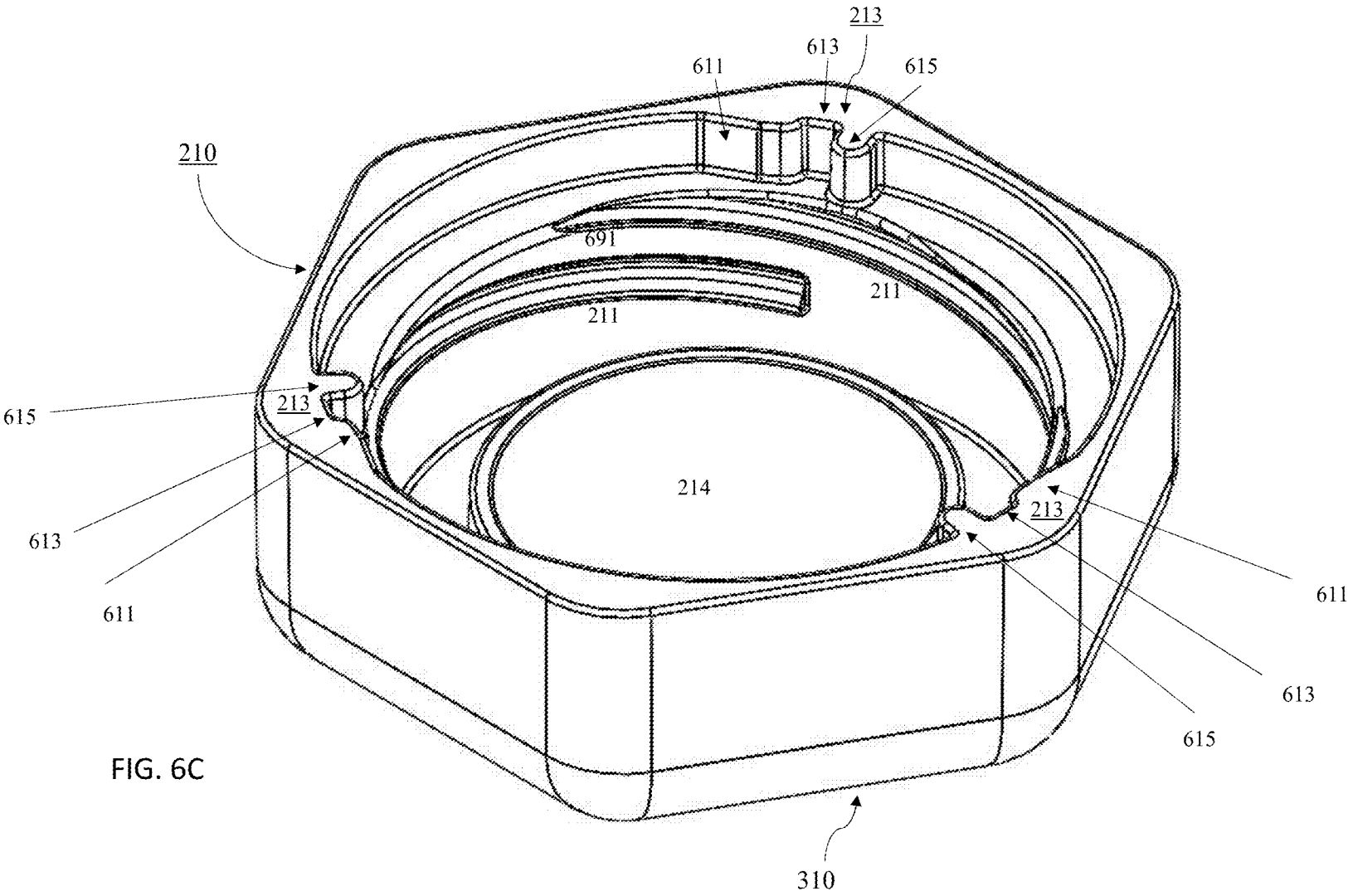

FIG. 6C is an isomeric top perspective view of an interior surface of first container section cap 210 in accordance with one embodiment. Shown in FIG. 6C are first container section cap lock curved guides 611, first container section cap lock catches 613, and first container section cap lock stops 615.

Figure 6D:
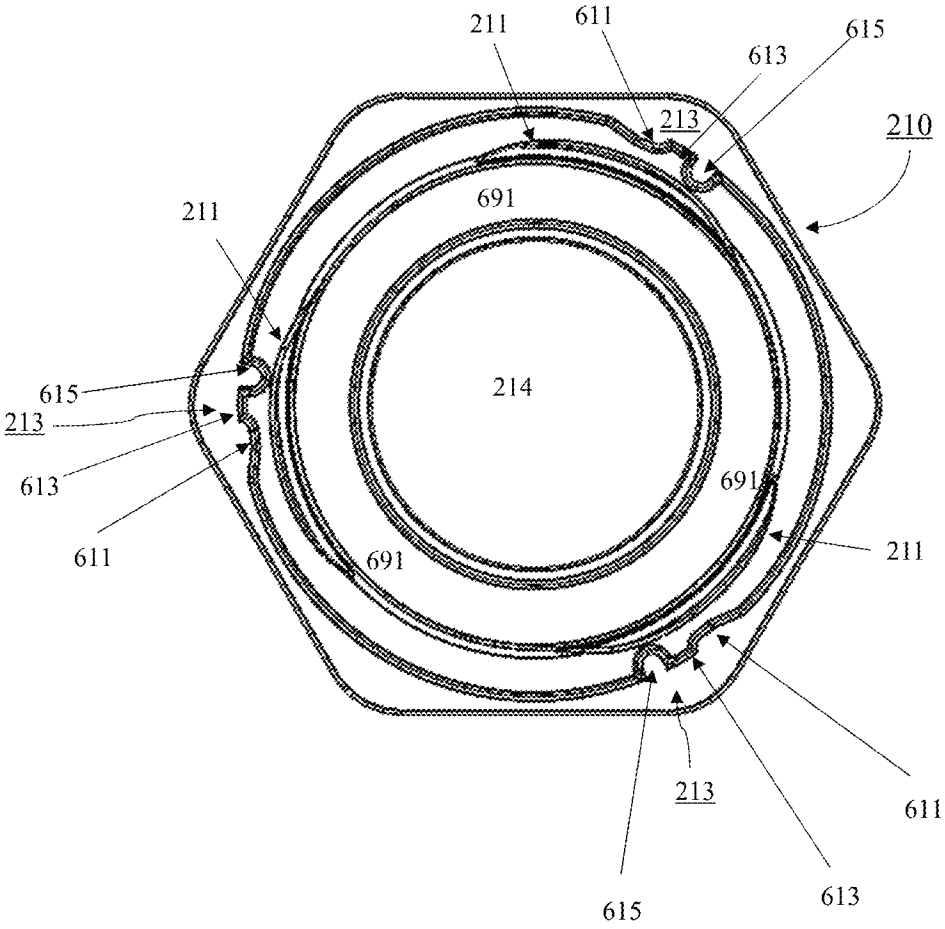

FIG. 6D is a view of an interior surface of first container section cap 210 looking down axis 690 of FIG. 6B in accordance with one embodiment.

Referring to FIGS. 6C, 6D, 7A and 7B, in one embodiment, first container section cap lock curved guides 611, first container section cap lock catches 613, and first container section cap lock stops 615 engage with first container section body locking detents 223 of first container section body 220 when first container section cap 210 is being coupled to first container section body 220 to lock first container section cap 210 in a desired position with respect to first container section body 220.

To this end, as self-sealing threads 211 and 221 are used to removably couple first container section cap 210 and first container section body 220, first container section cap lock curved guides 611 engage first container section body locking detents 223 and guide first container section body locking detents 223 into first container section cap lock catches 613 where first container section body locking detents 223 are captured. First container section cap lock stops 615 prevent first container section body locking detents 223, and therefore first container section cap 210, from moving past first container section cap lock stops 615.

Thus, the action of first container section cap lock curved guides 611, first container section cap lock catches 613, and first container section cap lock stops 615 help create the leak proof seal between first container section cap 210 and first container section body 220 and prevent self-sealing threads 211 and 221 from being stripped, or otherwise damaged.

In addition, first container section cap lock stops 615 make sure first container section cap 210 is in a desired position with respect to first container section body 220. In this way a continuous flat surface, such as flat surface 293 of FIG. 2A can be formed by keeping first container section cap 210 in the correct orientation with respect to first container section body 220.

Also of note in FIG. 6C and FIG. 6D is that, in one embodiment, there are three starting positions 691 and three stopping positions, e.g., first container section cap lock stops 615, for self-sealing threads 211. The result is that a user can more easily mate self-sealing threads 211 and 221 from various positions to allow first container section cap 210 to be properly coupled to first container section body 220. This feature is shown in detail in FIG. 6D.

Figure 6E:
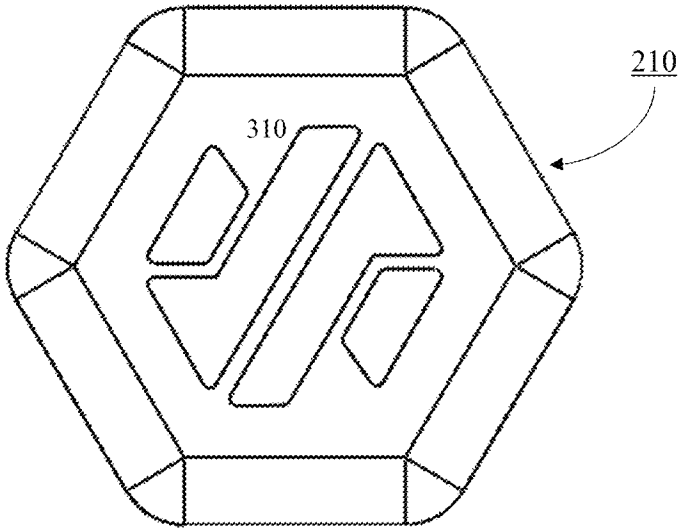

FIG. 6E is a downward looking view of exterior surface 310 looking down axis 680 of FIG. 6B of first container section cap 210 in accordance with one embodiment.

FIGS. 7A-7D show various views of first container section body 240 in accordance with one embodiment.

Referring to FIGS. 2A-2G, FIGS. 3A-3D, FIGS. 5A-5D, and FIGS. 7A-7D, FIG. 7A is an isomeric bottom perspective view of a first surface of first container section body 220 of interlocking sectional container 200 in accordance with one embodiment. Shown in FIG. 7A is first surface axis 780.

Figure 7A:
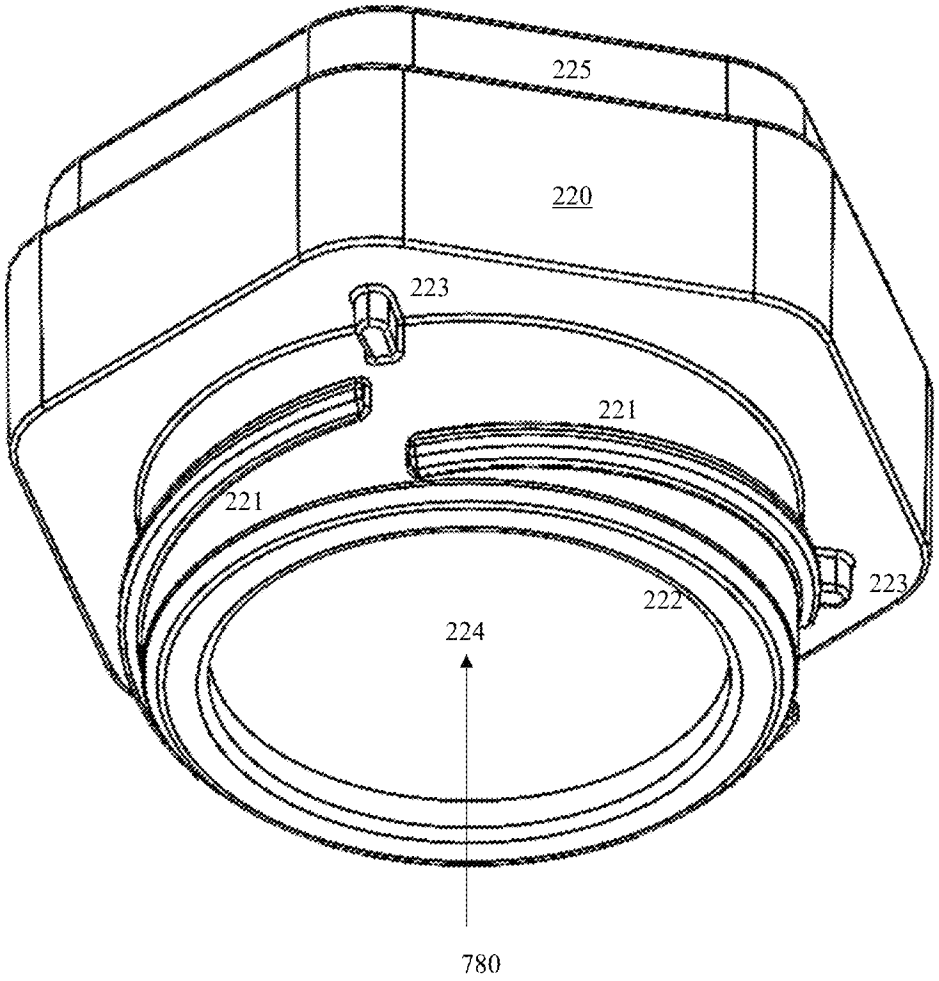
FIGS. 7A-7D show various views of a first container section body in accordance with one embodiment.
Figure 7B:
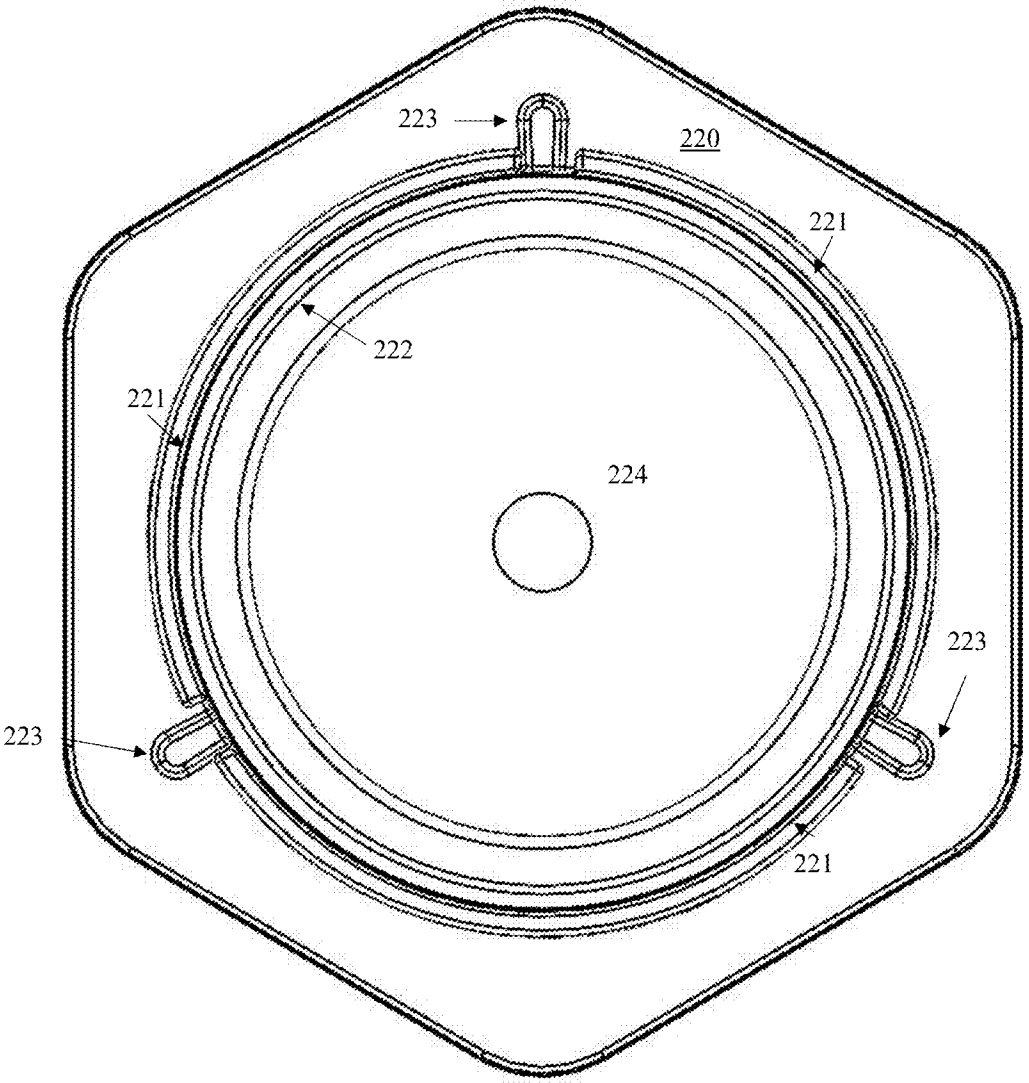

FIG. 7B is a downward looking view of the first surface of first container section body 220 looking down first surface axis 780 of FIG. 7A in accordance with one embodiment.

Figure 7C:
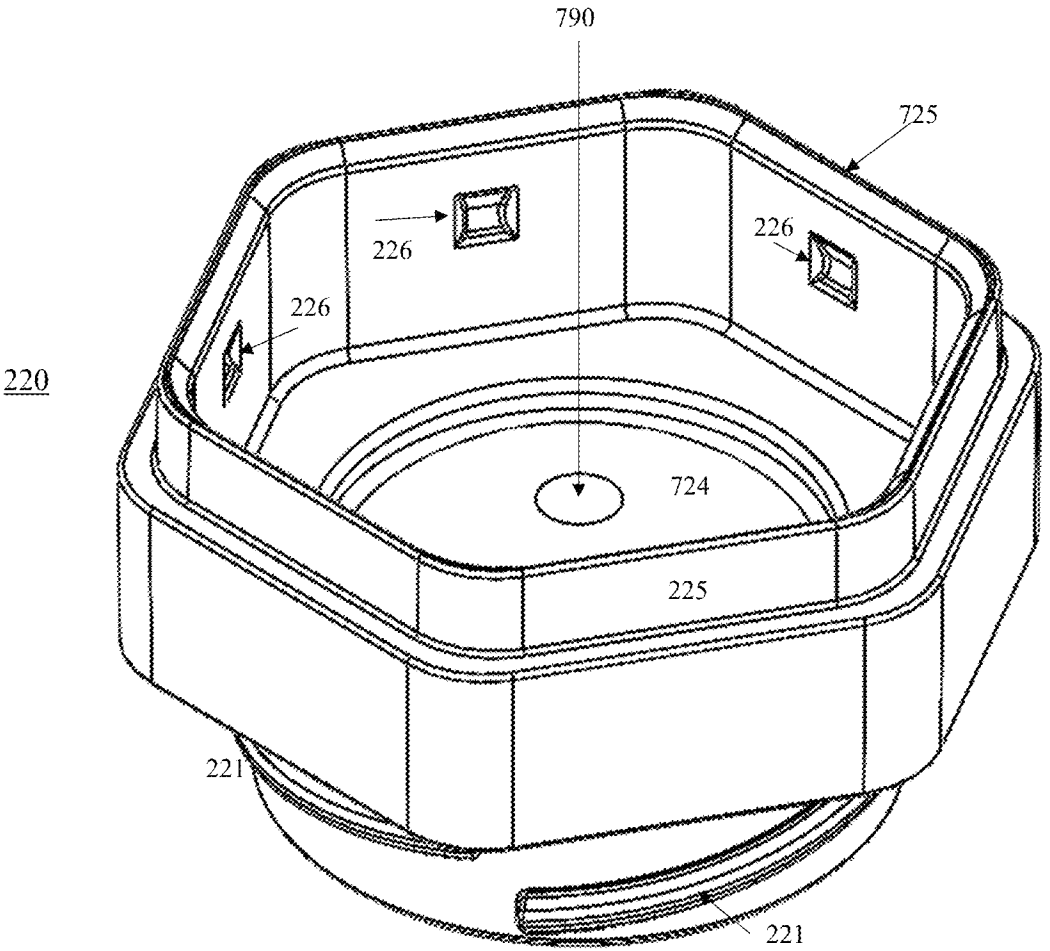

FIG. 7C is an isomeric top view of a second surface of first container section body 220 of an interlocking sectional container 200 in accordance with one embodiment. Shown in FIG. 7C is a second surface axis 790, first container section body concave outer surface 724, and first container section/interconnector interface edge 725.

Figure 7D:
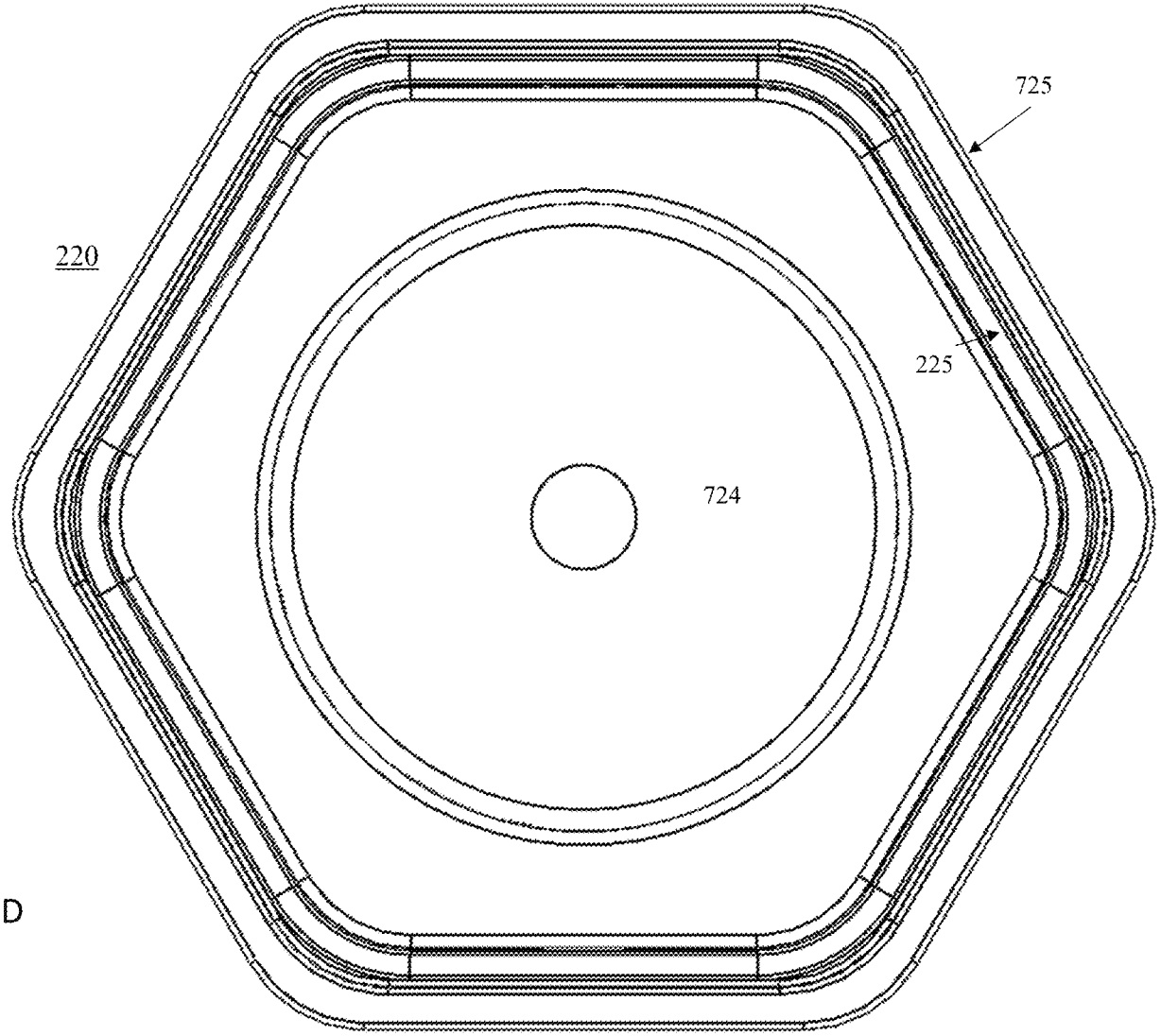

FIG. 7D is a downward looking view of the second surface of first container section body 220 of FIG. 7C looking down second surface axis 790 in accordance with one embodiment.

FIGS. 8A-8E show various views of interconnector 230 in accordance with one embodiment.

Referring to FIGS. 2A-2G, FIGS. 3A-3D, FIGS. 5A-5D, and FIGS. 8A-8E, FIG. 8A is an isomeric view of a second surface of interconnector 230 in accordance with one embodiment.

Figure 8A:
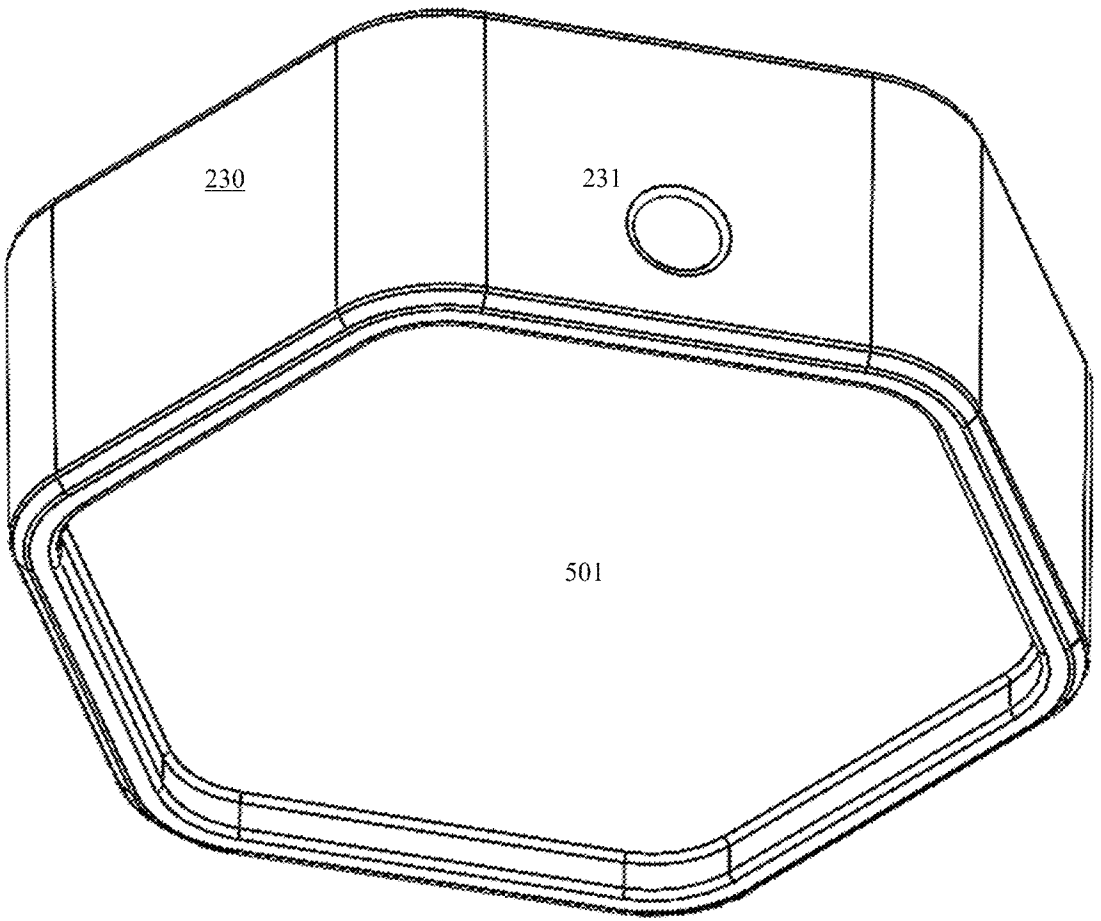
FIGS. 8A-8E show various views of an interconnector in accordance with one embodiment.
Figure 8B:
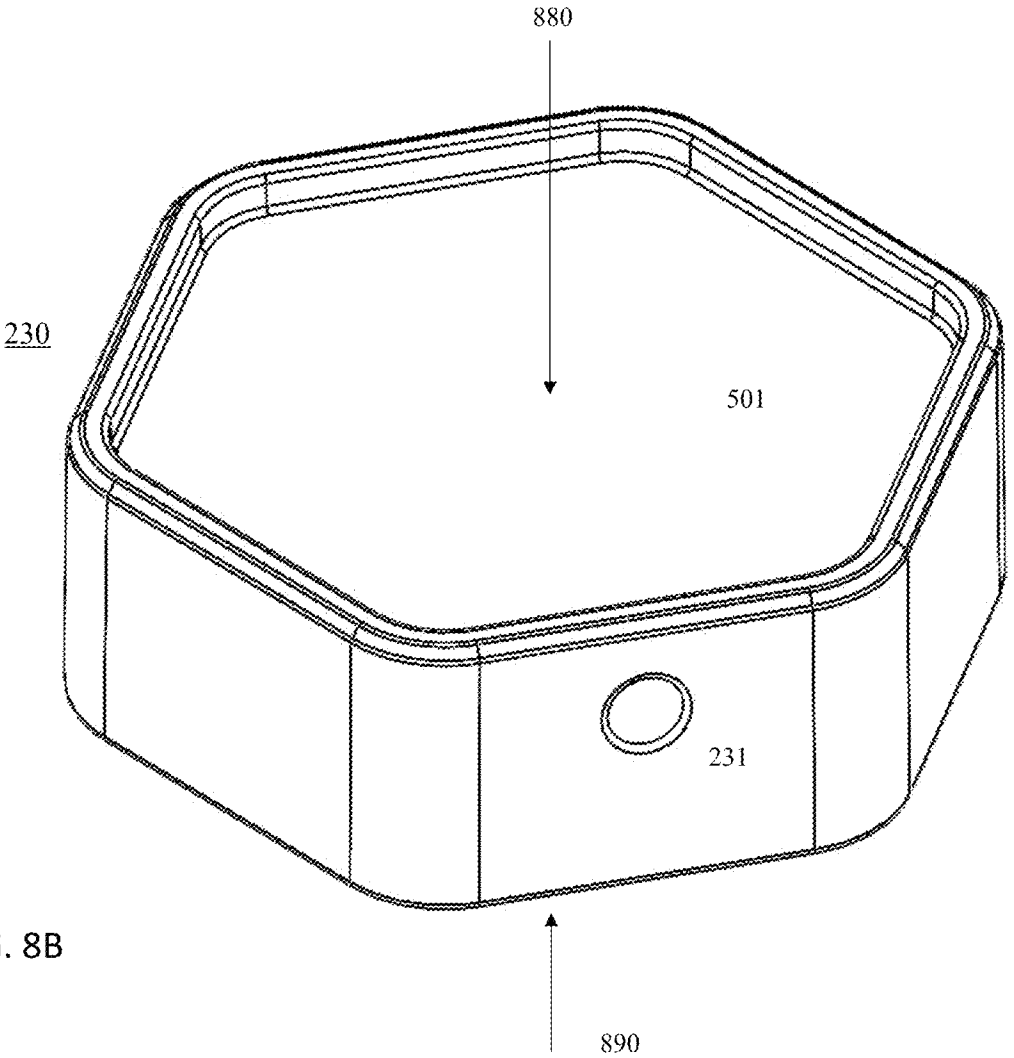

FIG. 8B is a perspective view of the second surface of interconnector 230 of FIG. 8A in accordance with one embodiment. Shown in FIG. 8B are second surface axis 880 and first surface axis 890 of interconnector 230.

Figure 8C:
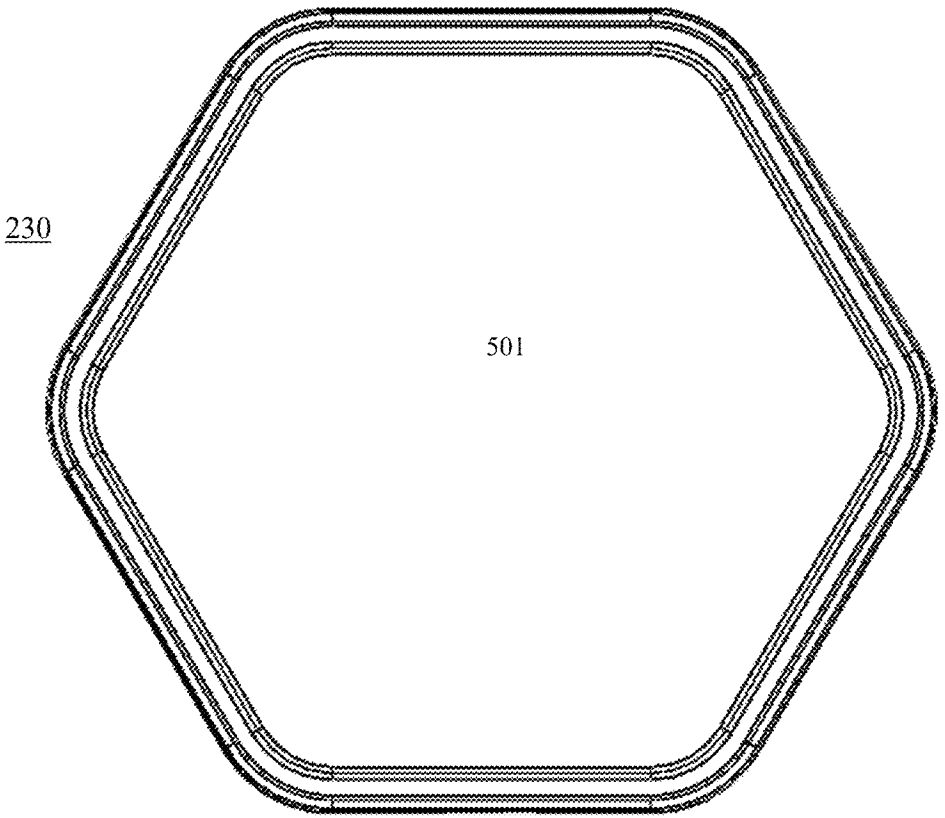

FIG. 8C is a downward looking view of the second surface of interconnector 230 of FIGS. 8A and 8B looking down second surface axis 880 of FIG. 8B in accordance with one embodiment.

Figure 8D:
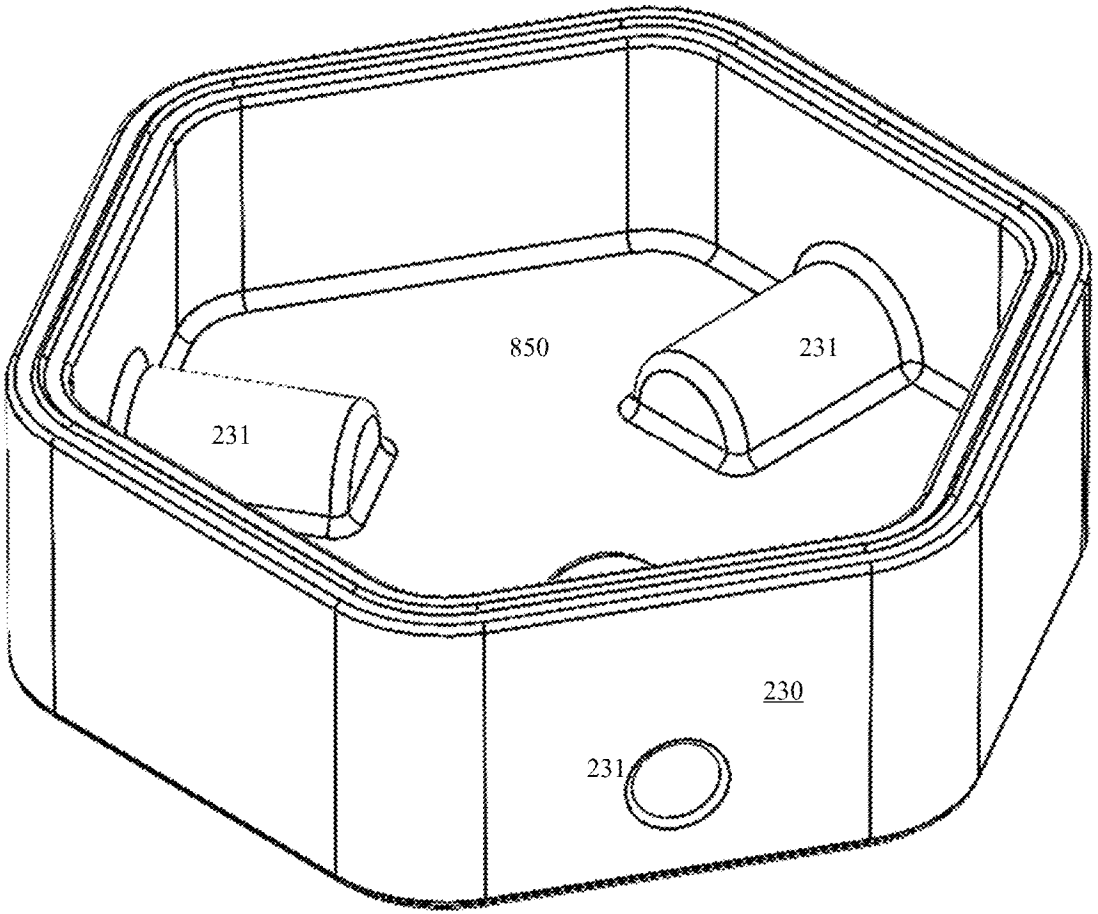

FIG. 8D is an isomeric view of a first surface of interconnector 230 in accordance with one embodiment. Shown in FIG. 8D is interior surface 850 of interconnector 230.

Figure 8E:
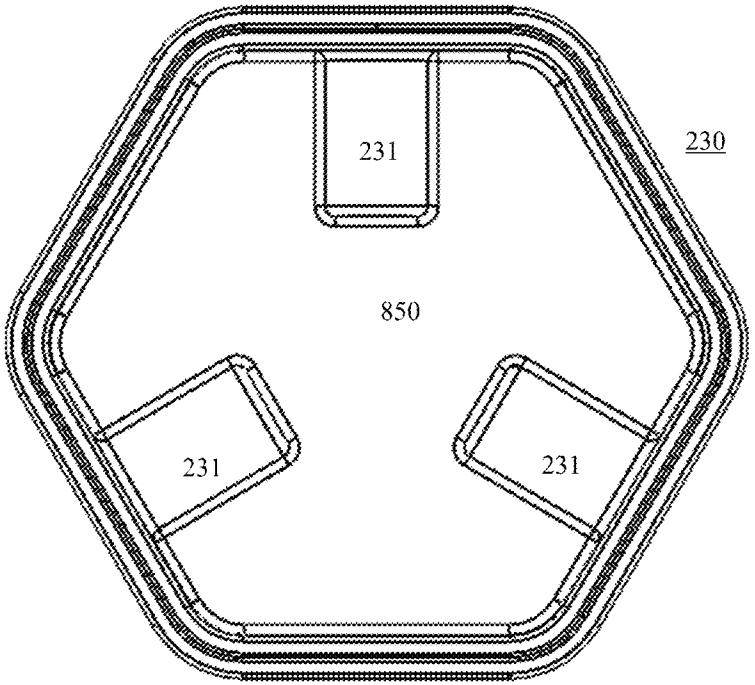

FIG. 8E is downward looking view of the first surface of interconnector 230 of FIG. 8D looking down first surface axis 890 of FIG. 8B in accordance with one embodiment.

FIGS. 9A-9E show various views of second container section body 240 in accordance with one embodiment.

Referring to FIGS. 2A-2G, FIGS. 3A-3D, FIGS. 5A-5D, and FIGS. 9A-9E, FIG. 9A is an isomeric top perspective view of a first surface of second container section body 240 of interlocking sectional container 200 in accordance with one embodiment. Shown in FIG. 9A are second container section body concave outer surface 924, first surface axis 980, and second surface axis 990.

Figure 9A:
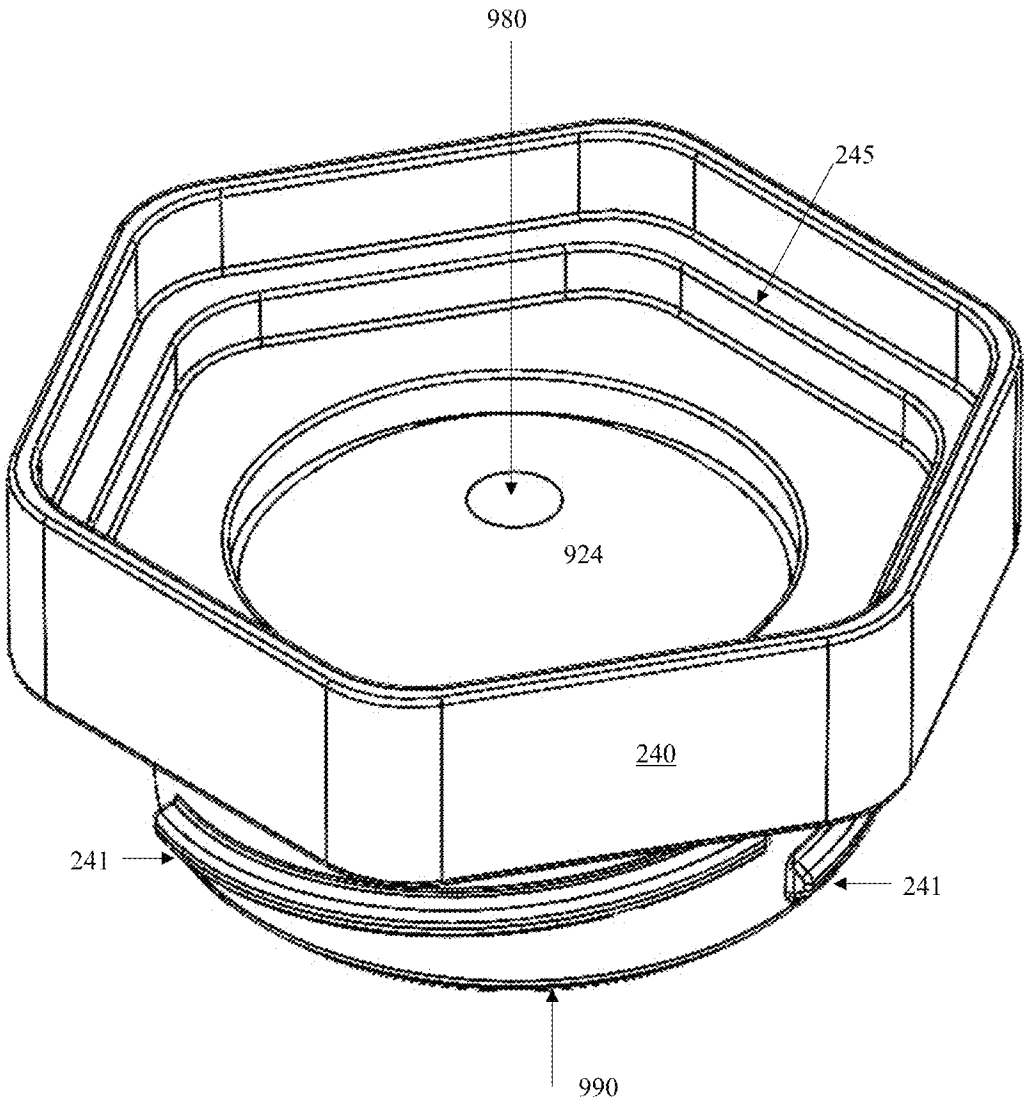
FIGS. 9A-9E show various views of a second container section body in accordance with one embodiment.
Figure 9B:
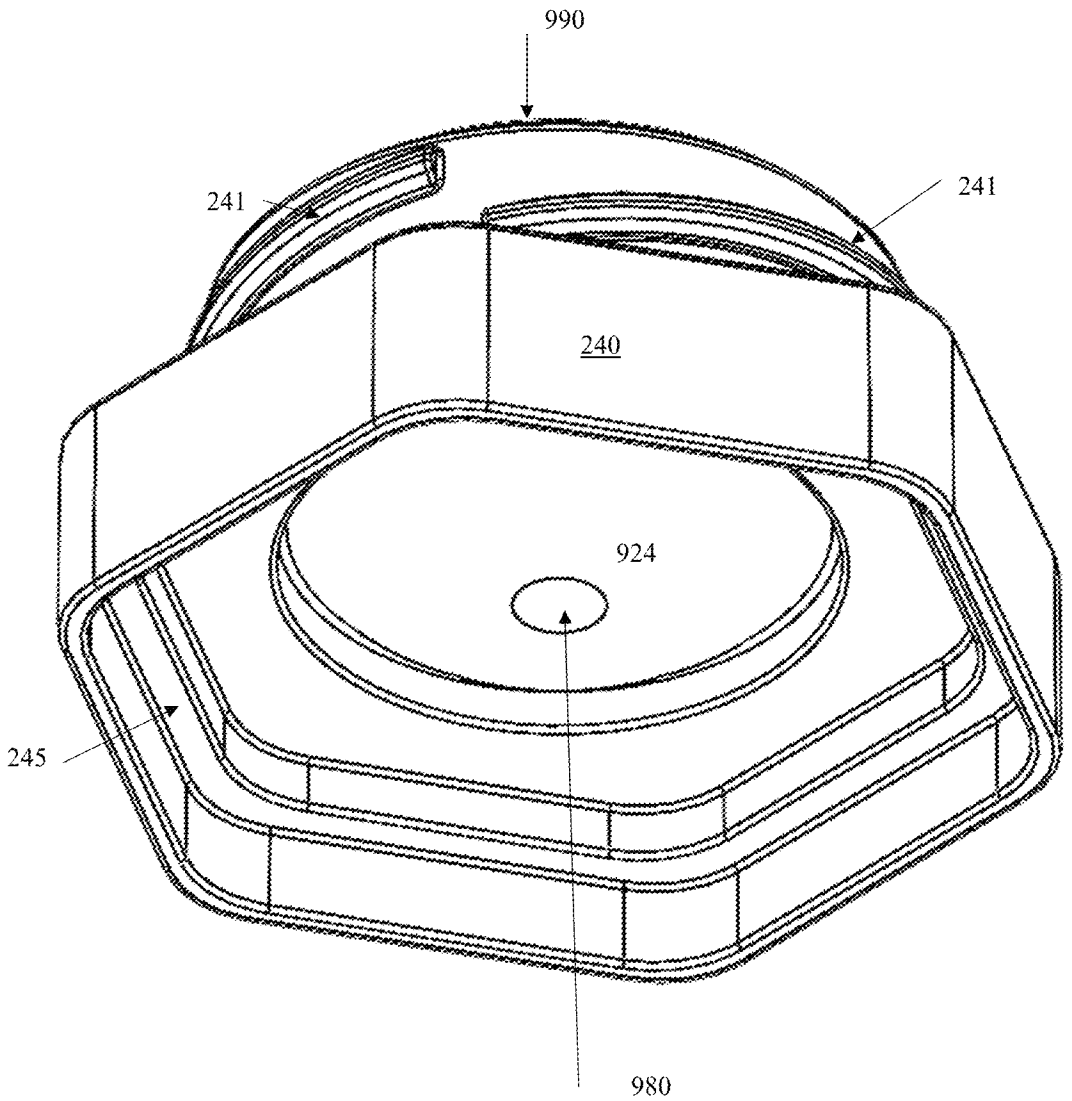

FIG. 9B is an isomeric bottom perspective view of the first surface of second container section 240 body of FIG. 9A in accordance with one embodiment.

Figure 9C:
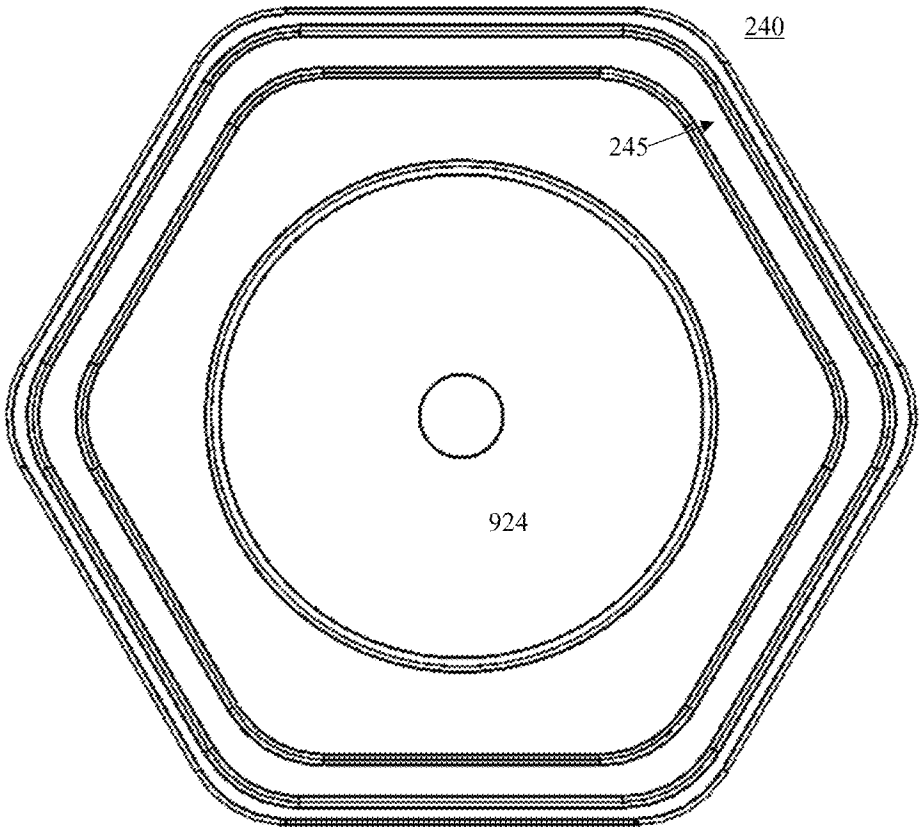

FIG. 9C is a downward looking view of the first surface second container section body 240 of FIG. 9A as seen looking down first surface axis 980 of FIG. 9A in accordance with one embodiment.

Figure 9D:
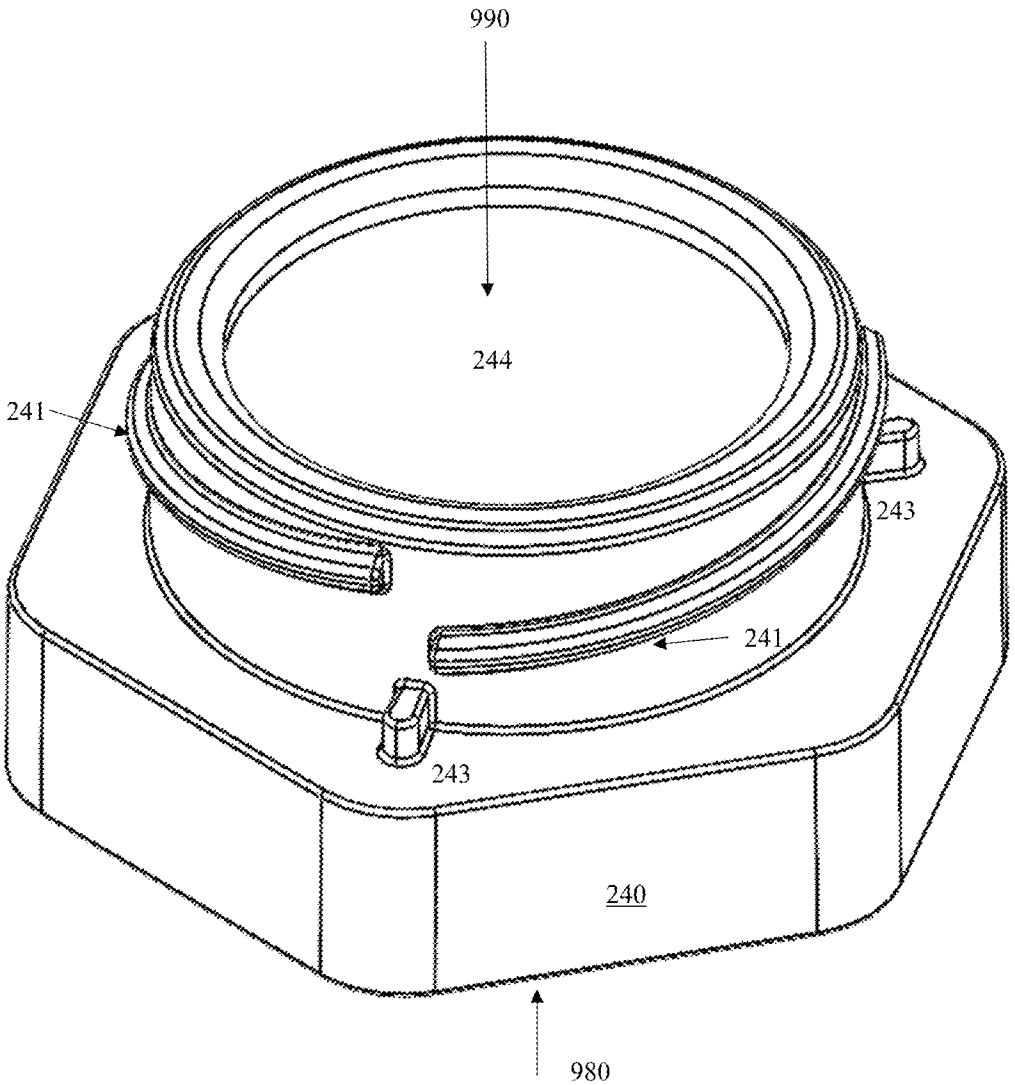

FIG. 9D is an isomeric bottom perspective view of a second surface of second container section body 240 of interlocking sectional container 200 in accordance with one embodiment.

Figure 9E:
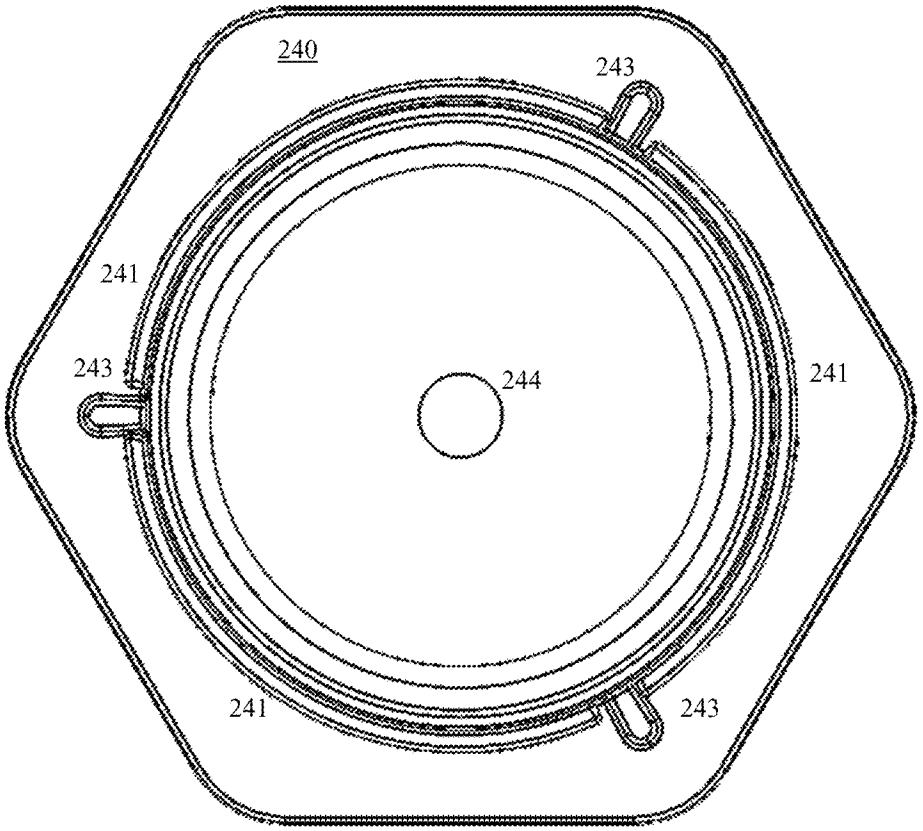

FIG. 9E is a downward looking view of the second surface of second container section body 240 of FIG. 9D as seen looking down second surface axis 990 of FIG. 9D in accordance with one embodiment.

FIGS. 10A-10D show various views of second container section cap 250 in accordance with one embodiment.

Referring to FIGS. 2A-2G, FIGS. 3A-3D, FIGS. 5A-5D, and FIGS. 10A-10D, FIG. 10A is an isomeric bottom perspective view of exterior surface 350 of first container section cap 250 in accordance with one embodiment. Shown in FIG. 10A is second container section cap exterior axis 1080 and second container section cap interior axis 1090.

Figure 10A:
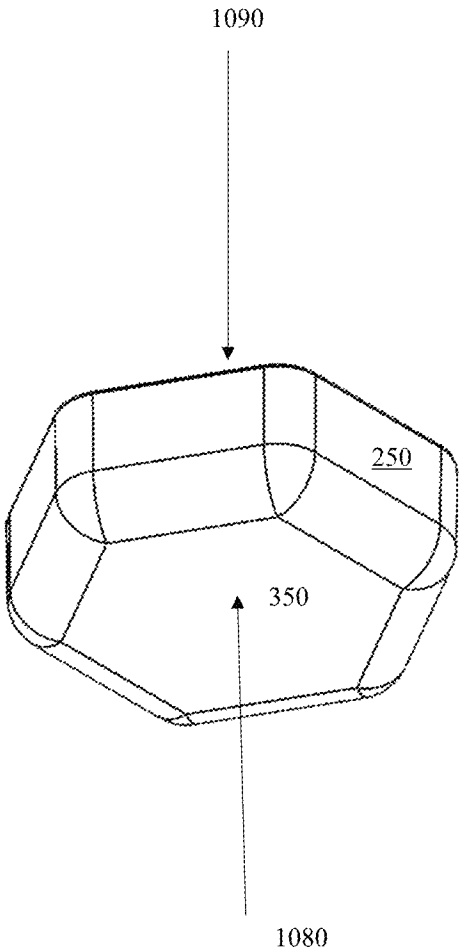
FIGS. 10A-10D show various views of a second container section cap in accordance with one embodiment.
Figure 10B:
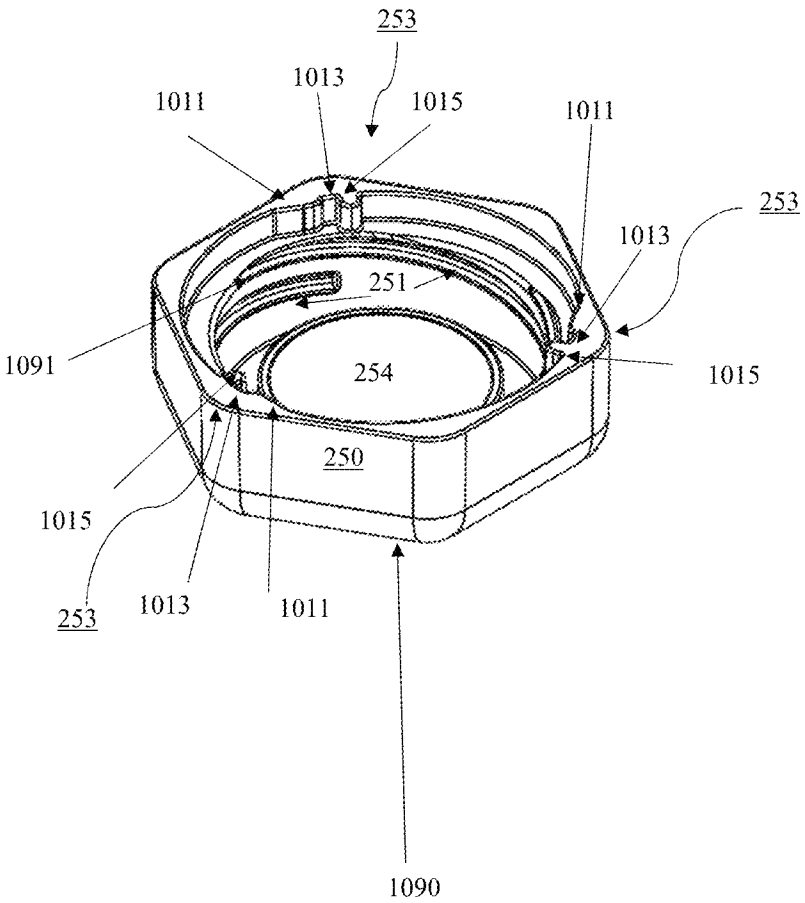

FIG. 10B is an isomeric top perspective view of an interior surface of second container section cap 250 in accordance with one embodiment.

Figure 10C:
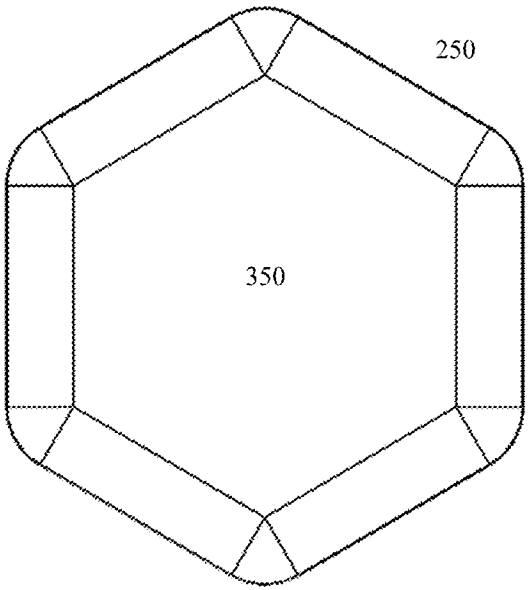

FIG. 10C is a downward looking view of exterior surface 350 looking down axis 1080 of FIG. 10A of second container section cap 250 in accordance with one embodiment.

Figure 10D:
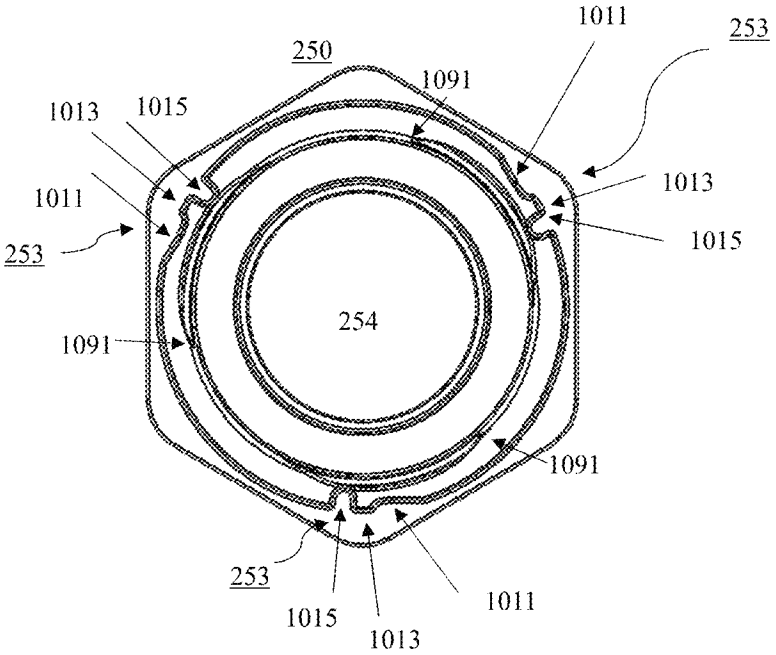

FIG. 10D is a view of an interior surface of second container section cap 250 looking down axis 1090 of FIG. 10A in accordance with one embodiment.

Shown in FIGS. 10B and 10D are second container section cap lock curved guides 1011, second container section cap lock catches 1013, and second container section cap lock stops 1015.

Referring to FIGS. 10B, 10D, 9D and 9E, in one embodiment, second container section cap lock curved guides 1011, second container section cap lock catches 1013, and second container section cap lock stops 1015, engage with second container section body locking detents 243 of second container section body 240 when second container section cap 250 is being removably coupled to second container section body 240 to lock second container section cap 250 in a desired position with respect to second container section body 240.

To this end, as self-sealing threads 251 and 241 are used to removably couple second container section cap 250 and second container section body 240, second container section cap lock curved guides 1011 engage second container section body locking detents 243 and guide second container section body locking detents 243 into second container section cap lock catches 1013 where second container section body locking detents 243 are captured. Second container section cap lock stops 1015 prevent second container section body locking detents 243, and therefore second container section cap 250, from moving past second container section cap lock stops 1015.

Thus, the action of second container section cap lock curved guides 1011, second container section cap lock catches 1013, and second container section cap lock stops 1015 help create the leak proof seal between second container section cap 250 and second container section body 240 and prevent self-sealing threads 251 and 241 from being stripped, or otherwise damaged.

In addition, second container section cap lock stops 1015 make sure second container section cap 250 is in a desired position with respect to second container section body 240. In this way, a continuous flat surface, such as flat surface 293 of FIG. 2A, can be insured by keeping second container section cap 250 in the correct orientation with respect to second container section body 240.

Also of note in FIG. 10B and FIG. 10D is that, in one embodiment, there are three starting positions 1091 and three stopping positions, e.g., second container section cap lock stops 1015, for self-sealing threads 251. The result is that a user can more easily mate self-sealing threads 251 and 241 from various positions to allow second container section cap 250 to be properly coupled to second container section body 240. This feature is shown in detail in FIG. 10D.

In some instances, it may be desired to provide an interlocking sectional container in which the first container section cap interior surface portion and/or second container section cap interior surface portion are substantially flat.

Figure 11:
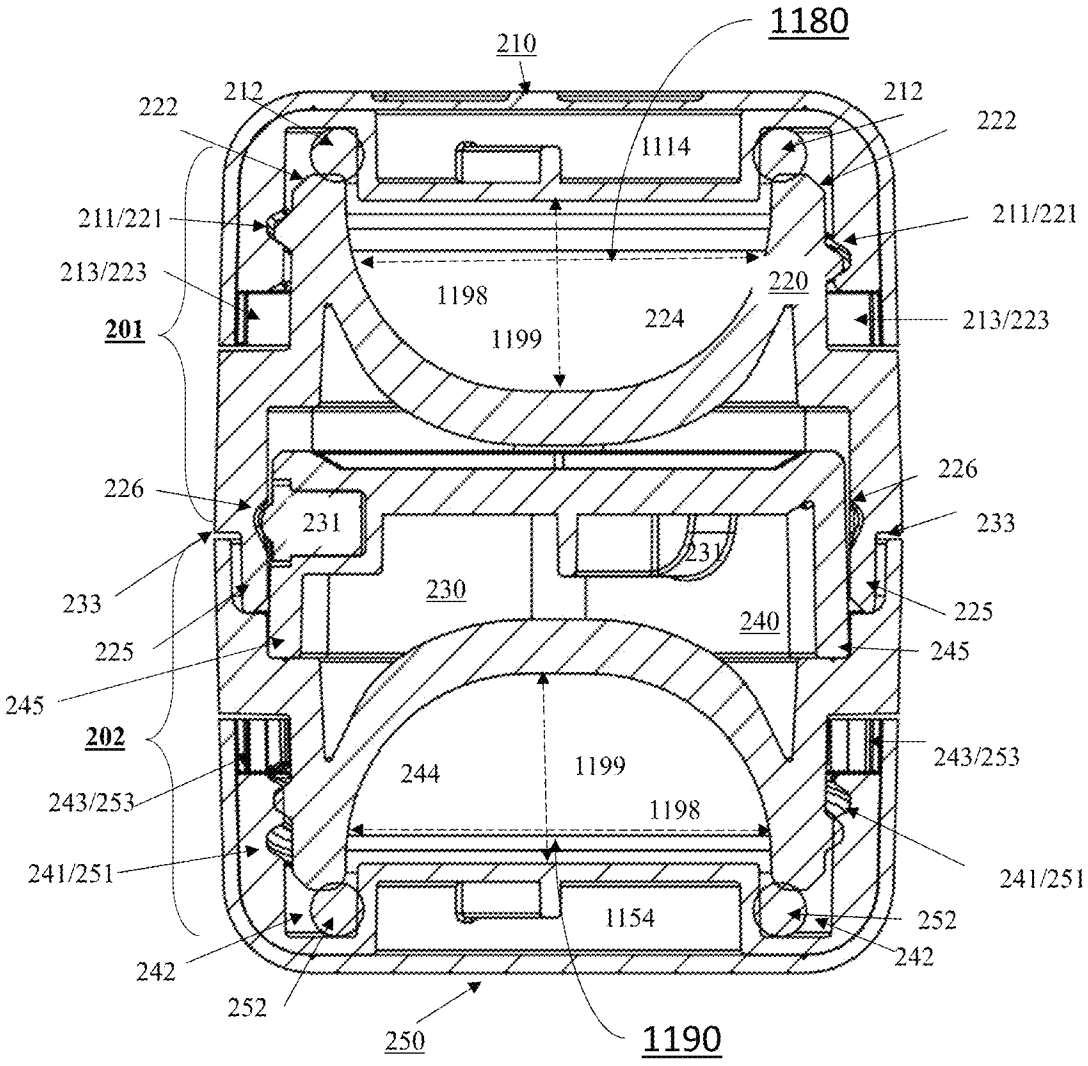
FIG. 11 is a side sectional view of an interlocking sectional container of in accordance with one embodiment.

FIG. 11 depicts an embodiment of interlocking sectional container 1100 that includes a first container section cap interior surface portion 1114 and a second container section cap interior surface portion 1154 are substantially level or flat.

Although the first container section cap interior surface portion 1114 and a second container section cap interior surface portion 1154 of interlocking sectional container 1100 are substantially flat, all other elements of interlocking sectional container 1100 are substantially the same as those disclosed and as discussed above with respect to interlocking sectional container 200 and FIGS. 2A-2G, 3A-3D, 4, 5A-5D, 6A-6E, 7A-7D, 8A-8E, 9A-9E, and 10A-10D. Consequently, the same elements in FIGS. 2A-2G, 3A-3D, 4, 5A-5D, 6A-6E, 7A-7D, 8A-8E, 9A-9E, and 10A-10D are labeled with the same numeral in FIG. 11. As a result, the reader is referred to the discussion above with respect to interlocking sectional container 200 and FIGS. 2A-2G, 3A-3D, 4, 5A-5D, 6A-6E, 7A-7D, 8A-8E, 9A-9E, and 10A-10D for a more detailed description of these elements and their operation as used in interlocking sectional container 1100 of FIG. 11.

In one embodiment, when the first container section cap self-sealing threads 211 of the first container section cap 210 and the first container section body self-sealing threads 221 of the first container section body 220 are used to removably couple the first container section cap 210 and the first container section body 220 to form leak-proof seal 211/221, the first container section cap interior surface portion 1114 of the first container section cap interior surface and the first container section body 220 interior surface 224 form a containment enclosure 1180 that is deep enough that both the item and the liquid can move freely within leak-proof containment enclosure 1180.

Similarly, in one embodiment, when the second container section cap self-sealing threads 251 of the second container section cap 250 and the second container section body self-sealing threads 241 of the second container section body 240 are used to removably couple the second container section cap 250 and the second container section body 240 to form a leak-proof seal 241/251, the second container section cap interior surface portion 1154 of the second container section cap interior surface and the of second container section body 240 interior surface 244 form a containment enclosure 1190 that is deep enough that both the item and the liquid can move freely within leak-proof containment enclosure 1190.

In one embodiment, when the container caps 210 and 250 and container bodies 220 and 240, respectively are removably connected by one or more leak-proof connection devices 211/221 and 241/251, respectively, the leak-proof containment enclosures 280 and 290 are formed each with a diameter dimension 1198 and depth dimension 1199 that are approximately equal for containing both an item, such as a contact lens, and its required fluid, such as contact lens solution.

In one embodiment, when the container caps 210 and 250 and container bodies 220 and 240, respectively, are removably connected by one or more leak-proof connection devices 211/221 and 241/251, respectively, the leak-proof containment enclosures 280 and 290 are formed each with a with a depth dimension 1199 that is approximately one half a diameter dimension 1198 for containing both an item, such as a contact lens, and its required fluid, such as contact lens solution.

Consequently, leak-proof containment enclosures 1180 and 1190 of the disclosed interlocking sectional container 1100 are dimensioned so that both the item and the liquid can move freely within leak-proof containment enclosures 1180 and 1190 and thereby remain in contact with each other. Consequently, when an item and its liquid are contained with the leak-proof containment enclosures 1180 and 1190 the item and liquid can freely move together within the leak-proof containment enclosures 1180 and 1190 so that the liquid remains in contact with the item regardless of orientation of the leak-proof containment enclosures 1180 and 1190 and/or the disclosed interlocking sectional container 1100.

As noted above, in some embodiments, interlocking sectional container 200 is a contact lens interlocking sectional container. In these embodiments, first container section 201 can be used to contain an item 283 that is a first contact lens and a fluid 281 that is a first portion of contact lens solution. Similarly, in these embodiments, second container section 202 can be used to contain an item 293 that is a second contact lens and fluid 291 that is a second portion of contact lens solution.

As discussed above, using the specific disclosed embodiment of an interlocking sectional container 200, an item, such as a contact lens, and its fluid, such as contact lens solution, are contained within spherical or ellipsoidal containment enclosure formed by a substantially semi-spherical or semi-ellipsoidal shaped container cap interior surface and substantially semi-spherical or semi-ellipsoidal shaped container body interior surface. As a result, the item, such as a contact lens, and the fluid, such as contact lens solution, can freely move together within the spherical or ellipsoidal containment enclosure and remains in contact with each other regardless of orientation of the container and/or the disclosed interlocking sectional container.

As also discussed above, using the specific disclosed embodiment of an interlocking sectional container 200 the first or second container section cap and first or second container section body are removably coupled by the one or more leak-proof coupling devices that include first or second container section cap self-sealing threads that mate with first or second container section body self-sealing threads.

Therefore, interlocking sectional container 200 provides a leak-proof container which prevents the fluid, such as contact lens solution, from leaking, evaporating, or otherwise getting released regardless of orientation of the container and even when the container is subject to significant use and abuse.

As also discussed above, according to the specific illustrative example of interlocking sectional container 200 the first container section and a second container section are removably connected by an interconnector. Therefore, according to the specific illustrative example of interlocking sectional container 200 the first and second container sections are removably attached to each other to form the disclosed interlocking sectional container. In this way, the disclosed first and second container sections can be separated from each other and manipulated separately.

Consequently, interlocking sectional container 200 provides a solution to the long-standing technical problem of providing a container that cost effectively, efficiently, and reliably keeps an item and its required fluid within the container and in contact with each other without leaking, evaporating, or otherwise getting released regardless of orientation of the container and even when the container is subject to significant use and abuse.

One embodiment of an interlocking sectional container includes a first container section for containing an item and a fluid. In one embodiment, the first container section is capable of being removably coupled to a second container section by an interconnector such that the first container section and a second container section can be connected and separated by a user as desired.

In one embodiment, the first container section includes a first container section cap. In one embodiment, the first container section cap has a first container section cap interior surface portion that is concave and curved and includes at least one first leak-proof coupling device for removably coupling the first container section cap to an at least one second leak-proof coupling device.

In one embodiment, the first container section includes a first container section body. In one embodiment, the first container section body has a first container section body interior surface portion that is concave and curved and includes at least one second leak-proof coupling device.

In one embodiment, the at least one first leak-proof coupling device of the first container section cap and the at least one second leak-proof coupling device of the first container section body are used to removably couple the first container section cap and the first container section body to form a leak-proof seal.

In one embodiment, when the at least one first leak-proof coupling device of the first container section cap and the at least one second leak-proof coupling device of the first container section body are used to removably couple the first container section cap and the first container section body to form a leak-proof seal, the concave and curved portion of the first container section cap interior surface and the concave and curved portion of the first container section body interior surface form a containment enclosure has continuously curved sides for containing both the item and the fluid such that the item and the fluid can freely move together within the first container section so that the item remains in contact with the fluid regardless of the orientation of the first container section.

In one embodiment the item is selected from the group of items consisting of a contact lens, a medical sample, a food item, a membrane, a reactive chemical, a live organism, and/or a preserved organism.

In one embodiment, at least one of the at least one first leak-proof coupling devices and at least one of the at least one second leak-proof coupling devices are self-sealing threads.

In one embodiment, at least one of the at least one first leak-proof coupling devices is an O-ring and at least one of the at least one second leak-proof coupling devices is an O-ring contact surface.

In one embodiment, the concave and curved portion of the first container section cap interior surface and the concave and curved portion of the first container section body interior surface form a concave and curved portion selected from the group of concave and curved portions consisting of a substantially semi-spherical concave and curved portion and a substantially semi-ellipsoidal concave and curved portion.

In one embodiment, the containment enclosure formed by the concave and curved portion of the first container section cap interior surface and the concave and curved portion of the first container section body interior surface is selected from the group of containment enclosures consisting of a substantially spherical containment enclosure, a substantially ellipsoidal containment enclosure, and/or a hybrid substantially spherical and substantially ellipsoidal containment enclosure.

In one embodiment, the interlocking sectional container has an exterior surface that includes at least one side that is flat.

In one embodiment, at least part of the interlocking sectional container is made of a material selected from the group of materials consisting of a polymer material, a metal material, an alloy material, and/or a ceramic material.

One embodiment of an interlocking sectional container includes a first container section for containing an item and a fluid. In one embodiment, the first container section is capable of being removably coupled to a second container section by an interconnector such that the first container section and a second container section can be connected and separated by a user as desired.

In one embodiment, the first container section includes a first container section cap. In one embodiment, the first container section cap has a first container section cap interior surface portion that is concave and curved and includes at least one first leak-proof coupling device for removably coupling the first container section cap to an at least one second leak-proof coupling device.

In one embodiment, the first container section includes a first container section body. In one embodiment, the first container section body has a first container section body interior surface portion that is concave and curved and includes at least one second leak-proof coupling device.

In one embodiment, the at least one first leak-proof coupling device of the first container section cap and the at least one second leak-proof coupling device of the first container section body are used to removably couple the first container section cap and the first container section body to form a leak-proof seal.

In one embodiment, when the at least one first leak-proof coupling device of the first container section cap and the at least one second leak-proof coupling device of the first container section body are used to removably couple the first container section cap and the first container section body to form a leak-proof seal, the concave and curved portion of the first container section cap interior surface and the concave and curved portion of the first container section body interior surface form a containment enclosure has continuously curved sides for containing both the item and the fluid such that the item and the fluid can freely move together within the first container section so that the item remains in contact with the fluid regardless of the orientation of the first container section.

One embodiment of the interlocking sectional container includes a second container section for containing a second item and a second fluid.

In one embodiment, the second container section includes a second container section cap. In one embodiment, the second container section cap has a second container section cap interior surface portion that is concave and curved and includes at least one first leak-proof coupling device for removably coupling the second container section cap to an at least one second leak-proof coupling device.

In one embodiment, the second container section includes a second container section body. In one embodiment, the second container section body has a second container section body interior surface portion that is concave and curved, the second container section body including at least one second leak-proof coupling device.

In one embodiment, the at least one first leak-proof coupling device of the second container section cap and the at least one second leak-proof coupling device of the second container section body are used to removably couple the second container section cap and the second container section body to form a leak-proof seal.

In one embodiment, when the at least one first leak-proof coupling device of the second container section cap and the at least one second leak-proof coupling device of the second container section body are used to removably couple the second container section cap and the second container section body to form a leak-proof seal, the concave and curved portion of the second container section cap interior surface and the concave and curved portion of the second container section body interior surface form a second containment enclosure has continuously curved sides for containing both the second item and the second fluid such that the second item and the second fluid can freely move together within the second container section so that the second item remains in contact with the second fluid regardless of the orientation of the second container section.

In one embodiment, the interlocking sectional container includes an interconnector. In one embodiment, the interconnector is coupled to the first container section body and the second container section body, the interconnector removably coupling the first container section and the second container section such that the first container section and the second container section can be connected and separated as desired.

In one embodiment, at least one of the first and second items are selected from the group of items consisting of a contact lens, a medical sample, a food item, a membrane, a reactive chemical, a live organism, and/or a preserved organism.

In one embodiment, at least one of the at least one first leak-proof coupling devices and at least one of the at least one second leak-proof coupling devices are self-sealing threads.

In one embodiment, at least one of the at least one first leak-proof coupling devices is an O-ring and at least one of the at least one second leak-proof coupling devices is an O-ring contact surface.

In one embodiment, at least one of the concave and curved portion of the first container section cap interior surface, the concave and curved portion of the first container section body interior surface, the concave and curved portion of second container section cap interior surface, and the concave and curved portion of the second container section body interior surface forms a concave and curved portion selected from the group of concave and curved portions consisting of, a substantially semi-spherical concave and curved portion, or a substantially semi-ellipsoidal concave and curved portion.

In one embodiment, at least one of the containment enclosure formed by the concave and curved portion of the first container section cap interior surface and the concave and curved portion of the first container section body interior surface and the second container section cap interior surface and the concave and curved portion of the second container section body interior surface is selected from the group of containment enclosures consisting of a substantially spherical containment enclosure, a substantially ellipsoidal containment enclosure, or a hybrid substantially spherical and substantially ellipsoidal containment enclosure.

In one embodiment, the interlocking sectional container has an exterior surface that includes at least one side that is flat.

In one embodiment, at least part of the interlocking sectional container is made of a material selected from the group of materials consisting of a polymer material, a metal material, an alloy material, and/or a ceramic material.

In one embodiment, an interlocking sectional contact lens container includes a first contact lens container section for containing a first contact lens and a first contact lens solution portion and a second contact lens container section for containing a second contact lens and second contact lens solution portion.

In one embodiment the first contact lens container section includes a first contact lens container section cap. In one embodiment, the first contact lens container section cap has a first contact lens container section cap interior surface portion that is concave and curved to form a substantially semi-spherical or substantially semi-ellipsoidal first contact lens container section body interior surface portion.

In one embodiment, the first contact lens container section cap includes at least one first leak-proof coupling device for removably coupling the first contact lens container section cap to an at least one second leak-proof coupling device.

In one embodiment the first contact lens container section includes a first contact lens container section body. In one embodiment, the first contact lens container section body has a first contact lens container section body interior surface portion that is concave and curved to form a substantially semi-spherical or substantially semi-ellipsoidal first contact lens container section body interior surface portion.

In one embodiment, the first contact lens container section body includes at least one second leak-proof coupling device.

In one embodiment, the at least one first leak-proof coupling device of the first contact lens container section cap and the at least one second leak-proof coupling device of the first contact lens container section body are used to removably couple the first contact lens container section cap and the first contact lens container section body to form a leak-proof seal.

In one embodiment, when the at least one first leak-proof coupling device of the first contact lens container section cap and the at least one second leak-proof coupling device of the first contact lens container section body are used to removably couple the first contact lens container section cap and the first contact lens container section body to form a leak-proof seal, the concave and curved portion of the first contact lens container section cap interior surface and the concave and curved portion of the first contact lens container section body interior surface form a first containment enclosure that is spherical or ellipsoidal has continuously curved sides for containing both the first item and the first fluid for containing both the first contact lens and the first contact lens solution portion such that first contact lens and the first contact lens solution portion can freely move together within the first containment enclosure so that the first contact lens remains in contact with the first contact lens solution portion regardless of the orientation of the first container section.

In one embodiment, the interlocking sectional contact lens container includes a second contact lens container section for containing a second contact lens and a second contact lens fluid portion. In one embodiment, the second contact lens container section includes a second contact lens container section cap. In one embodiment, the second contact lens container section cap has a second contact lens container section cap interior surface portion that is concave and curved to form a substantially semi-spherical or substantially semi-ellipsoidal second contact lens container section cap interior surface portion.

In one embodiment, the second contact lens container section cap includes at least one first leak-proof coupling device for removably coupling the second contact lens container section cap to an at least one second leak-proof coupling device.

In one embodiment, the second contact lens container section includes a second contact lens container section body. In one embodiment, the second contact lens container section body has a second contact lens container section body interior surface potion that is concave and curved to form a substantially semi-spherical or substantially semi-ellipsoidal second contact lens container section body interior surface portion.

In one embodiment, the second contact lens container section body includes at least one second leak-proof coupling device.

In one embodiment, the at least one first leak-proof coupling device of the second contact lens container section cap and the at least one second leak-proof coupling device of the second contact lens container section body are used to removably couple the second contact lens container section cap and the second contact lens container section body to form a leak-proof seal.

In one embodiment, when the at least one first leak-proof coupling device of the second contact lens container section cap and the at least one second leak-proof coupling device of the second contact lens container section body are used to removably couple the second contact lens container section cap and the second contact lens container section body to form a leak-proof seal, the concave and curved portion of the second contact lens container section cap interior surface and the concave and curved portion of the second contact lens container section body interior surface form a second containment enclosure that is spherical or ellipsoidal has continuously curved sides for containing both the second contact lens and the second contact lens solution portion such that the second contact lens and the second contact lens solution portion can freely move together within the second containment enclosure so that the second contact lens remains in contact with the second contact lens solution portion regardless of the orientation of the first container section.

In one embodiment, the interlocking sectional contact lens container includes an interconnector. In one embodiment, interconnector is coupled to the first contact lens container section body and the second contact lens container section body. In one embodiment, the interconnector removably couples the first contact lens container section and the second contact lens container section such that the first contact lens container section and a second contact lens container section can be connected and separated by as desired.

In one embodiment, at least one of the at least one first leak-proof coupling devices and at least one of the at least one second leak-proof coupling devices are self-sealing threads.

In one embodiment, at least one of the at least one first leak-proof coupling devices is an O-ring and at least one of the at least one second leak-proof coupling devices is an O-ring contact surface.

In one embodiment, at least one of the containment enclosures formed by the concave and curved portion of the first contact lens container section cap interior surface and the concave and curved portion of the first contact lens container section body interior surface and the second contact lens container section cap interior surface and the concave and curved portion of the second contact lens container section body interior surface is a hybrid substantially spherical and substantially ellipsoidal compartment.

In one embodiment, the interlocking sectional contact lens container has an exterior surface that includes at least one side that is flat.

The present invention has been described in particular detail with respect to specific possible embodiments. Those of skill in the art will appreciate that the invention may be practiced in other embodiments. For example, the nomenclature used for components, capitalization of component designations and terms, the attributes, data structures, or any other programming or structural aspect is not significant, mandatory, or limiting, and the mechanisms that implement the invention or its features can have various different names, formats, or protocols. Further, the system or functionality of the invention may be implemented via various combinations of software and hardware, as described, or entirely in hardware elements. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations shown in the figures, or as discussed herein, are identified using a particular nomenclature for ease of description and understanding, but other nomenclature is often used in the art to identify equivalent operations.

In addition, the operations and/or steps shown in the figures, or as discussed herein, are shown in a particular order for illustrative purposes only. The particular order of the operations and/or steps is not limiting nor is it intended to convey a required order.

Therefore, numerous variations, whether explicitly provided for by the specification or implied by the specification or not, may be implemented by one of skill in the art in view of this disclosure.

What is claimed is:

1. An interlocking sectional container comprising:

a first container section for containing an item and a fluid, the first container section including:

a first container section cap, the first container section cap having a first container section cap interior surface portion that is concave and curved, the first container section cap including at least one first leak-proof coupling device for removably coupling the first container section cap to an at least one second leak-proof coupling device; and a first container section body, the first container section body having a first container section body interior surface portion that is concave and curved, the first container section body including at least one second leak-proof coupling device, wherein the at least one first leak-proof coupling device of the first container section cap and the at least one second leak-proof coupling device of the first container section body are used to removably couple the first container section cap and the first container section body to form a leak-proof seal between the first container section cap and the first container section body, further wherein when the at least one first leak-proof coupling device of the first container section cap and the at least one second leak-proof coupling device of the first container section body are used to removably couple the first container section cap and the first container section body, the concave and curved portion of the first container section cap interior surface and the concave and curved portion of the first container section body interior surface form a containment enclosure having continuously curved sides for containing both the item and the fluid such that the item and the fluid can freely move together within the first container section so that the item remains in contact with the fluid regardless of the orientation of the first container section;

a second container section for containing an item and a fluid, the second container section including:

a second container section cap, the second container section cap having a second container section cap interior surface portion that is concave and curved, the second container section cap including at least one first leak-proof coupling device for removably coupling the second container section cap to an at least one second leak-proof coupling device; and a second container section body, the second container section body having a second container section body interior surface portion that is concave and curved, the second container section body including at least one second leak-proof coupling device, wherein the at least one first leak-proof coupling device of the second container section cap and the at least one second leak-proof coupling device of the second container section body are used to removably couple the second container section cap and the second container section body to form a leak-proof seal between the second container section cap and the second container section body, further wherein when the at least one first leak-proof coupling device of the second container section cap and the at least one second leak-proof coupling device of the second container section body are used to removably couple the second container section cap and the second container section body, the concave and curved portion of the second container section cap interior surface and the concave and curved portion of the second container section body interior surface form a containment enclosure having continuously curved sides for containing both the item and the fluid such that the item and the fluid can freely move together within the second container section so that the item remains in contact with the fluid regardless of the orientation of the second container section; and an interconnector section, the interconnector section being used to removably couple the first container section body and the second container section body, the interconnector section removably coupling the first container section and the second container section such that the first container section and the second container section can be separated from each other as desired to form two separate and distinct container sections, wherein the first container section has an exterior surface that includes at least one side that is flat and the second container section has an exterior surface that includes at least one side that is flat such that when the first container section and the second container section are removably coupled by the interconnector section, the at least one flat side of the first container section and the at least one flat side of the second container section are substantially aligned thereby preventing the interlocking sectional container from rolling when the interlocking sectional container is placed on its side, further wherein the first container section at least one flat side prevents the first container section from rolling when the first container section is separated from the second container section and is placed on its side and the second container section at least one flat side prevents the second container section from rolling when the second container section is separated from the first container section and is placed on its side.

2. The interlocking sectional container of claim 1 wherein the item is selected from the group of items consisting of:

a contact lens;

a medical sample;

a food item;

a membrane;

a chemical;

live organism; and a preserved organism.

3. The interlocking sectional container of claim 1 wherein at least one of the at least one first leak-proof coupling devices and at least one of the at least one second leak-proof coupling devices are self-sealing threads.

4. The interlocking sectional container of claim 3 wherein at least one of the at least one first leak-proof coupling devices is an O-ring and at least one of the at least one second leak-proof coupling devices is an O-ring contact surface.

5. The interlocking sectional container of claim 1 wherein the concave and curved portion of the first container section cap interior surface and the concave and curved portion of the first container section body interior surface form a concave and curved portion selected from the group of concave and curved portions consisting of:

a substantially semi-spherical concave and curved portion; and a substantially semi-ellipsoidal concave and curved portion.

6. The interlocking sectional container of claim 1 wherein the containment enclosure formed by the concave and curved portion of the first container section cap interior surface and the concave and curved portion of the first container section body interior surface is selected from the group of containment enclosures consisting of:

a substantially spherical containment enclosure;

a substantially ellipsoidal containment enclosure; and a hybrid substantially spherical and substantially ellipsoidal containment enclosure.

7. The interlocking sectional container of claim 1 wherein at least part of the interlocking sectional container is made of a material selected from the group of materials consisting of:

a polymer material;

a metal material;

an alloy material; and a ceramic material.

8. An interlocking sectional contact lens container comprising:

a first contact lens container section for containing a first contact lens and a contact lens solution, the first contact lens container section including:

a first contact lens container section cap, the first contact lens container section cap having a first contact lens container section cap interior surface portion that is concave and curved to form a substantially semi-spherical or substantially semi-ellipsoidal first contact lens container section body interior surface portion, the first contact lens container section cap including at least one first leak-proof coupling device for removably coupling the first contact lens container section cap to an at least one second leak-proof coupling device; and a first contact lens container section body, the first contact lens container section body having a first contact lens container section body interior surface portion that is concave and curved to form a substantially semi-spherical or substantially semi-ellipsoidal first contact lens container section body interior surface portion, the first contact lens container section body including at least one second leak-proof coupling device, wherein the at least one first leak-proof coupling device of the first contact lens container section cap and the at least one second leak-proof coupling device of the first contact lens container section body are used to removably couple the first contact lens container section cap and the first contact lens container section body to form a leak-proof seal between the first contact lens container section cap and the first contact lens container section body, further wherein when the at least one first leak-proof coupling device of the first contact lens container section cap and the at least one second leak-proof coupling device of the first contact lens container section body are used to removably couple the first contact lens container section cap and the first contact lens container section body to form a leak-proof seal, the concave and curved portion of the first contact lens container section cap interior surface and the concave and curved portion of the first contact lens container section body interior surface form a first leak-proof containment enclosure that is spherical or ellipsoidal having continuously curved sides for containing both the first contact lens and the first contact lens solution such that first contact lens and the first contact lens solution can freely move together within the first containment enclosure so that the first contact lens remains in contact with the first contact lens solution regardless of the orientation of the first container section;

a second contact lens container section for containing a second contact lens and a second contact lens fluid, the second contact lens container section including:

a second contact lens container section cap, the second contact lens container section cap having a second contact lens container section cap interior surface portion that is concave and curved to form a substantially semi-spherical or substantially semi-ellipsoidal second contact lens container section cap interior surface portion, the second contact lens container section cap including at least one first leak-proof coupling device for removably coupling the second contact lens container section cap to an at least one second leak-proof coupling device; and a second contact lens container section body, the second contact lens container section body having a second contact lens container section body interior surface potion that is concave and curved to form a substantially semi-spherical or substantially semi-ellipsoidal second contact lens container section body interior surface portion, the second contact lens container section body including at least one second leak-proof coupling device, wherein the at least one first leak-proof coupling device of the second contact lens container section cap and the at least one second leak-proof coupling device of the second contact lens container section body are used to removably couple the second contact lens container section cap and the second contact lens container section body to form a leak-proof seal between the second contact lens container section cap and the second contact lens container section body, further wherein when the at least one first leak-proof coupling device of the second contact lens container section cap and the at least one second leak-proof coupling device of the second contact lens container section body are used to removably couple the second contact lens container section cap and the second contact lens container section body, the concave and curved portion of the second contact lens container section cap interior surface and the concave and curved portion of the second contact lens container section body interior surface form a second leak-proof containment enclosure that is spherical or ellipsoidal having continuously curved sides for containing both the second contact lens and the second contact lens solution such that the second contact lens and the second contact lens solution can freely move together within the second containment enclosure so that the second contact lens remains in contact with the second contact lens solution regardless of the orientation of the first container section; and an interconnector section, the interconnector section being used to removably couple the first contact lens container section body and the second contact lens container section body, the interconnector section removably coupling the first contact lens container section and the second contact lens container section such that the first contact lens container section and the second contact lens container section can be separated from each other as desired to form two separate and distinct contact lens container sections, wherein the first contact lens container section has an exterior surface that includes at least one side that is flat and the second contact lens container section has an exterior surface that includes at least one side that is flat such that when the first contact lens container section and the second contact lens container section are removably coupled by the interconnector section, the at least one flat side of the first contact lens container section and the at least one flat side of the second contact lens container section are substantially aligned thereby preventing interlocking sectional contact lens container from rolling when the interlocking sectional contact lens container is placed on its side, further wherein the first contact lens container section at least one flat side prevents the first contact lens container section from rolling when the first contact lens container section is separated from the second contact lens container section and is placed on its side and the second contact lens container section at least one flat side prevents the second contact lens container section from rolling when the second contact lens container section is separated from the first contact lens container section and is placed on its side.

9. The interlocking sectional contact lens container of claim 8 wherein at least one of the at least one first leak-proof coupling devices and at least one of the at least one second leak-proof coupling devices are self-sealing threads and at least one of the at least one first leak-proof coupling devices is an O-ring and at least one of the at least one second leak-proof coupling devices is an O-ring contact surface.

10. The interlocking sectional contact lens container of claim 8 wherein at least one of the containment enclosure formed by the concave and curved portion of the first contact lens container section cap interior surface and the concave and curved portion of the first contact lens container section body interior surface and the second contact lens container section cap interior surface and the concave and curved portion of the second contact lens container section body interior surface is a hybrid substantially spherical and substantially ellipsoidal compartment.

11. The interlocking sectional contact lens container of claim 8 wherein the interconnector section has an exterior surface that includes at least one side that is flat.

* * * * *